US009110396B2

(12) United States Patent
Toyoda et al.

(10) Patent No.: US 9,110,396 B2
(45) Date of Patent: Aug. 18, 2015

(54) MECHANISM FOR ELECTRIFYING, METHOD OF ELECTRIFYING, AND CONDUCTIVE MEMBER

(71) Applicants: Minoru Toyoda, Hyogo (JP); Hirobumi Ooyoshi, Kanagawa (JP)

(72) Inventors: Minoru Toyoda, Hyogo (JP); Hirobumi Ooyoshi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/162,458

(22) Filed: Jan. 23, 2014

(65) Prior Publication Data

US 2014/0133884 A1 May 15, 2014

Related U.S. Application Data

(63) Continuation of application No. 12/926,095, filed on Oct. 26, 2010, now Pat. No. 8,682,199.

(30) Foreign Application Priority Data

Oct. 27, 2009 (JP) ..... 2009-246951

(51) Int. Cl.
*G03G 15/02* (2006.01)
*G03G 15/00* (2006.01)

(52) U.S. Cl.
CPC ..... *G03G 15/0208* (2013.01); *G03G 15/751* (2013.01); *G03G 15/80* (2013.01)

(58) Field of Classification Search
CPC ..... G03G 15/80; G03G 21/1652; G03G 21/1867; G03G 2221/166
USPC ..... 399/90; 361/214, 220
See application file for complete search history.

(56) References Cited

U.S. PATENT DOCUMENTS

| | | | | |
|---|---|---|---|---|
| 6,167,219 | A | 12/2000 | Miyamoto et al. | |
| 6,265,046 | B1 | 7/2001 | Swift | |
| 6,725,009 | B1 | 4/2004 | Tatematsu et al. | |
| 6,771,915 | B2 | 8/2004 | Cais et al. | |
| 6,845,226 | B2 | 1/2005 | Tatematsu et al. | |
| 7,599,652 | B2 | 10/2009 | Takagami | |
| 2004/0161254 | A1 * | 8/2004 | Martin et al. | 399/67 |

(Continued)

FOREIGN PATENT DOCUMENTS

| | | | |
|---|---|---|---|
| CN | 101114150 | A | 1/2008 |
| CN | 101666989 | A | 3/2010 |

(Continued)

OTHER PUBLICATIONS

Machine Translation of JP 2002-116660 A, obtained on Nov. 12, 2014.*

(Continued)

*Primary Examiner* — Gregory H Curran
(74) *Attorney, Agent, or Firm* — Harness, Dickey & Pierce, P.L.C.

(57) ABSTRACT

A mechanism for electrifying a rotator that is used in an image forming apparatus includes a cloth-like or sheet-like conductive member, wherein part of the conductive member comes into contact with an object to be electrified and the other part of the conductive member comes into surface contact with any one contact member of the rotator, a rotating shaft that rotates together with the rotator, and a shaft where the rotator is rotatably supported, so that the object to be electrified and the contact member are electrically connected to each other through the conductive member.

18 Claims, 51 Drawing Sheets

(56) References Cited

U.S. PATENT DOCUMENTS

| | | | | |
|---|---|---|---|---|
| 2008/0145119 | A1 | 6/2008 | Tatsumi et al. | |
| 2008/0152371 | A1 * | 6/2008 | Burry et al. | 399/50 |
| 2008/0152408 | A1 | 6/2008 | Kawakami et al. | |
| 2008/0279586 | A1 | 11/2008 | Tatsumi et al. | |
| 2009/0022531 | A1 | 1/2009 | Kubota et al. | |
| 2009/0154973 | A1 | 6/2009 | Shimizu et al. | |
| 2010/0054825 | A1 | 3/2010 | Ju et al. | |

FOREIGN PATENT DOCUMENTS

| | | | |
|---|---|---|---|
| JP | H05-297782 | A | 11/1993 |
| JP | H11-249495 | A | 9/1999 |
| JP | 2000-048873 | A | 2/2000 |
| JP | 2002-062759 | A | 2/2002 |
| JP | 2002-116660 | A | 4/2002 |
| JP | 2007-057945 | A | 3/2007 |
| JP | 3950635 | B2 | 8/2007 |
| WO | WO-0131405 | A1 | 5/2001 |

OTHER PUBLICATIONS

European Search Report fo EP 10188923.6 dated Feb. 26, 2011.
Abstract of JP2002-226074 published Aug. 14, 2002.
Japanese Office Action dated Jul. 15, 2014 in corresponding Japanese Application No. 2010-229137.
Chinese Office Action dated Feb. 7, 2014 for corresponding Chinese Application No. 201110276775.8.

* cited by examiner

PHOTOGRAPH MAGNIFIED 30x

PHOTOGRAPH MAGNIFIED 100x

RESISTANCE: LESS THAN 0.01 Ω
THICKNESS: 0.25 mm

STATE BEFORE FLANGE ASSEMBLY IS PRESS-FITTED INTO PHOTORECEPTOR

STATE AFTER FLANGE ASSEMBLY IS PRESS-FITTED INTO PHOTORECEPTOR

FIG. 66A

CONFIGURATION DIAGRAM OF CONDUCTIVE CLOTH 6D1 EQUIPPED WITH PET SHEET 37 (BEFORE MOUNTING GROUNDING PLATE 5)

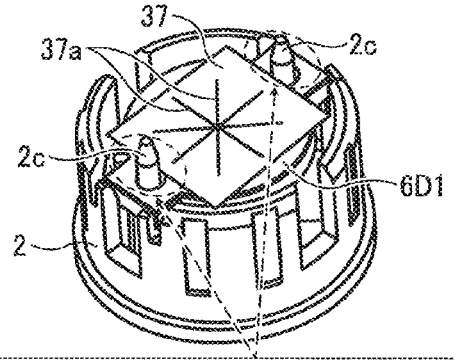

THESE PORTIONS ARE OUT OF PET SHEET 37, AND COME INTO CONTACT WITH GROUNDING PLATE 5

FIG. 66B

CONFIGURATION DIAGRAM OF CONDUCTIVE CLOTH 6D1 EQUIPPED WITH PET SHEET 37

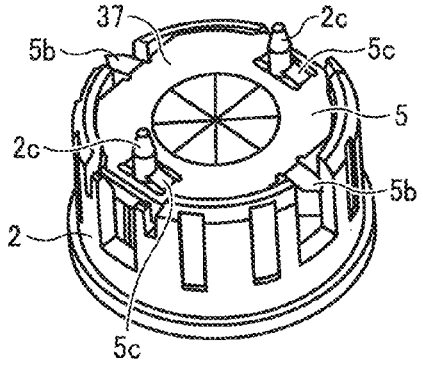

FIG. 66C

WHEN SHAFT PASSES THROUGH FLANGE ASSEMBLY 32A

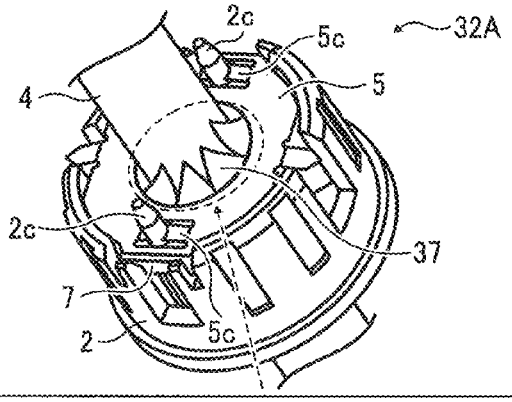

SHAFT 4 COMES INTO CONTACT WITH CONDUCTIVE CLOTH 6D1
PET SHEET 37 ONLY PRESSES CONDUCTIVE CLOTH 6D1

| | PRESSING LOAD [N] |
|---|---|
| CONDUCTIVE CLOTH ALONE | 0.08 N |
| CONDUCTIVE CLOTH WITH PET SHEET THICKNESS: 0.075 mm | 0.24 N |
| CONDUCTIVE CLOTH WITH PET SHEET THICKNESS: 0.125 mm | 0.34 N |

MECHANISM FOR ELECTRIFYING, METHOD OF ELECTRIFYING, AND CONDUCTIVE MEMBER

CROSS-REFERENCE TO RELATED APPLICATIONS

The present application is a continuation of U.S. application Ser. No. 12/926,095 filed on Oct. 26, 2010 and claims priority to and incorporates by reference the entire contents of Japanese Patent Application No. 2009-246951 filed in Japan on Oct. 27, 2009.

BACKGROUND OF THE INVENTION

1. Field of the Invention

The present invention relates to a mechanism for electrifying (e.g., grounding), a method of electrifying (e.g., grounding), and a conductive member.

2. Description of the Related Art

Regarding an electrifying mechanism, such as a grounding mechanism, which is used in an electrophotographic image forming apparatus, such as a copying machine, a facsimile, a printer, a plotter, or a multifunction peripheral having these functions, it has been proposed a technique of achieving electrical connection, e.g., grounding, by the use of a static eliminating cloth, a conductive cloth having conductivity and flexibility, or a conductive sheet (for example, see Japanese Patent Application Laid-open No. 2000-48873, Japanese Patent Application Laid-open No. 2007-57945, and Japanese Patent Application Laid-open No. H11-249495 and Japanese Patent No. 3950635).

Japanese Patent Application Laid-open No. 2000-48873 discloses a grounding device for a conductive rotary shaft that is used in a sheet conveying apparatus. The grounding device includes a grounding unit having a core made of an elastic material and a conductive material (a cloth, hereinafter referred to as a "conductive cloth") formed around the core. A conductive surface of the grounding unit is biased against the surface of the conductive shaft that is rotating, and another conductive surface of the grounding unit is brought into contact with a conductive member that is electrically connected to the grounded frame of the main body of the grounding device, so that the conductive shaft that is rotating is grounded.

Japanese Patent Application Laid-open No. 2007-57945 discloses a technique of achieving the grounding by the use of a static eliminating member, which is provided near a transfer unit to eliminate the static of a recording medium. The static eliminating member uses a static eliminating cloth (conductive cloth) made of a sheet-like conductive fiber aggregate as a base material. The static eliminating cloth is attached to a member and comes into press contact with the member while it is moved in synchronization with the member, so that grounding is achieved.

Japanese Patent Application Laid-open No. H11-249495 discloses a structure including a shaft contact spring (first leaf spring) of a drum grounding plate that comes into contact with an electrical connection shaft by which a photosensitive drum (cylindrical member) is rotatably supported, and two or more grounding spring contact parts (second leaf springs) of cylinder springs and that come into contact with an inner wall of the photosensitive drum, in which the electrical connection shaft and the inner wall of the photosensitive drum are electrically connected to each other (see FIGS. 4 and 20 to 24 of Japanese Patent Application Laid-open No. H11-249495).

Japanese Patent No. 3950635 discloses a static eliminator for a paper conveying apparatus which grounds the static generated from triboelectric charge between a roller and paper and in which a rotary shaft, which supports a paper conveying roller, is supported in a freely rotatable manner at the both ends by supporting members. In this technique, a conductive member for grounding contacts a portion of the peripheral surface of the rotary shaft (which includes an outer circumferential surface and an end face) via a static eliminating cloth, a conductive lubricant is applied to the surface of the static eliminating cloth that faces the rotary shaft made of a metal, and the surface of the conductive member for grounding, on which the static eliminating cloth is attached, has an exposed opposing surface where the conductive member for grounding does not contact the rotary shaft made of a metal (see FIGS. 2, 3, and 6 of Japanese Patent No. 3950635).

However, in the technique disclosed in Japanese Patent Application Laid-open No. 2000-48873, the conductive shaft is pressed against the conductive cloth from above in a vertical direction by the weight of the conveying roller including the conductive shaft, so that electrical connection, e.g., grounding is achieved. Flexibility of the conductive cloth is not actively used in this technique.

In the technique disclosed in Japanese Patent Application Laid-open No. 2007-57945, the static eliminating cloth is attached to a member and comes into press contact with the member by being moved in synchronization with the member. Accordingly, flexibility of the conductive cloth is not actively used like in Japanese Patent Application Laid-open No. 2000-48873.

In the technique disclosed in Japanese Patent Application Laid-open No. 11-249495, a conductive cloth is not used and the electrical connection shaft made of a metal and the first leaf spring, which is also a metal member, slide on each other, so that abrasion occurs on either one or both of the members. For this reason, there have been problems, such as abnormal sound caused by abrasion, poor electrical connection caused by the oxidation of metal, and a large load caused by press contact. As measures against the sliding between metals, a conductive lubricant may be used to solve the above-mentioned problems. However, a conductive lubricant is scraped off at a contact point between metal members as sliding is done many times. Accordingly, although a conductive lubricant is a very effective measure at the early stage of sliding, it is not the fundamental solution.

Since an office machine, which is an electrophotographic image forming apparatus, such as a copying machine, a facsimile, or a printer, is used indoors, it is particularly required that no noise, no abnormal sound, is generated.

Even in the technique disclosed in Japanese Patent No. 3950635, flexibility of the conductive cloth is not actively used like in the techniques of Japanese Patent Application Laid-open No. 2000-48873, Japanese Patent Application Laid-open No. 2007-57945, and H11-249495.

The invention is made in view of the above circumstances and it is an object of the invention to provide a mechanism for electrifying (grounding) a rotator that solves problems caused by the sliding between metals and has a structure which is simple, inexpensive, and environment-friendly, and does not use a conductive lubricant, the mechanism for electrifying (grounding) a rotator being used in any one of an electrophotographic image forming apparatus, an electrostatic recording image forming apparatus, and a magnetic recording image forming apparatus; an image carrier unit, a process cartridge, a belt unit, a fixing unit, a sheet conveying unit, and an image forming apparatus that respectively uses the mechanism for electrifying a rotator; a method of electrifying (grounding) a rotator; and a conductive member (e.g., a conductive cloth).

The above and other objects, features, advantages and technical and industrial significance of this invention will be better understood by reading the following detailed description of presently preferred embodiments of the invention, when considered in connection with the accompanying drawings.

SUMMARY OF THE INVENTION

It is an object of the present invention to at least partially solve the problems in the conventional technology.

According to one aspect of the invention, a mechanism for electrifying a rotator that is used in an image forming apparatus includes a cloth-like or sheet-like conductive member, wherein part of the conductive member comes into contact with an object to be electrified and the other part of the conductive member comes into surface contact with any one contact member of the rotator, a rotating shaft that rotates together with the rotator, and a shaft where the rotator is rotatably supported, so that the object to be electrified and the contact member are electrically connected to each other through the conductive member.

According to another aspect of the invention, a method of electrifying a rotator that uses a cloth-like or sheet-like conductive member having flexibility and that is used in an image forming apparatus, the method includes previously forming at least one through-contact portion of a cut and a cutout portion through which an end face of the contact member orthogonal to a longitudinal direction of the contact member passes and which allows the conductive member to come into contact with the contact member while the conductive member is bent when the end portion passes through the through-contact portion, and then, electrifying the object to be electrified and the contact member through the conductive member by making the contact member be inserted into and pass through the through-contact portion, when electrically connecting the object to be electrified with any one contact member of the rotator, a rotating shaft rotating together with the rotator, and a shaft where the rotator is rotatably supported, through the conductive member.

According to still another aspect of the invention, a cloth-like or sheet-like conductive member comes into surface contact with a contact member.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 66A to 66C are photographs showing perspective illustration of exploded parts of a flange for explaining a transition state for assembling the flange assembly of the second example;

DETAILED DESCRIPTION OF THE PREFERRED EMBODIMENTS

Figure 1:
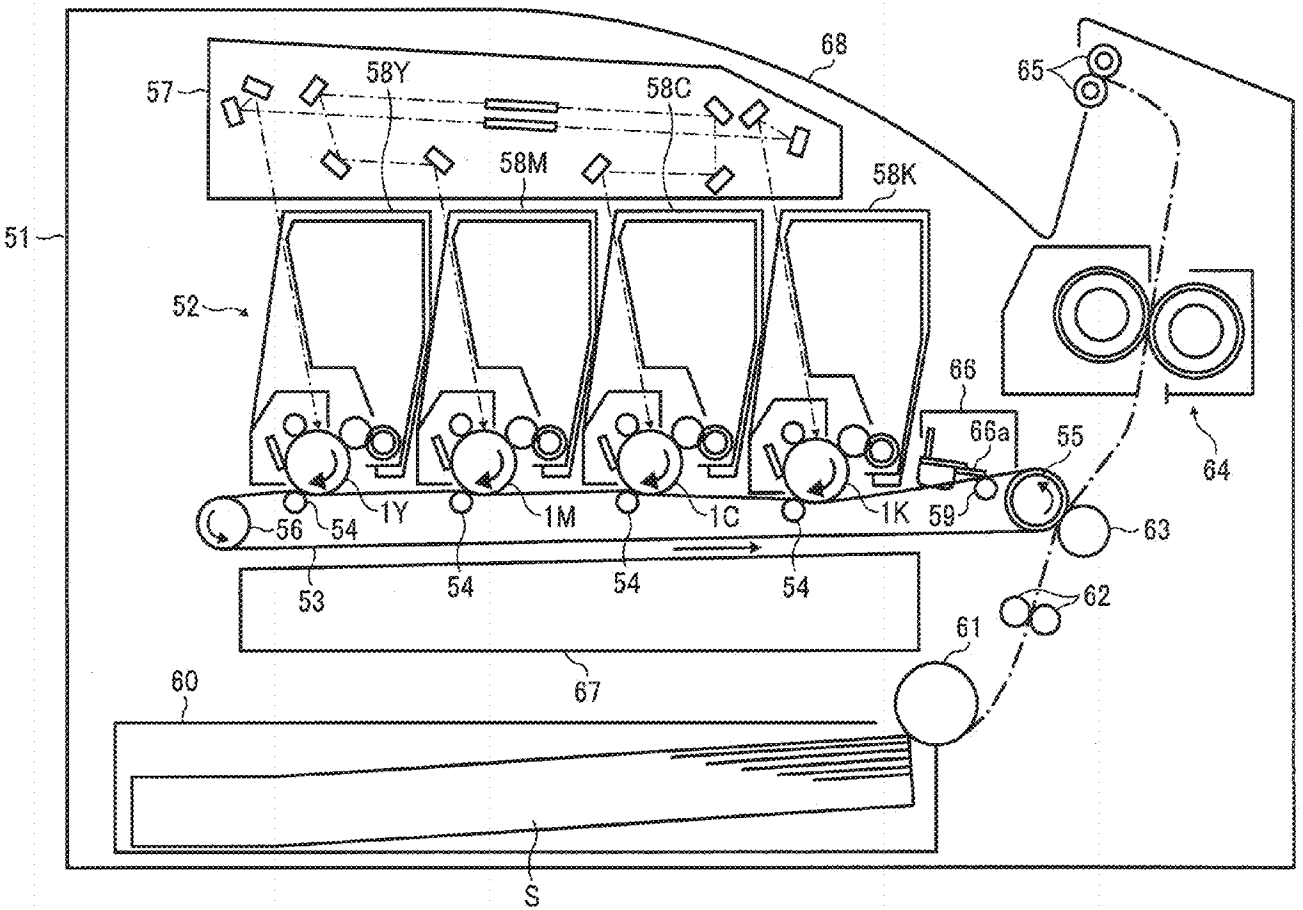
FIG. 1 is a schematic view showing the entire structure of a color image forming apparatus to which a first embodiment is applied.

Embodiments of the invention including examples will be described below with reference to drawings. As long as there is no concern that the elements are mistakable over the respective embodiments, elements (members or components) having the same functions and shapes will be denoted by the same reference numerals. If elements, which should be shown in drawings, do not need to be particularly described in the drawings, the elements will be appropriately omitted for the simplification of drawings and description.

First Embodiment

The entire structure and operation of an electrophotographic color image forming apparatus 50 to which a first embodiment of the invention is applied will be described first with reference to FIG. 1. FIG. 1 is a schematic cross-sectional view showing the internal structure of the color image forming apparatus 50.

As shown in FIG. 1, the color image forming apparatus 50 includes four process cartridges 58K, 58C, 58M, and 58Y serving as process cartridges constituting an image forming section. The process cartridges are arranged in parallel in this order from the left side to the right side at a substantially middle portion of a main body frame 51 that forms a machine frame serving as a main body of the apparatus. An exposure device 57 serving as an exposure unit and a latent image forming unit is disposed above the process cartridges 58K, 58C, 58M, and 58Y to form latent images on image carriers 1K, 1C, 1M, and 1Y, respectively. In the example shown in FIG. 1, each of the image carriers 1K, 1C, 1M, and 1Y is formed of a photoreceptor, and a black toner image, a cyan toner image, a magenta toner image, and a yellow toner image are formed on the surfaces of the photoreceptors, respectively.

Hereinafter, the process cartridges 58K, 58C, 58M, and 58Y have the same structure but for the color of toner used as developer and the toner image to be formed. Accordingly, when being generally described, these will be referred to as process cartridges 58 without affixing the reference letters representing colors. Likewise, when being described in general, these image carriers 1K, 1C, 1M, and 1Y will be referred to as image carriers 1 without the reference letters representing colors.

As shown in detail in FIGS. 1 and 2, each process cartridge 58 includes an image carrier unit 10 that includes an image carrier 1 and the like as described below, a charging roller 11 constituting a charging device as a charging unit, a cleaning blade 13 constituting a cleaning device as a cleaning unit, and a frame 14 as a casing-like support member that integrally supports a developing roller 12 constituting a developing device as a developing unit. Each process cartridge 58 is detachably mounted on the main body frame 51 of the color image forming apparatus 50 via the frame 14. The frame 14 includes a pair of support side plates (not shown) that are disposed on the front and rear sides of the plane of FIG. 2.

The charging roller 11 comes into press contact with the outer peripheral surface of the image carrier 1. Accordingly, while the charging roller is rotated by the rotation of the image carrier 1, a DC bias or a bias where an AC bias is superimposed on a DC bias is applied to the charging roller by a high-voltage power source (not shown). As a result, the image carrier 1 is charged to a uniform surface potential (for example, −200 to −1000 V).

The developing device, which includes the developing roller 12 and the like, is a one-component contact developing unit, and an electrostatic latent image formed on the image carrier 1 is developed into a toner image by a predetermined developing bias supplied from a high-voltage power source (not shown).

An endless intermediate transfer belt 53 as an intermediate transfer body, which carries and conveys a toner image as a transfer image, is disposed below the process cartridges 58. The intermediate transfer belt 53 is stretched by a plurality of rotary members, that is, a driving roller 55 also serving as a secondary transfer opposite roller, a cleaning opposite roller 59 made of metal, primary transfer rollers 54, and a driven roller 56 also serving as a tension roller. The intermediate transfer belt is rotationally driven in a direction of an arrow in the drawing via the driving roller 55 by a driving motor (not shown) serving as a driving unit that is connected to the driving roller 55 via a driving force transmitting unit, such as a gear or a belt. Among the plurality of rotary members, the driving roller 55 is a driving rotary member and the driven roller 56 is a driven rotary member.

Meanwhile, bearing parts, which are provided at both ends of the driven roller 56, are pressurized by springs (not shown), so that belt tension applied to the intermediate transfer belt 53 is generated. The respective rollers, which stretch the intermediate transfer belt 53, are supported on both sides of the intermediate transfer belt 53 by a pair of side plates (not shown) of an intermediate transfer belt unit.

An endless belt of a resin film form that is obtained by dispersing a conductive material such as carbon black in PVDF (polyvinylidene fluoride), ETFE (ethylene-tetrafluoroethylene copolymer), PI (polyimide), PC (polycarbonate), TPE (thermoplastic elastomer), or the like is used as the intermediate transfer belt 53.

The primary transfer rollers 54, which form a primary transfer device, are disposed below the positions where the image carriers 1 of the process cartridges 58 come into contact with the intermediate transfer belt 53. A conductive blade, a conductive sponge roller, a metal roller, or the like may be used as the primary transfer roller 54. However, a metal roller is used as the primary transfer roller in this embodiment, and the primary transfer roller is disposed so as to be offset from the image carrier 1 in the moving direction of the intermediate transfer belt 53 and in a vertical direction. When a predetermined transfer bias (for example, +500 to +1000 V) is commonly applied to the primary transfer rollers 54 by a single high-voltage power source (not shown), transfer electric fields are formed on the image carriers 1 through the intermediate transfer belt 53 and a potential difference is generated between the image carriers 1 and the intermediate transfer belt 53. Accordingly, monochrome toner images corresponding to respective colors, which are formed on the surfaces of the image carriers 1, are transferred to the intermediate transfer belt 53.

These monochrome toner images corresponding to the respective colors are sequentially transferred to the intermediate transfer belt 53 by the respective process cartridges 58.

Accordingly, a color toner image having a plurality of colors, which is formed by superimposing the monochrome toner images, is formed on the intermediate transfer belt 53.

A sheet feed cassette 60 of a sheet feeding device, in which transfer materials such as paper or OHP sheets or sheet-like recording media (hereinafter, referred to as "sheets") S are stacked and received, is disposed below the intermediate transfer belt 53. The sheets S are separated and fed one by one by a sheet separating unit (not shown) and a sheet feed roller 61 of the sheet feeding device, passes between the intermediate transfer belt 53 and a secondary transfer roller 63 serving as a secondary transfer device by the driving roller 55 and is guided to a fixing device 64. Accordingly, the toner image is fixed to the sheet S by heat and pressure.

The sheet S fed from the sheet feed roller 61 is temporarily stopped at resist rollers 62 serving as resist means, and the sheet is aligned. After that, when the front end portion of the monochrome or color toner image formed on the surface of the intermediate transfer belt 53 reaches a secondary transfer position, the sheet is fed to the secondary transfer roller 63. When a high potential is applied to the secondary transfer roller 63 and there is a potential difference between the intermediate transfer belt 53 and the secondary transfer roller 63, the monochrome or color toner image formed on the intermediate transfer belt 53 is transferred to the sheet S.

Meanwhile, a roller, which is obtained by coating a metal core that has a diameter of, for example, 6 mm and is made of SUS or the like with an elastic body of a conductive material is used as the secondary transfer roller 63. For example, an electronically conductive roller, a conductive roller made of EPDM, or the like is used as the secondary transfer roller 63.

A sheet S to which an unfixed toner image has been transferred is released from the intermediate transfer belt 53 due to the curvature of the driving roller (secondary transfer opposite roller) 55 disposed on a longitudinal sheet feed path, and the toner image is melted and fixed to the sheet S by the fixing device 64. Then, the sheet is ejected and discharged to a sheet discharge tray 68, which is provided on the upper surface of the main body frame 51, by a sheet discharge roller 65 of a sheet discharge device.

Surplus toner, which remains on the surface of the intermediate transfer belt 53 from which the toner image has been transferred to the sheet S, is scraped by a cleaning blade 66*a* of an intermediate transfer body cleaning device 66 so that the intermediate transfer belt is cleaned. Then, the scraped toner is recovered by a toner recovery device 67 by way of a toner conveying path (not shown). The cleaned intermediate transfer belt 53 gets ready for the transfer of the next toner image.

Meanwhile, for example, urethane rubber is used as a material of the cleaning blade 66*a*, and the cleaning blade comes into counter contact with the intermediate transfer belt 53. It is preferable to prevent the blade from being turned up by applying a lubricant to at least either of a portion of the intermediate transfer belt 53 corresponding to a cleaning nip portion and an edge portion of the cleaning blade 66*a* during the assembly work, and to improve cleaning performance by forming a dam layer at the cleaning nip portion.

Since a sheet conveying path, from the feeding of the sheet S to the discharge of the sheet, is simplified as much as possible and the radius of curvature of the sheet conveying path is increased as shown in FIG. 1, the color image forming apparatus 50 may prevent a sheet jam during the conveyance of a sheet and improve reliability. Further, the color image forming apparatus 50 is configured to allow an easy operation in removing a sheet jam when the sheet jam occurs and to be applied to a multi-purpose color electrophotographic device using various kinds of recording media, for example, thick paper.

In this embodiment, the sheet conveying path is formed to have a substantially circular arc shape. The intermediate transfer belt 53, the process cartridges 58, and the exposure device 57 are disposed on the inner side of the sheet conveying path. Accordingly, a space in the main body frame 51 is effectively used, which allows size reduction of the apparatus. In addition, the sheet conveying path is simplified, and the sheet S is ejected with the image-formed surface down.

According to the above-mentioned structure, the sheet conveying path may be simplified and almost all of the units are disposed on the inner side of the sheet conveying path, so that the sheet conveying path becomes closer to the main body frame 51 that is disposed at a relatively outer portion of the image forming apparatus. Accordingly, since the sheet conveying path is easily opened, an operation of removing a sheet jam is also easily performed when the sheet jam occurs. Further, since the sheet S is ejected to the sheet discharge tray 68 provided on the upper surface of the main body frame 51 in a posture in which the image-formed surface faces downward, when the sheets S stacked on the sheet discharge tray 68 are taken out, the image-formed surfaces of the sheets S face upward. This is advantageous in that the sheets are arranged in the printing order from the top to the bottom in the stack.

Furthermore, it is configured such that the right-hand side of FIG. 1 is the front side, an openable cover unit (not shown) is provided on the right side of the substantially middle of the sheet conveying path, and the sheet conveying path may be exposed to the outside when the cover unit is opened. Accordingly, an operation of removing a sheet jam is also more easily performed when the sheet jam occurs.

An electrophotographic image forming process will be described below. FIG. 2 is a cross-sectional view of the process cartridge 58.

Figure 2:
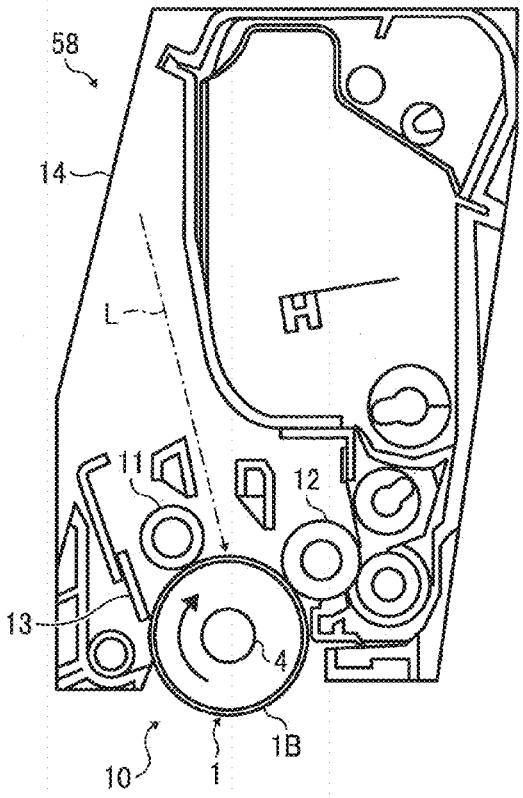
FIG. 2 is a cross-sectional view of main parts of a process cartridge to which the first embodiment is applied.

In FIGS. 1 and 2, the image carrier 1 has a cylindrical shape and is rotationally driven in a direction of an arrow of FIG. 2 by a driving unit (not shown) provided in the main body frame 51, and a photosensitive layer 1B formed on the surface of the image carrier is charged uniformly to a high potential by the charging roller 11. The uniformly charged photosensitive layer 1B is exposed to a light beam (for example, laser light) L based on the image information output from the exposure device 57 that is the latent image forming means. An electrostatic latent image is formed on the photosensitive layer 1B by this exposure. The electrostatic latent image including a low potential portion with a reduced potential and a high potential portion resulting from initializing is formed in the photosensitive layer 1B. Subsequently, when the low potential portion (or the high potential portion) of the electrostatic latent image reaches a position where the image carrier 1 faces the developing roller 12, toner is moved to the image carrier 1 from the developing roller 12 that carries a thin toner layer on the surface thereof. Accordingly, a toner image (visible image) as a transferable image is formed on the surface of the image carrier 1. When the image carrier 1 rotates, the toner image is transferred to the intermediate transfer belt 53 by the primary transfer roller 54 shown in FIG. 1. In this case, residual toner, which is left after the transfer, that is, which is not transferred to the intermediate transfer belt 53, is present on the image carrier 1. However, the residual toner is removed from the image carrier 1 by the cleaning blade 13. A static eliminator (not shown) is provided on the downstream side of the cleaning blade 13 in the rotational direction of the image carrier 1. Residual charges on the surface of the image carrier 1 are removed by the static eliminator. Since the charging roller 11 is provided on the downstream side of the static eliminator in the rotational direction of the image carrier 1, the image carrier 1 is charged uniformly again to a high potential by the charging roller 11.

The image carrier unit 10 of the process cartridge 58 of this embodiment and components thereof will be described with reference to FIGS. 3 to 10, based on the comparison with an image carrier unit 500 of the related technology that is a comparative example shown in FIGS. 11 and 12. This embodiment is described with reference to FIGS. 3 to 8, using an example in which a shaft 4 and a conductive base member 1A of the image carrier (photoreceptor) 1, which are two components of the image carrier unit 10, are electrically connected to each other by a conductive cloth so as to be electrically connected, e.g., grounded.

Figure 3:
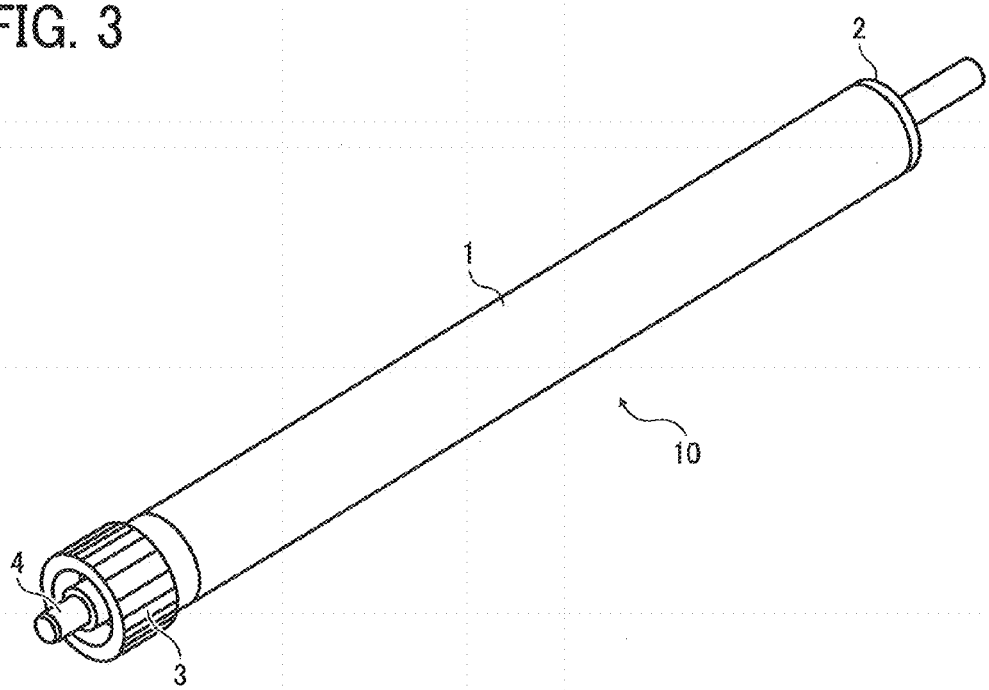
FIG. 3 is a perspective view showing the appearance of an image carrier unit of the first embodiment of the invention.
Figure 4:
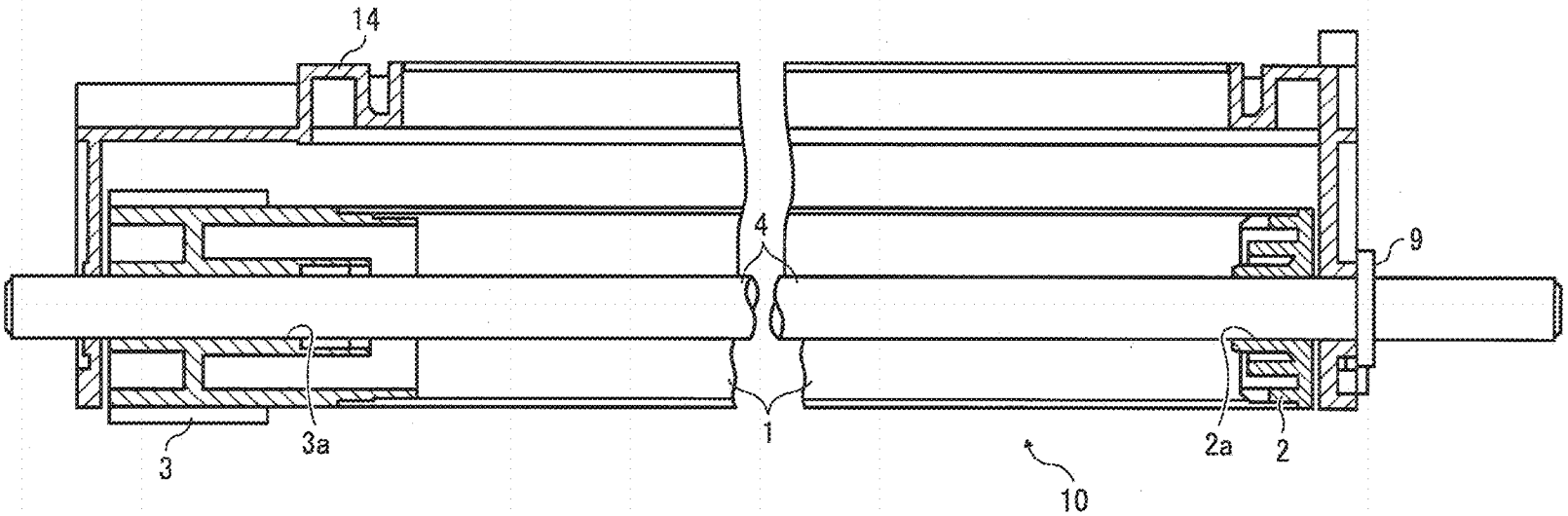
FIG. 4 is a cross-sectional view of main parts of both end portions of the image carrier unit of the first embodiment, the view being taken along a longitudinal (axial) direction.
Figure 5:
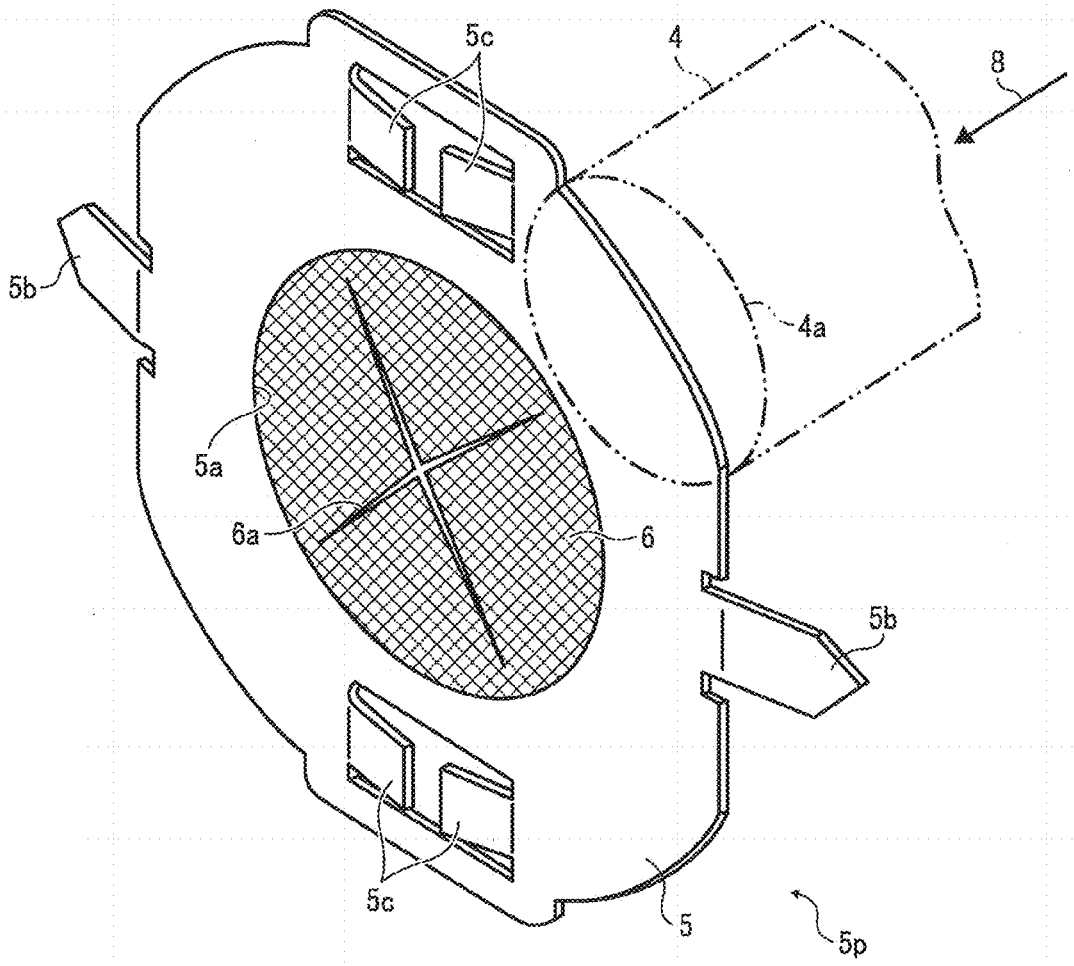
FIG. 5 is a perspective view showing the shapes and mounting states of a grounding plate, a conductive cloth, and the like and the state before a shaft passes through the conductive cloth according to the first embodiment.
Figure 6:
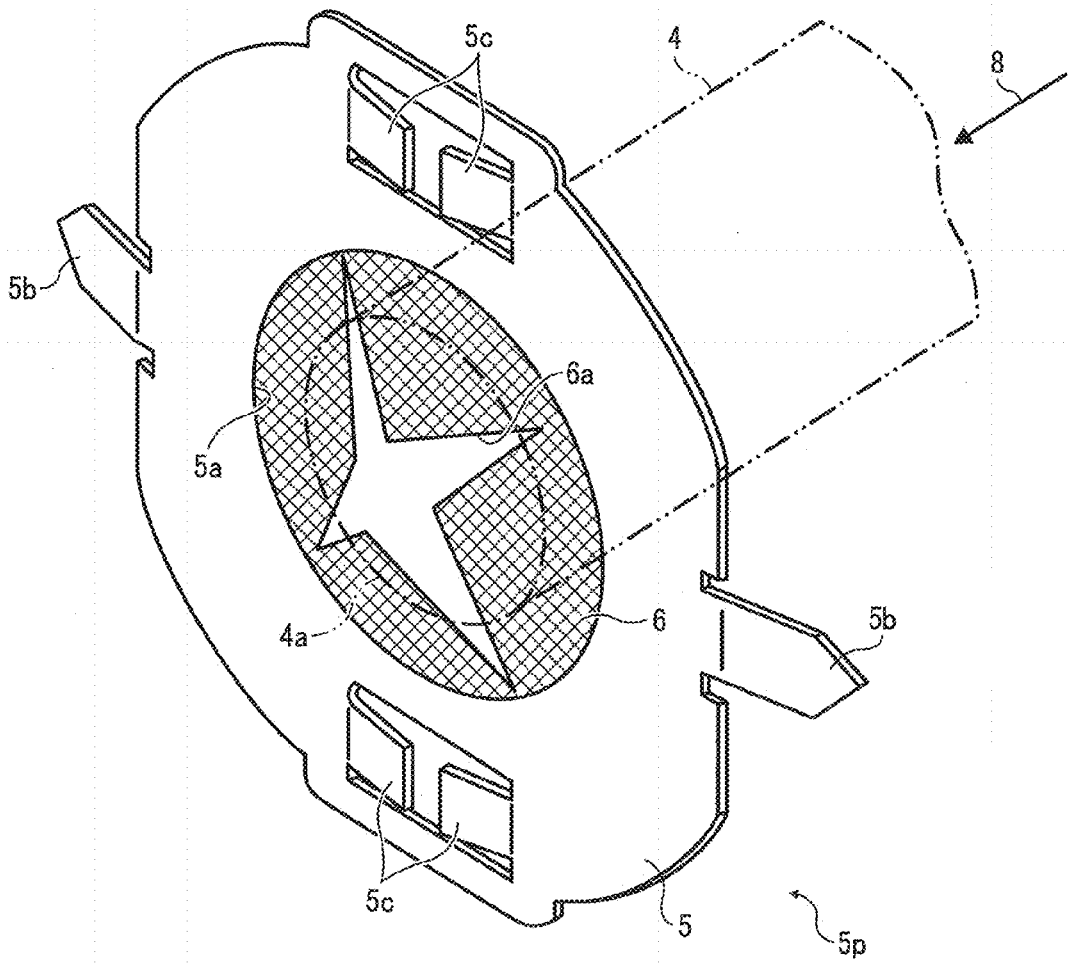
FIG. 6 is a perspective view showing a conductive-cloth passing state in which the shaft is pressed against the conductive cloth to thereby open cuts of the conductive cloth.
Figure 7:
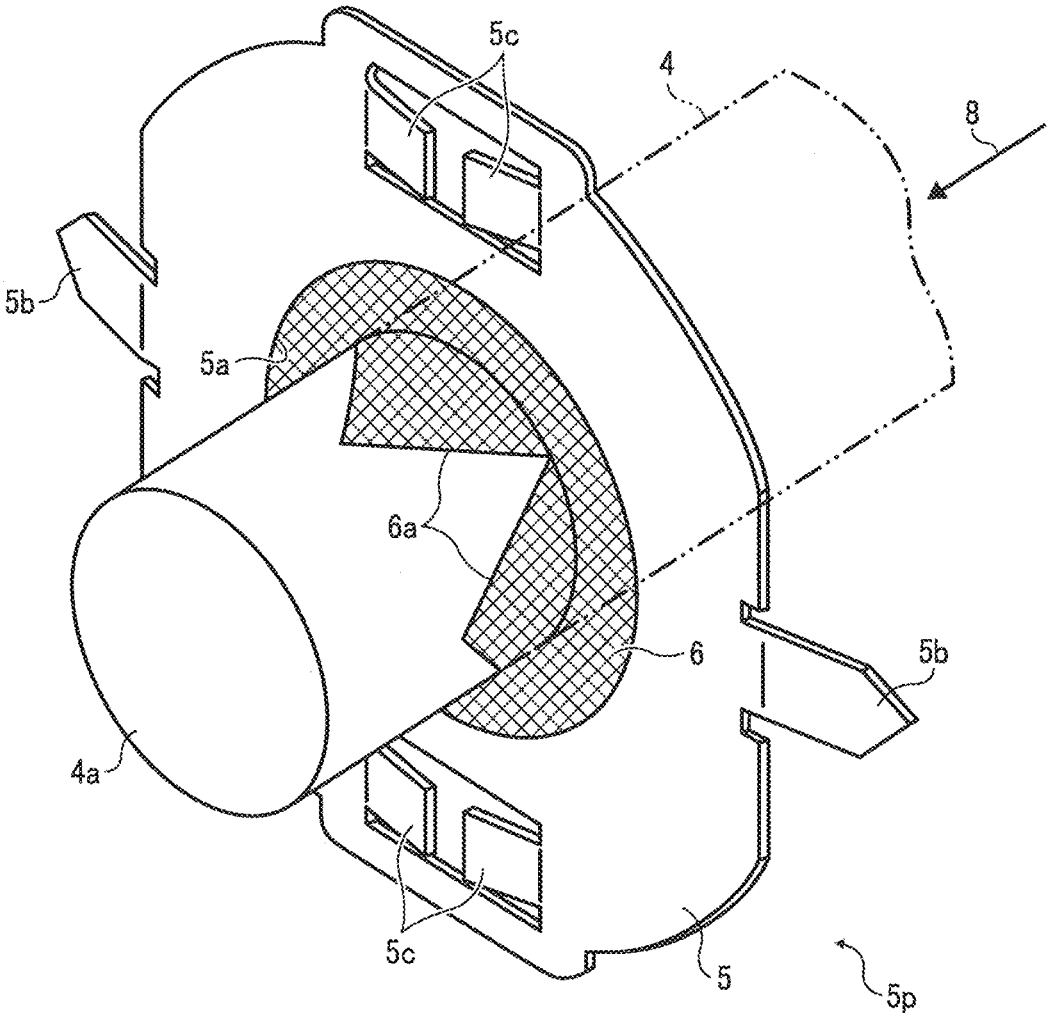
FIG. 7 is a perspective view showing the state after the shaft passes through the conductive cloth.
Figure 8:
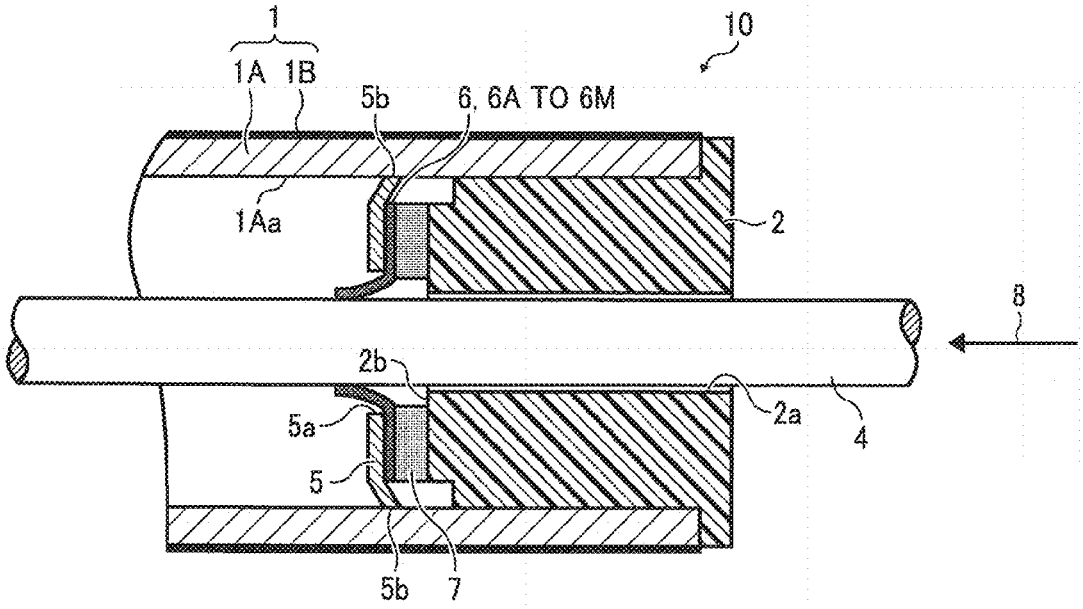
FIG. 8 is a cross-sectional view of one end portion of the image carrier unit of the first embodiment taken along the longitudinal (axial) direction.
Figure 9A:
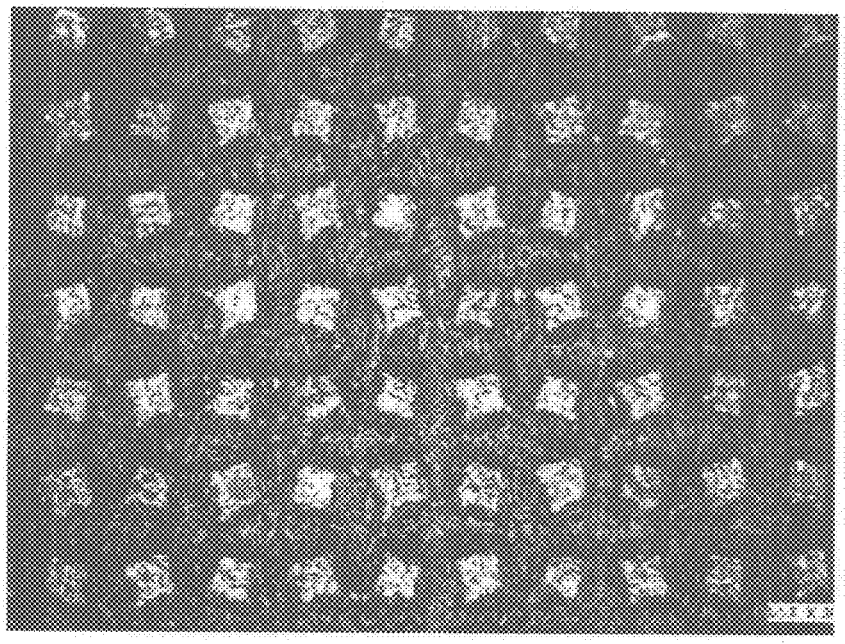
FIGS. 9A and 9B are magnified micrographs (at magnification of 30× and 100×) of the conductive cloth.
Figure 9B:
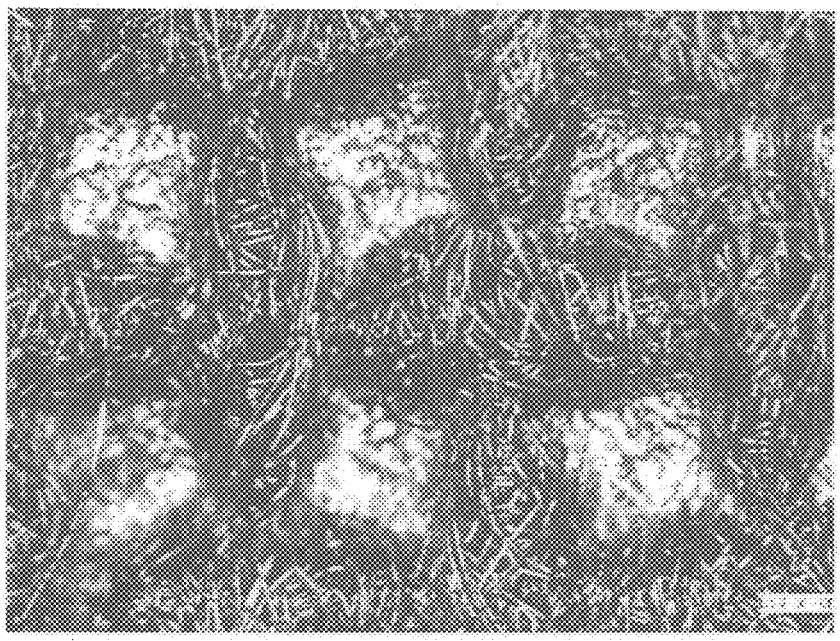
Figure 10:
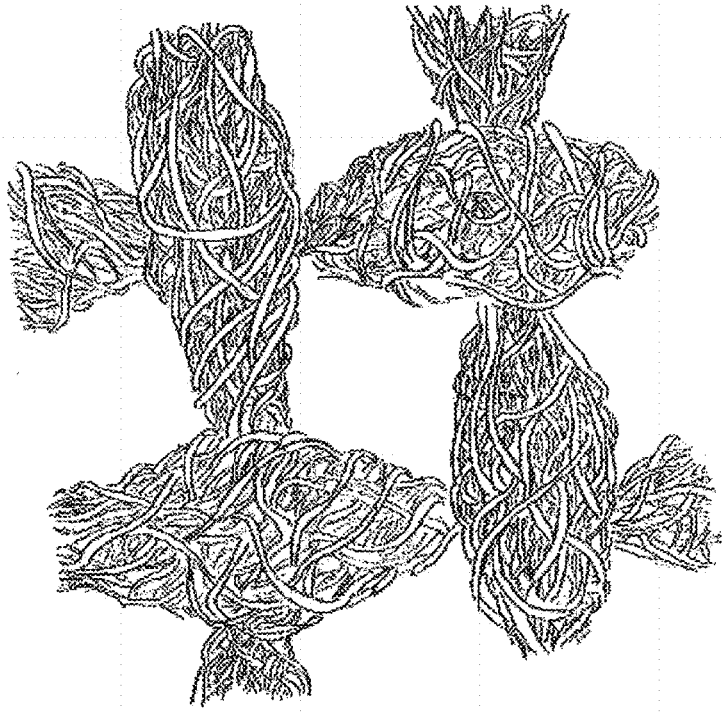
FIG. 10 is a schematic diagram (at magnification of 100×) of the conductive cloth.

FIG. 3 is a perspective view showing the appearance of the image carrier unit 10. FIG. 4 is a cross-sectional view of main parts of both end portions of the image carrier unit 10, the view being taken along a longitudinal direction (axial direction) and also showing peripheral components of the image carrier 1 in addition to the image carrier unit 10. However, a grounding plate 5, a conductive cloth 6, and a pressing member 7 are not shown. FIGS. 5 to 7 are perspective views showing the shapes of the grounding plate 5 and the conductive cloth 6 and showing that the shaft 4 is inserted into and removed from the conductive cloth 6. FIG. 8 is a cross-sectional view of one end portion of the image carrier unit 10 taken along the longitudinal direction (axial direction) of the image carrier unit, and shows the shapes and disposition of the image carrier 1, a flange 2, the grounding plate 5, the conductive cloth 6, and the pressing member 7. FIGS. 9A and 9B are magnified micrographs (at magnification of 30× and 100×) of the conductive cloth 6. FIG. 10 is a schematic diagram (at magnification of 100×) of the conductive cloth 6.

As shown in FIGS. 3 to 8, the image carrier unit 10 mainly includes the image carrier 1, the flange 2 as a flange member, a gear 3, the shaft 4 as a contact member, the conductive cloth 6 as a cloth-like conductive member, the grounding plate 5 serving as a electrifying (grounding) member and a conductive member made of a metal, and the pressing member 7. The image carrier 1 is formed of a photoreceptor that includes the photosensitive layer 1B on the surface of the conductive base member 1A having a cylindrical shape. The flange 2 is mounted on and fixed to one end portion of the image carrier 1. The gear 3 is mounted on and fixed to the other end portion of the image carrier 1. The shaft 4 passes through the central portions of the flange 2 and the gear 3 so that the image carrier 1 is rotatably supported by the shaft. The shaft 4 may be inserted into and pass through the conductive cloth 6 serving as a cloth-like conductive member. The conductive cloth has flexibility and has cuts 6*a* that allow the conductive cloth to come into contact with the shaft 4 while the conductive cloth is bent when the shaft 4 passes through the conductive cloth. A base end portion of the grounding plate 5 comes into contact with the conductive cloth 6 and is mounted on the flange 2, and a tip portion thereof is fixed to an inner wall of the conductive base member 1A. The pressing member 7 presses the conductive cloth 6 against the grounding plate 5.

As shown in FIG. 4, an electrical connection unit to be described below is disposed around the image carrier unit 10. The electrical connection unit electrically connects, e.g., grounds the shaft 4 and the frame 14 that supports both ends portions of the shaft 4 of the image carrier unit 10.

As shown in FIGS. 4 and 8, the image carrier 1 is rotatably supported by the shaft 4 that passes through a hole 2*a* formed at the central portion of the flange 2 and a hole 3*a* formed at the central portion of the gear 3. The shaft 4 is made of a metal such as conductive special steel, or plated with a conductive material. The both end portions of the shaft are supported by the frame 14 of the process cartridge 58 shown in FIG. 2, the rotation of the shaft 4 is suppressed by a rotation preventing member 9 such as a retaining ring, and the shaft is prevented from slipping out to the left-hand side of FIG. 4. Further, an end portion of the shaft 4 opposite to the rotation preventing member 9 is completely prevented from slipping out in an axial direction by an additional member (not shown).

With reference to FIGS. 3 and 4, when the process cartridge 58 shown in FIGS. 1 and 2 is mounted on the main body frame 51 of the color image forming apparatus 50, a metal sheet (not shown) that is made of, for example, stainless steel and is mounted on the main body frame 51 and electrically grounded, comes into contact with the end portion of the conductive shaft 4, so that the shaft 4 is grounded. The metal sheet (not shown), which is mounted on the main body frame 51 and electrically grounded as described above, forms an electrical connection unit that electrically grounds the shaft 4.

As shown in FIGS. 2 and 8, the image carrier 1 includes the photosensitive layer 1B that is made of selenium or the like and is formed on the surface of the conductive base member 1A made of aluminum or the like. In FIG. 2, the image carrier 1 sequentially and repeatedly performs operations, such as charging, developing, and the transfer of a toner image, on the photosensitive layer 1B by using the charging roller 11 of the charging device, the developing roller 12 of the developing device, and the primary transfer roller 54 (not shown in FIG. 2, see FIG. 1) of the primary transfer device that are disposed around the image carrier. The toner image is finally transferred to the sheet S such as paper by way of the intermediate transfer belt 53, so that a sheet with an image is produced. In this embodiment, the conductive base member 1A of the image carrier 1 corresponds to an object to be electrified (grounded) (the same hereinafter).

Charging is repeatedly performed on the image carrier 1 and the charging voltage is high. Accordingly, electrical connection is secured between the shaft 4 and the image carrier 1 to be rotationally driven, static electricity is easily discharged, and vibration is reduced which results in reduction of noise generation and prevention of oxidation attributable to sliding between metals. Therefore, the conductive cloth 6, the grounding plate 5 formed of a spring member made of a metal, and the pressing member 7 are formed and disposed as described above and below in this embodiment, so that a defect of an image, generation of noise, and oxidation of a member made of a metal, and the like are prevented.

Figure 12:
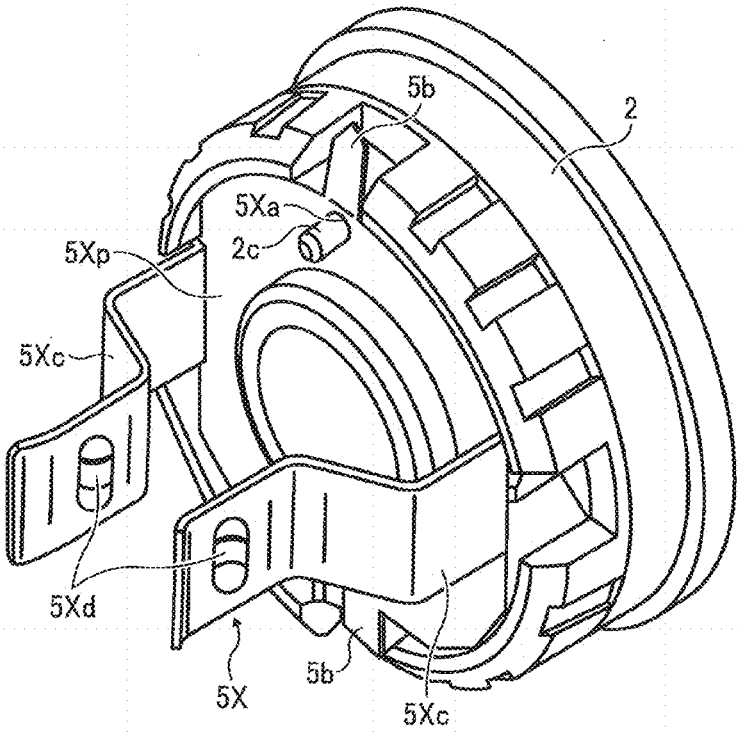
FIG. 12 is a perspective view showing the appearance of a portion of the image carrier unit around a flange and a grounding plate of the image carrier unit of the comparative example.

As shown in FIGS. 3, 4, and 8, the flange 2 includes the hole 2*a*, a mounting surface 2*b*, and two bosses (see bosses 2*c* of the flange 2 shown in FIG. 12). The shaft 4 is inserted into and supported by the hole 2*a*. The mounting surface 2*b* is formed at an inner portion of the flange, and is parallel to the plane perpendicular to an axis of the shaft 4 that is the rotation axis of the image carrier 1. The two bosses are formed on the mounting surface 2*b* so as to protrude from the mounting surface. The mounting surface and the two bosses are made of a resin, which has an electrical insulation property and may be thermally caulked, so as to be integrated with each other. When being press-fitted to an inner wall 1Aa of the conductive base member 1A, the flanges 2 is firmly fixed to one end portion of the image carrier 1 by appropriate fixing means. The appropriate fixing means includes the pressing and fixing to the conductive base member 1A, which are performed by a pair of pressure contact portions 5*b* of the grounding plate 5 to be described below. Meanwhile, the detailed shape of the flange 2 is shown in FIGS. 4 and 8. However, as long as there is no problem in the characteristic structure of the invention, the flange is schematically shown in other drawings other than FIGS. 4 and 8 for the simplification of the drawing.

As shown in FIGS. 5 to 7, the grounding plate 5 is formed in a substantially square shape having four round corners, and includes a through hole 5*a*, a plurality of pressure contact portions 5*b*, a plurality of boss fixing claws 5*c*, and a flat plate portion 5*p*. The grounding plate 5 is integrally formed of a thin plate made of phosphor bronze, stainless steel, or the like, for example, a spring material that has a thickness of 0.1 to 0.2 mm. The grounding plate 5 includes the through hole 5*a* that hinders the grounding plate from contacting the shaft 4; the flat plate portion 5*p* serving as a mounted portion that has a base end portion in contact with the conductive cloth 6 and attached to the mounting surface 2*b* of the flange 2 at least two points as described below, with the conductive cloth 6 and the pressing member 7 interposed therebetween; plural pressure contact portions 5*b* (two in this embodiment) that are pressed and fixed (substantially fixed) by an elastic force of a spring and that has a portion extending from the flat plate portion 5*p* in the radial direction of the conductive base member 1A and cutting into the inner wall 1Aa of the conductive base member 1A; and boss fixing claws 5*c* that are elastically engaged with plural bosses of the flange 2 (two in this embodiment and not shown, see the bosses 2*c* of the flange 2 shown in FIG. 12) and mounted and fixed to the bosses. The diameter of the through hole 5*a* piercing through the grounding plate 5 is larger than the outer diameter of the shaft 4 to prevent contact with the shaft 4.

The pressure contact portions 5*b* are formed in a pointed triangular shape so as to be pressed and fixed in the state in which the tip portions thereof cut into the inner wall 1Aa of the conductive base member 1A (see, for example, FIG. 8). Two boss fixing claws 5*c* function as the basis to determine position of the grounding plate 5 in a two-dimensional direction. The grounding plate 5 is positioned relative to the flange 2 in a three-dimensional direction by the boss fixing claws 5*c* and the flat plate portion 5*p*, and is disposed in the image carrier 1.

Meanwhile, a work for fixing and holding the tip portion (head portion) of each of the bosses 2*c* by thermal caulking using heating and welding may be additionally performed after the bosses (see the bosses 2*c* of the flange 2 shown in FIG. 12) are elastically engaged with and fixed to the boss fixing claws 5*c*, respectively.

The conductive cloth will be described. The conductive cloth is also called a static eliminating cloth, and is formed of a cloth-like material (conductive fiber aggregate) that is woven with at least one kind of fiber selected from among polyethylene terephthalate fiber, nylon fiber, and polyester fiber, nickel, and copper. Since the conductive cloth has conductivity and appropriate lubricity, it may be possible to secure stable electrical connection with no abnormal sound and oxidation even though the conductive cloth comes in contact with a sliding object. Further, since it is not necessary to apply a conductive lubricant for reducing sliding resistance when metals slide on each other, it may be possible to reduce the burden on environment.

The magnified micrographs of the conductive cloth that is actually used in the embodiment are shown in FIG. 9A (magnification 30×) and 9B (magnification 100×). FIG. 10 is a schematic diagram (magnification 100×) of the conductive cloth 6. As can be seen in the figures, the conductive cloth is formed such that conductive fibers are braided into ropes as fiber bundles, and the fiber bundles are laced in a reticular pattern. This conductive cloth has resistance of less than 0.01Ω and a thickness of 0.25 mm.

The conductive cloth 6 of this embodiment includes the cuts 6*a* through which the shaft 4 passes. The grounding plate 5 and the conductive cloth 6 come into contact with each other at portions other than the cuts 6*a*. That is, in this embodiment, the dimension of the outer profile of the conductive cloth 6 is larger than the diameter of the through hole 5*a* on the back side of the grounding plate 5 in FIGS. 5 to 8. Accordingly, the conductive cloth comes into contact with the grounding plate in a region where the conductive cloth overlaps the flat plate portion 5*p* of the grounding plate 5. Therefore, the grounding plate 5 and the conductive cloth 6 are electrically connected to each other.

As illustrated by an imaginary line of FIGS. 5 and 6, plural cuts 6*a* are formed in the conductive cloth 6 of this embodiment to be arranged in a cross shape or a radial shape so that they intersect with one another at around the outer-diameter shape 4*a* (hereinafter, referred to as "shaft-outer-diameter shape 4*a*") which is a shape of an outer contour of a cross section of the shaft 4 when the shaft 4 passes through the conductive cloth. If the shaft-outer-diameter shape 4*a* is positioned such that the shaft-outer-diameter shape overlaps conductive cloth 6, it is shown that the shaft 4 comes into contact with the conductive cloth 6 (this is the same even in the modifications, a first example, and the like to be described below). The end portion of each of the cuts 6*a* lies in the vicinity of the outer edge of the shaft-outer-diameter shape 4*a* so that the shaft 4 easily passes through the conductive cloth (this is the same even in the modifications, the first example, and the like to be described below). Meanwhile, FIG. 8 shows the conductive cloth 6 of the first embodiment and also shows that conductive clothes 6A to 6M including 6D1 (hereinafter, described as "6A to 6M") of first to twelfth modifications and the first example to be described below may be applicable.

The shape including "cuts" or "cutout portions," formed at the conductive cloth to actively use the flexibility of the conductive cloth, is the main theme of the invention to solve the above-mentioned problem. Accordingly, since items for embodiments, such as elastic restoration representing the degree of flexibility and thickness, are considered as design-associated items that are set according to specific examples of mechanisms for electrifying, e.g., grounding, rotators to which the conductive cloths are to be applied, the detailed description thereof will not be given here.

Various forms and modifications, such as a conductive cloth including only "cuts" that do not generate scraps and dust as in this embodiment, a conductive cloth including "cutout portions" (which include notches and punched portions) that generate scraps and dust, a conductive cloth without "cuts" or "cutout portions" as the extreme case, and the combinations thereof have been created in order to actively use the flexibility of the conductive cloth that has not been used until now, and will be described below.

The pressing member 7 is formed of a non-metallic elastic body that includes rubber and sponge. For example, urethane foam rubber or the like may be used as the material of the pressing member.

The pressure contact portions 5*b* of the grounding plate 5 are fixed to the inner wall 1Aa of the conductive base member 1A as described above, so that the pressure contact portions are electrically connected to the conductive base member 1A. Accordingly, the flat plate portion 5*p* (base end portion) of the grounding plate 5 corresponds to an object to be electrified (grounded). Therefore, in this embodiment, part of the conductive cloth 6 comes into contact with the flat plate portion 5*p* of the grounding plate 5 that is an object to be electrified (grounded) and other part of the conductive cloth 6 is bent and comes into contact with the shaft 4.

An example of a method of assembling the image carrier unit 10 will be described with reference to FIGS. 5 to 8. First, the respective bosses (not shown, see the bosses 2*c* shown in FIG. 12) of the flange 2 elastically engage with and are fixed to the boss fixing claws 5*c* of the grounding plate 5 while the pressing member 7 and the conductive cloth 6 are interposed between the mounting surface 2*b* of the flange 2 and the grounding plate (as will be described below as the first example, the pressing member 7 and the conductive cloth 6 are structured as an assembly (conductive cloth assembly)). As a result, the grounding plate 5 is fixed and held on the flange 2. In this case, the bosses are fixed at the positions where the phase difference between the positions of the pressure contact portions 5*b* of the grounding plate 5 and the positions of the bosses is about 90°. After that, an assembly (flange assembly) of the flange 2, where the grounding plate 5 is fixed to the flange with the pressing member 7 and the conductive cloth 6 interposed therebetween (conductive cloth assembly), is press-fitted to the inner wall 1Aa of the conductive base member 1A by a flange pushing jig (tool) (not shown) or the like so as to be fixed to one end portion of the image carrier 1. In this case, if the diameter of the outer circumference edge of the pressure contact portions 5*b* of the grounding plate 5, (the diameter of the circumscribed circle) is formed to be appropriately larger than the diameter of the inner wall 1Aa (inner diameter) of the conductive base member 1A, the tips of the pressure contact portions 5*b* are elastically deformed so as to break into the inner wall 1Aa of the conductive base member 1A to be thereby pressed against the inner wall of the conductive base member. As a result, the assembly is firmly fixed in the image carrier 1.

Then, when the shaft 4, which is shown in FIG. 5 by an imaginary line, is inserted into the assembly (flange assembly) of the flange 2, which is firmly fixed in the image carrier 1, from the outside of the flange 2 in a contact direction 8 in FIGS. 5 to 7, the shaft passes through the hole 2*a* of the flange 2 as shown in FIG. 8. Thereafter, the tip portion of the shaft 4 is pressed against the conductive cloth 6 as shown in FIG. 6, so that the cuts 6*a* are opened. The shaft 4 is further inserted in the contact direction 8, the shaft passes through the cuts 6*a* formed at the conductive cloth 6 so as to enlarge the cuts as shown in FIG. 7. In this case, intersection portions of the cuts 6*a* of the conductive cloth 6 come into contact with the shaft 4 at a plurality of points while being bent in the same direction as the contact direction 8 (hereinafter, referred to as an "insertion direction 8") of the shaft 4.

When the grounding plate 5, the conductive cloth 6, and the pressing member 7 are fixed to the flange 2 as described above and the flange 2 is press-fitted into the image carrier 1, the conductive base member 1A and the grounding plate 5 come into contact with each other, the grounding plate 5 and the conductive cloth 6 come into contact with each other, and the conductive cloth 6 and the shaft 4 come into contact with each other. As a result, the conductive base member 1A and the shaft 4 may be finally electrically connected to each other. In this case, as a method of making the grounding plate 5 come into contact with the conductive cloth 6, the pressing member 7 is disposed between the flange 2 and the conductive cloth 6; and the conductive cloth 6 and the pressing member 7 are pressed by the grounding plate 5, so that the pressing member 7 is elastically deformed so as to be compressed and the conductive cloth 6 may more reliably come into contact with the grounding plate 5. Therefore, electrical connection is stably secured with time.

When a rotational driving force of a driving unit (not shown) is transmitted to the gear 3 that meshes with a driving force transmitting member such as a gear train connected to the driving unit in FIGS. 3 and 4, the image carrier 1 is rotationally driven in the direction of an arrow shown in FIGS. 1 and 2. Accordingly, the grounding plate 5 is also rotated together with the flange 2, the conductive cloth 6, and the pressing member 7 in the direction of the arrow shown in FIGS. 1 and 2, and the bent portions of the conductive cloth 6 are rotated while sliding on and coming into contact with the outer peripheral surface of the shaft 4. In this case, since the conductive cloth 6 has conductivity and appropriate lubricity, it may be possible to secure stable electrical connection with time without generating abnormal sound and causing oxidation even though the conductive cloth comes in contact with the shaft 4 that is a sliding object. Further, since a conductive lubricant for reducing sliding resistance (for example, conductive grease or the like used in a comparative example to be described below) does not need to be applied when metals slide on each other, it may also be possible to reduce total burden imposed on environmental. Therefore, it may be possible to form and provide the environment-friendly image carrier unit 10, the process cartridge 58, and the color image forming apparatus 50 shown in FIG. 1.

As for the contact between the conductive cloth 6 and the shaft 4, it may be possible to obtain appropriate contact pressure between the conductive cloth and the shaft 4 since the conductive cloth 6 itself is bent. Further, as for the shape of the conductive cloth, it may be possible to obtain the above-mentioned performance by the simple shape that is formed by a very simple work of forming the cuts 6*a* in the conductive cloth 6. The conductive cloth 6 contains metal. However, since the metal is not a main material, abnormal sound and poor electrical connection attributable to oxidation, which is a problem in the related technology, are not generated.

Furthermore, the contact portions of the cuts 6*a* of the conductive cloth 6 coming into contact with the shaft 4 may have appropriate rigidity due to the above-mentioned structure, particularly to the contact state between portions of the cuts 6*a* of the conductive cloth 6 and the shaft 4 shown in FIG. 7, the contact portions do not easily fall down in the direction opposite to the contact direction of the shaft 4, and contact pressure is decreased since the widths of the contact portions in contact with the shaft 4 are decreased toward a shaft center 4*c*. Accordingly, it may be possible to obtain a low-load electrifying, e.g., grounding, structure. Since the base portions of the contact portions are wide and the tip portions thereof are slim, there is an advantage in that the tip portions of the contact portions come into soft contact with the shaft 4 and the bodies of the contact portions are not easily bent.

The shapes, mounting states, and assembly (sub assembly) states of the grounding plate, the conductive cloth, and the pressing member will be explained in detail in the first example to be described later. In the first example to be described later, compared with the first embodiment, a conductive cloth 6D1 is used in which the number of cuts is different from the cuts 6*a* of the conductive cloth 6 of the first embodiment. The conductive cloth 6D1 is of course applicable to the first embodiment. To avoid confusion of the conductive cloth 6D1 and the conductive cloth 6 of the first embodiment, the conductive cloth 6D1 will be described later in the first example.

The image carrier unit 10 is not limited thereto. When advantages and effects that may be obtained by the pressing member 7 are not desired to that extent, the pressing member 7 may be removed from the image carrier unit 10. That is, referring to FIG. 8, the pressing member 7 may be removed from FIG. 8 and the grounding plate 5 may be fixed and held on the mounting surface 2*b* of the flange 2 with only the conductive cloth 6 interposed therebetween.

Comparative Example of First Embodiment

An image carrier unit 500 in the related technology as a comparative example of the first embodiment will be described below with reference to FIGS. 11 and 12. FIG. 11 is a cross-sectional view of both end portions of an image carrier unit 500 which is taken along a longitudinal direction (axial direction) of the image carrier unit and shows the shapes and disposition of the image carrier 1, the flange 2, and a grounding plate 5X. FIG. 12 is a perspective view showing a state where the grounding plate 5X is mounted on the flange 2 before thermal caulking.

Figure 11:
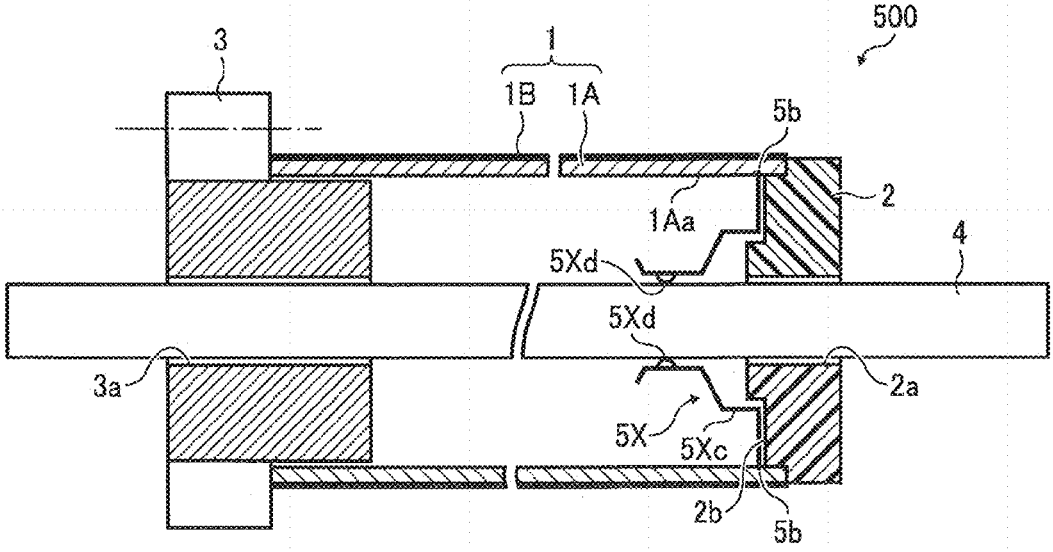
FIG. 11 is a cross-sectional view of one end portion of an image carrier unit of a comparative example taken along the longitudinal (axial) direction.

An example using metal contacts, which electrically connect the shaft 4 and a conductive base member 1A of an image carrier (photoreceptor) 1, which are two components of the image carrier unit 500, to a grounding plate made of a metal in the related technology, will be illustrated in this comparative example with reference to FIGS. 11 and 12.

As shown in FIGS. 11 and 12, the material difference of the image carrier unit 500 in the related technology from the image carrier unit 10 of the first embodiment is that the conductive cloth 6 and the pressing member 7 are removed and the grounding plate 5X is used as the grounding plate 5. The structure of the image carrier unit 500 is the same as that of the image carrier unit 10 except for this difference.

As shown in FIGS. 11 and 12, the grounding plate 5X includes two pressure contact portions 5*b* and 5*b* like the grounding plate 5. However, the grounding plate 5X includes two holes 5Xa (only an upper hole 5Xa is shown in FIG. 12 and a lower elongated hole is hidden and not shown) formed at a flat plate portion 5Xp, bent portions 5Xc and 5Xc, and contact portions 5Xd and 5Xd, which are not included in the grounding plate 5. The grounding plate 5X is integrally formed of the same spring material of the grounding plate 5.

When compared with the grounding plate 5, the grounding plate 5X includes the flat plate portion 5Xp that is directly fixed to the mounting surface 2*b* of a flange 2 at two points as described below. The flat plate portion 5Xp includes protruding contact portions 5Xd and 5Xd. The contact portions 5Xd and 5Xd are formed at tip portions of the bent portions 5Xc and 5Xc, which are bent from the flat plate portion 5Xp along a longitudinal direction of the shaft 4, and slide on and come into contact with the outer peripheral surface of the shaft 4. Accordingly, the grounding plate 5X is shaped such that the grounding plate electrically connects the shaft 4 to the conductive base member 1A of the image carrier 1. The grounding plate 5X is the same as the grounding plate 5 of the first embodiment except for this difference.

If two bosses 2*c* (only an upper boss 2*c* is shown in FIG. 12 and a lower boss is hidden and not shown) planted on the mounting surface 2*b* of the flange 2 are fitted to two holes 5Xa (only an upper circular hole 5Xa is shown in FIG. 12 and a lower elongated hole is hidden and not shown), respectively, and, for example, the tips of the bosses are then thermally caulked, the grounding plate 5X is positioned, fixed, and held on the mounting surface 2*b* of the flange 2 in a three-dimensional direction.

When a rotational driving force of a driving unit (not shown) is transmitted to the gear 3 that meshes with a driving force transmitting member such as a gear train connected to the driving unit in FIG. 11 like in the first embodiment, the image carrier 1 is rotationally driven in the direction of an arrow shown in FIGS. 1 and 2 like in the first embodiment. Accordingly, the grounding plate 5X is also rotated in the direction of the arrow shown in FIG. 2 together with the flange 2, the bent portions 5Xc and 5Xc, which are disposed at two positions so as to face each other, are bent due to the elasticity of the spring material, and the contact portions 5Xd and 5Xd are rotated while they are in contact with and slide on a conductive lubricant (not shown) applied to the outer peripheral surface of the shaft 4, so that electrical connection between the conductive base member 1A of the image carrier 1 and the shaft 4 is ensured. For example, conductive grease or the like is used as the conductive lubricant.

Since the shaft 4 is fixed and the image carrier 1 is rotated as described above, the grounding plate 5X is always slidably rotated on the shaft 4. Poor electrical connection attributable to the oxidation of metal or noise generation may occur due to the sliding between metals. In connection with measures against poor electrical connection or noise generation, there is a method of applying a conductive lubricant (for example, conductive grease) to a contact portion of the grounding plate 5X that is to come into contact with the shaft 4. However, as sliding time is increased, the conductive lubricant is scraped at press-contact points between the metal members. For this reason, although the conductive lubricant is a very effective measure at the early stage of sliding, it is not the fundamental solution.

On the other hand, the first embodiment is possible to root out the above-mentioned problem by only a new use of the conductive cloth that makes active use of the bending performance of the conductive cloth, that is, by a very simple work of forming the cuts 6*a* in the conductive cloth 6.

Meanwhile, according to this comparative example, the grounding plate 5X is fixed to the flange 2 at two points by thermal caulking. However, when the grounding plate 5X and the flange 2 subjected to thermal caulking (hereinafter, referred to a "thermally caulked flange 2") are assembled with the image carrier 1, the pressure contact portion 5*b* functions to fix the thermally caulked flange 2 to one end portion of the image carrier 1. For this reason, as compared with a technique disclosed in Japanese Patent Application Laid-open No. H11-249495, the stable fixing of the thermally caulked flange 2 is achieved at least at the thermally caulked points of the grounding plate 5 and the points where the grounding plate is pressed and fixed to the inner wall of the image carrier 1. Accordingly, the number of points where the grounding plate 5X is pressed and fixed to the inner wall of the image carrier 1 does not need to be increased, or the number of the thermally caulked points does not need to be increased. Therefore, there are advantages in that it may be possible to reduce a load to the image carrier 1 when the thermally caulked flange 2 is press-fitted to one end portion of the image carrier 1 and to prevent the deformation and breakage of components.

Various modifications of the pattern and shape of the "cuts" of the conductive cloth of the first embodiment will be described below.

First Modification

Figure 13:
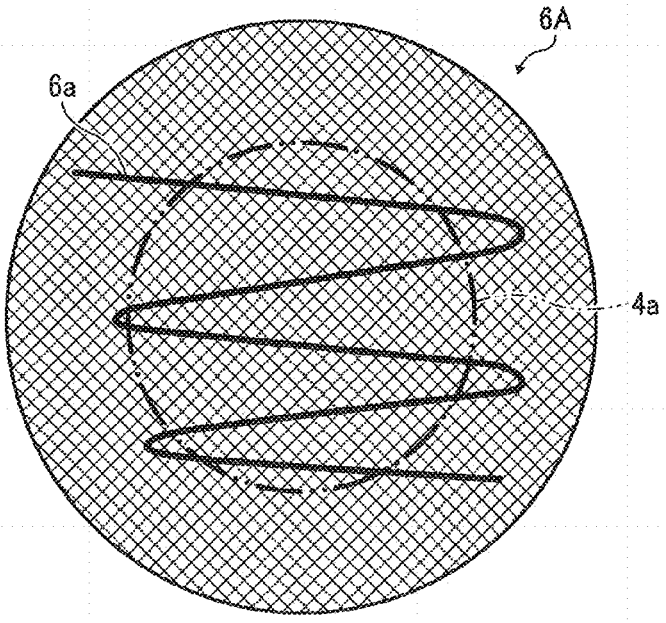
FIG. 13 is a front view of a conductive cloth of a first modification.
Figure 14:
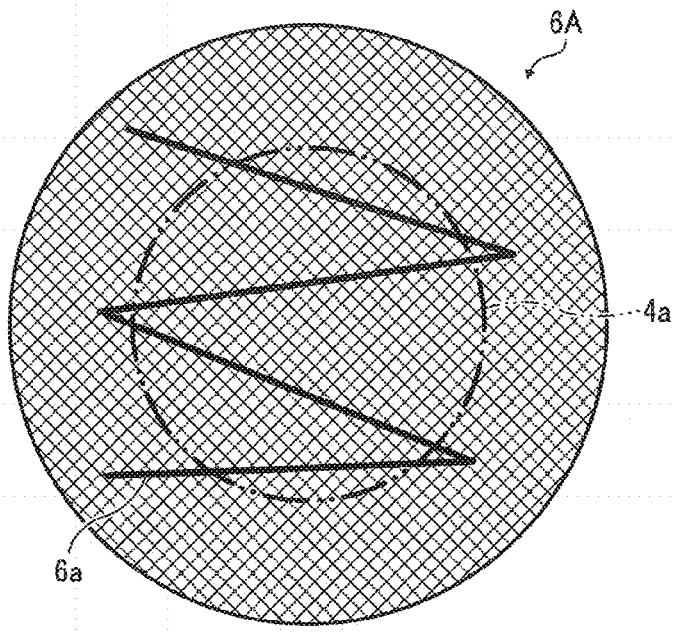
FIG. 14 is a front view of another conductive cloth of the first modification.

A first modification will be described with reference to FIGS. 13 to 15. A conductive cloth 6A of the first modification is different from the conductive cloth 6 of the first embodiment only in that a cut 6*a* is formed in the shape of a wavy line or a broken line crossing the shaft-outer-diameter shape 4*a* several times as shown in FIGS. 13 and 14. Meanwhile, the end portions and broken portions of the cut 6*a* lie in the vicinity of the outside of the shaft-outer-diameter shape 4*a* so that the shaft easily passes through the conductive cloth.

Figure 15:
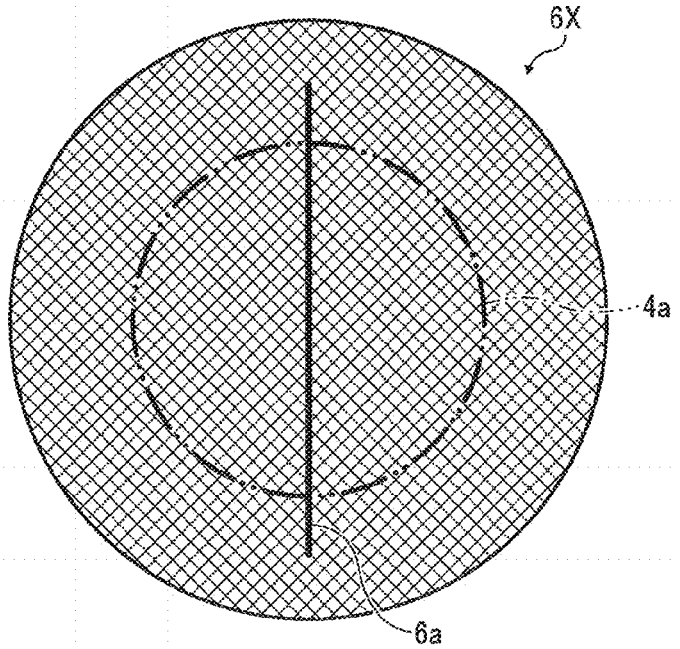
FIG. 15 is a front view of a conductive cloth of a comparative example of the first modification.

According to the conductive cloth 6A of the first modification, when the shaft passes through the conductive cloth, the conductive cloth comes into contact with the shaft at plural points, that is, more contact points are obtained as compared with a conductive cloth 6X that has a simple one cut 6*a* as shown in FIG. 15. Accordingly, it may be possible to secure stable electrical connection. Further, since contact portions are obtained by only the cut 6*a* as in the conductive cloth 6 of the first embodiment, there is also an advantage in that scraps and dust are not generated when preparing the conductive cloth 6A.

Second Modification

Figure 16:
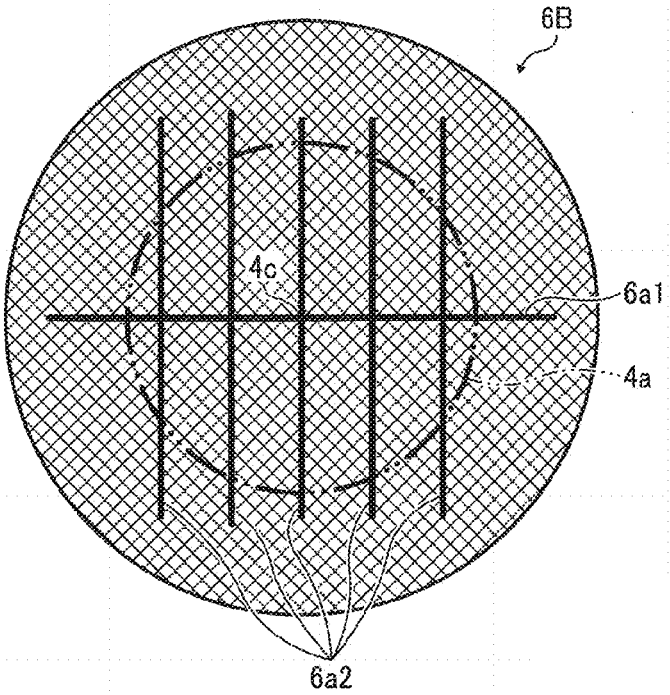
FIG. 16 is a front view of a conductive cloth of a second modification.

A second modification will be described with reference to FIG. 16. A conductive cloth 6B of the second modification is different from the conductive cloth 6 of the first embodiment only in that plural vertical cuts 6*a*2 parallel to each other are formed along with one horizontal cut 6*a*1 formed in a horizontal direction in FIG. 16. The cut 6*a*1 is formed along a line passing through the shaft center 4*c*, and the end portions of the cut 6*a*1 lie in the vicinity of the outside of the shaft-outer-diameter shape 4*a*. The cuts 6*a*2 have the same length, and each of them extends up to the vicinity of the outside of the shaft-outer-diameter shape 4*a*.

According to the conductive cloth 6B of the second modification, many contact points are formed between the conductive cloth and the shaft. Accordingly, it may be possible to secure more stable electrical connection.

Third Modification

Figure 17:
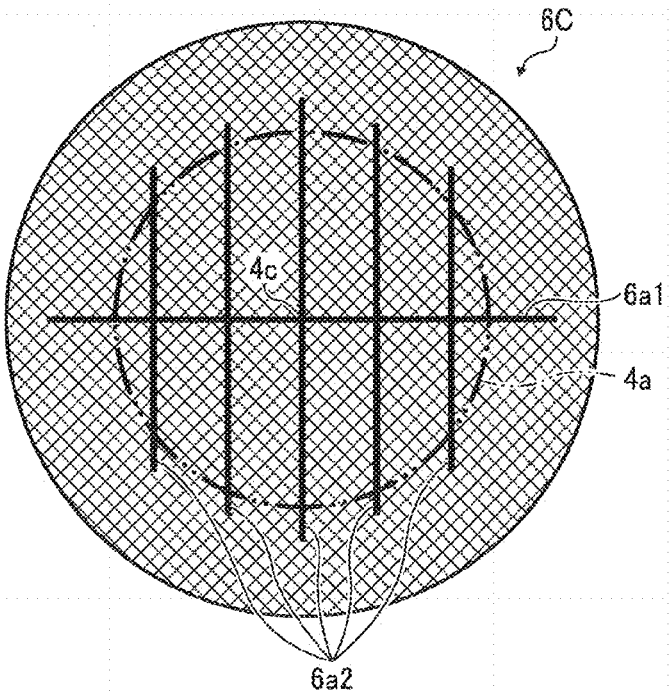
FIG. 17 is a front view of a conductive cloth of a third modification.

A third modification will be described with reference to FIG. 17. As shown in FIG. 17, a conductive cloth 6C of the third modification is different from the conductive cloth 6B of the second modification only in that the lengths of plural vertical cuts 6*a*2 are adjusted to vary so as to follow the shaft-outer-diameter shape 4*a* and are shorter from the shaft center 4*c* toward the outside of the shaft-outer-diameter shape 4*a*.

According to the conductive cloth 6C of the third modification, the cuts 6*a*2 are gradually shortened so as to follow the shaft-outer-diameter shape 4*a*. Accordingly, distances between the outer edge of the conductive cloth and the end portions of the cuts 6*a*2 are secured, so that the rigidity of the conductive cloth is improved and the conductive cloth may be made smaller than the conductive cloth 6B shown in FIG. 16. As a result, the space saving of the apparatus may also be achieved. Meanwhile, a distance between the cuts 6*a*2 and the orientation of the cuts may be arbitrarily set.

Fourth Modification

A fourth modification will be described with reference to FIG. 18. A conductive cloth 6D of the fourth modification includes plural (six in this modification) first radial cuts 6*b* that extend from one point, which is positioned substantially at the center of the conductive cloth 6D, (hereinafter, referred to as a "center point" or a "center") in a radial direction of the shaft-outer-diameter shape 4*a*. A shaft (not shown) is inserted into the conductive cloth at a center point 6*c*. The center point 6*c* of the conductive cloth 6D is an intersection of the six cuts 6*b*, and also corresponds to the shaft center 4*c*. The end portions of the six cuts 6*b* lie in the vicinity of the outside of the shaft-outer-diameter shape 4*a*.

According to the conductive cloth 6D of the fourth modification, plural cuts 6*b* are formed, so that the number of contact points between the conductive cloth and the shaft is increased. Accordingly, the stability of electrical connection is improved. Further, for example, if the conductive cloth 6D is employed in the case of FIG. 8, bending-base portions of the conductive cloth 6D (a portion of the conductive cloth interposed between the inner peripheral end portion of the pressing member 7 and the inner peripheral end portion of the through hole 5*a* of the grounding plate 5) do not fall down and stable electrical connection may be achieved with low contact pressure between the shaft 4 and the conductive cloth. In this modification, the adjacent cuts 6*b* are disposed at regular angular intervals. However, even though the adjacent cuts are disposed at arbitrarily angular intervals, the same effect may be obtained.

Furthermore, the contact portions of the cuts 6*b* of the conductive cloth 6D coming into contact with the shaft 4 may have appropriate rigidity due to the above-mentioned structure, the contact portions do not easily fall down in the direction opposite to the contact direction of the shaft 4, and contact pressure is decreased since the widths of the contact portions of the cuts 6*b* and the shaft 4 is decreased toward the shaft center 4*c*. Accordingly, it may be possible to obtain a low-load electrifying, e.g., grounding, structure. Since the base portions of the contact portions are wide and the tip portions thereof are slim, there is an advantage in that the tip portions of the contact portions come into soft contact with the shaft 4 and the body of the contact portions is not easily bent.

FIRST EXAMPLE

Figure 19:
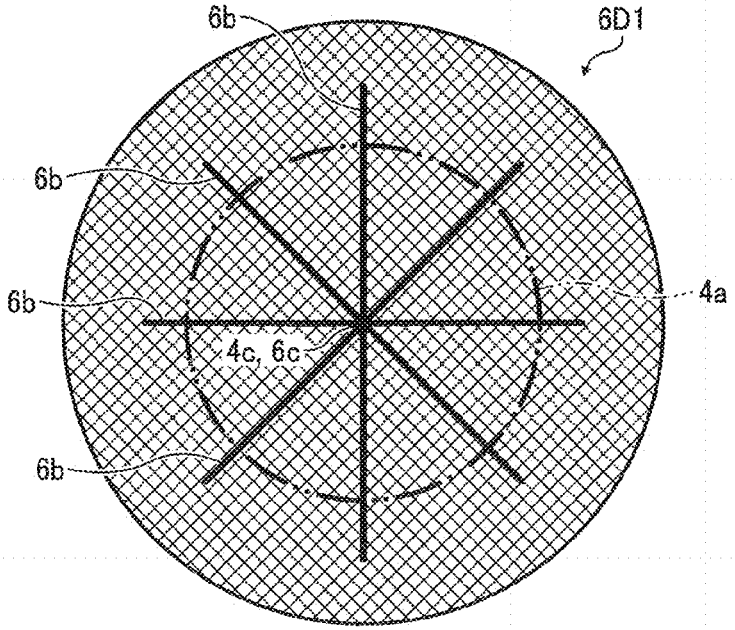
FIG. 19 is a front view of the conductive cloth of a first example.

The conductive cloth 6D1 of the first example will be described with reference to FIG. 19. As shown in FIG. 19, the conductive cloth 6D1 is different from the conductive cloth 6D of the fourth modification only in that the number of the cuts 6*b* is increased by two at portions in a lateral/horizontal direction in the figure. That is, the conductive cloth 6D1 of the first example includes eight first radial cuts 6*b* that extend from the center point 6*c* of the conductive cloth 6D1 in a radial direction of the shaft-outer-diameter shape 4*a*. A shaft (not shown) is inserted into the conductive cloth at the center point 6*c*.

According to the conductive cloth 6D1 of the first example, the increased number of cuts 6*b* than the conductive cloth 6D of the fourth modification are formed, so that the number of contact points between the conductive cloth and the shaft is increased. Accordingly, the stability of electrical connection is improved. Further, for example, if the conductive cloth 6D1 is employed in the case of FIG. 8, bending-base portions of the conductive cloth 6D1 (a portion of the conductive cloth interposed between the inner peripheral end portion of the pressing member 7 and the inner peripheral end portion of the through hole 5*a* of the grounding plate 5) do not fall down and stable electrical connection may be achieved with low contact pressure between the shaft 4 and the conductive cloth. Moreover, there is an advantage in that the bending-base portions do not easily fall down in the direction opposite to the contact direction of the shaft 4, and contact pressure is decreased toward the shaft center 4*c*.

Figure 20:
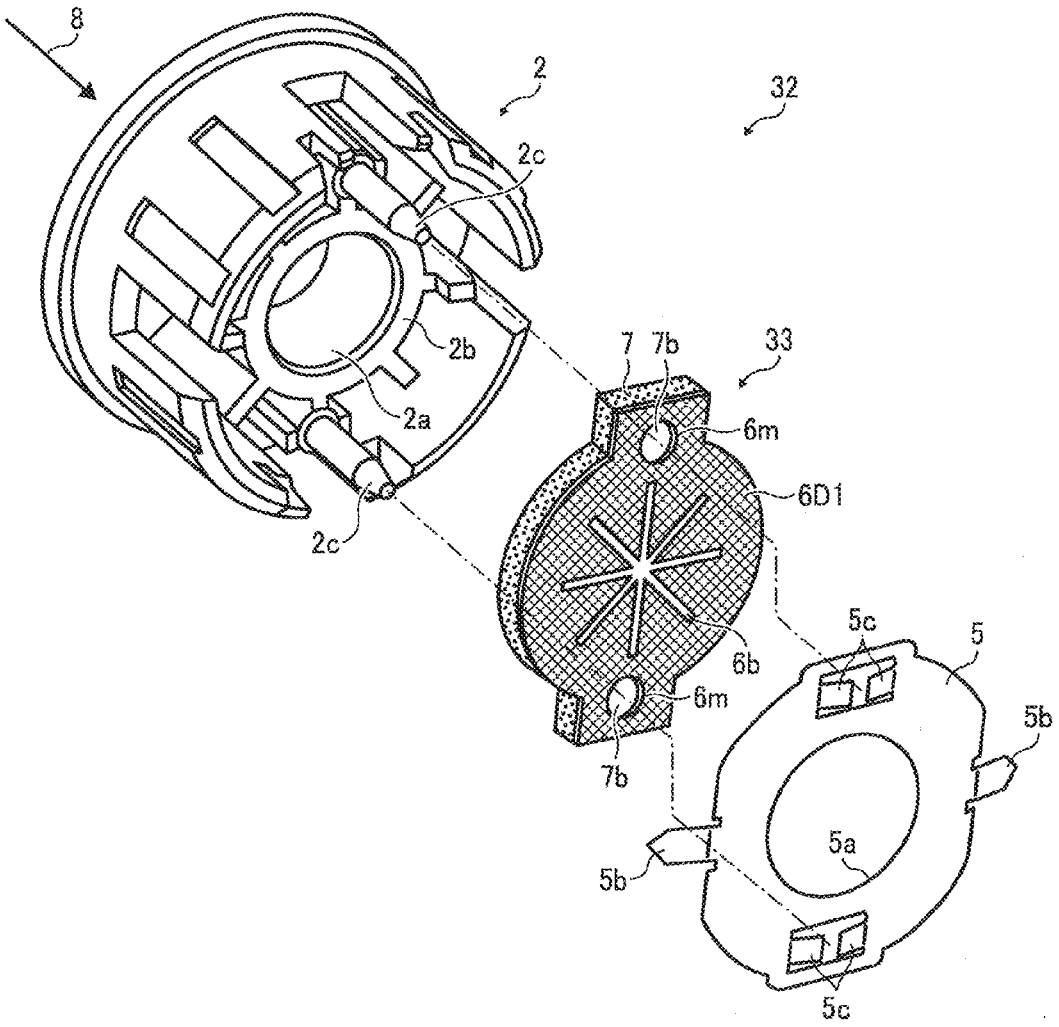
FIG. 20 is an exploded perspective view illustrating a structure of a flange assembly of the first example.
Figure 21A:
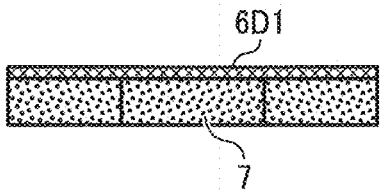
FIGS. 21A to 21D are a plan view, a front view, a bottom view, and a right side view, respectively, for explaining a structure of a conductive cloth assembly of the first example.
Figure 21B:
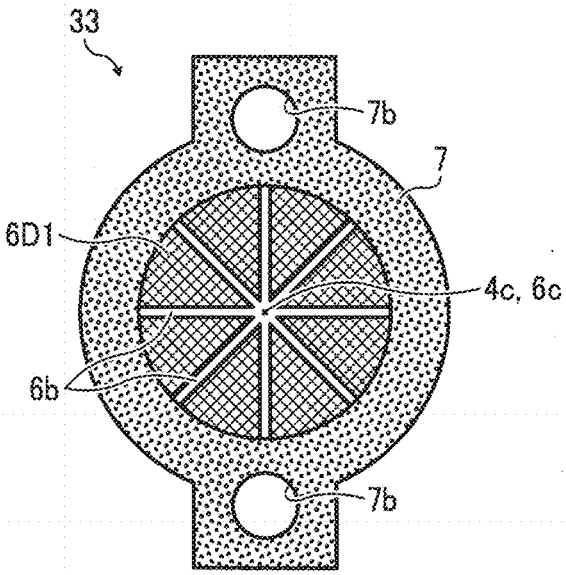
Figure 21D:
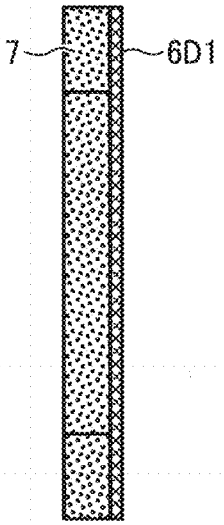
Figure 21C:
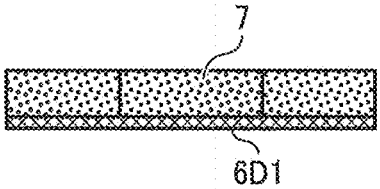
Figure 22A:
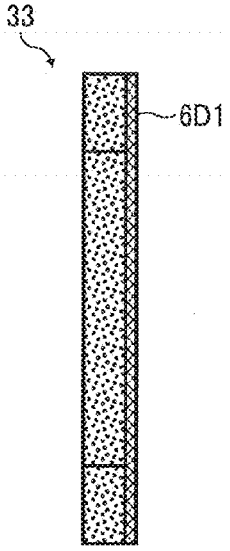
FIGS. 22A and 22B are a side view and a back view, respectively, for explaining the structure of the conductive cloth assembly of the first example.
Figure 22B:
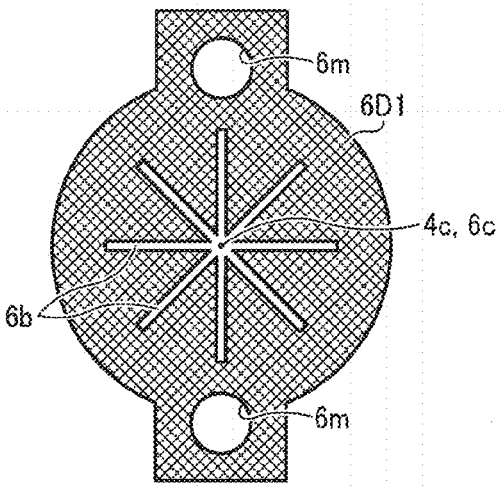

With reference to FIGS. 20 to 28, examples of an assembly of the flange (flange assembly) and an assembly of the conductive cloth (conductive cloth assembly) will be described. FIG. 20 illustrates an assembly structure of an assembly 32 (hereinafter, referred to as a "flange assembly 32"), which is formed of the flange 2 and components to be described later and which is assembled with the photoreceptor to form the image carrier unit. The flange assembly 32 includes, as shown in FIG. 20, the flange 2, an assembly 33 (hereinafter refereed to as a "conductive cloth assembly 33") of the conductive cloth 6D1 and the pressing member 7, and the grounding plate 5.

Figure 23A:
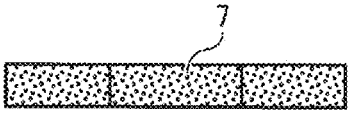
FIGS. 23A to 23C are a plan view, a front view, and a right side view, respectively, for explaining the shape of a pressing member of the first example.
Figure 23B:
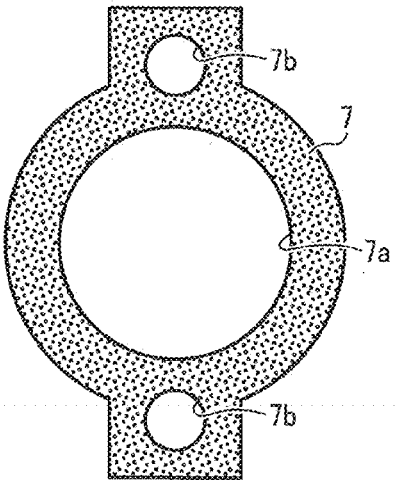
Figure 23C:
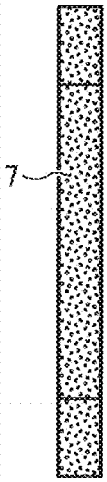

As shown in FIGS. 20 to 22B, the conductive cloth assembly 33 is structured such that the conductive cloth 6D1 and the pressing member 7 are attached to each other with a double-sided tape (not shown). The conductive cloth 6D1 includes the eight cuts 6*b* through which the shaft passes, and boss holes 6*m* through which the two bosses 2*c* of the flange 2 pass. As shown in FIG. 23B, the pressing member 7 includes a through hole 7*a* that is larger than the outer diameter of the shaft and through which the shaft passes, and boss holes 7*b* through which the two bosses 2*c* of the flange pass.

In FIGS. 20 to 22B, FIGS. 24A to 27, and the like, the cuts 6*b* of the conductive cloth 6D1 are exaggeratingly magnified with interspaces shown therebetween for clear illustration. However, it should be noted that actual interspaces between the cuts 6*b* is arranged in a non-viewable manner.

Figure 24A:
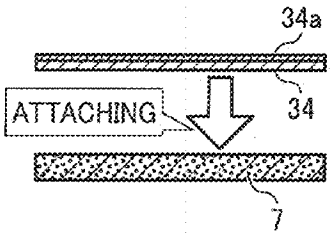
FIGS. 24A to 24E are diagrams illustrating a flow of processing the conductive cloth assembly of the first example.
Figure 24B:
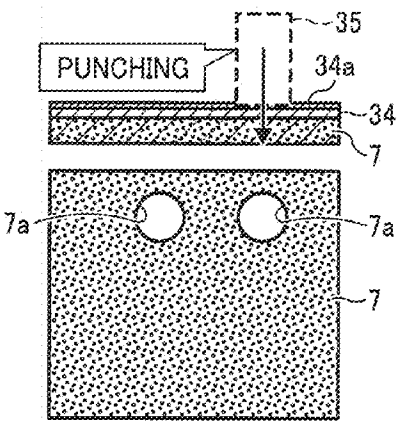

A method of processing the conductive cloth assembly 33 is described with reference to FIGS. 24A to 24E. In a first process, as shown in FIG. 24A, a double-sided tape 34 is attached to the pressing member 7. The double-sided tape 34 with release paper 34*a* is attached to the surface of the unprocessed pressing member 7 having a predetermined thickness. Subsequently, in a second process as shown in FIG. 24B, a process of making a hole in the center of the pressing member 7 is performed. In this process, the pressing member 7 together with the double-sided tape 34 with the release paper 34*a* is punched by using a punch 35 illustrated by a dashed line to form the through hole 7*a* of the pressing member 7 (in this example, two through holes are formed to form two conductive cloth assemblies 33), so that the two through holes 7*a* are formed.

Figure 24C:
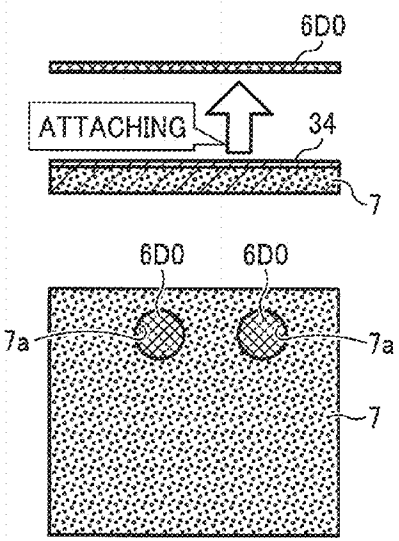
Figure 24D:
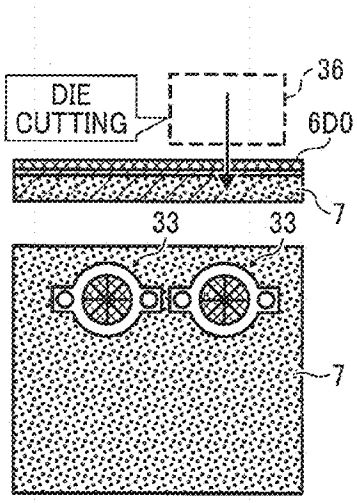
Figure 24E:
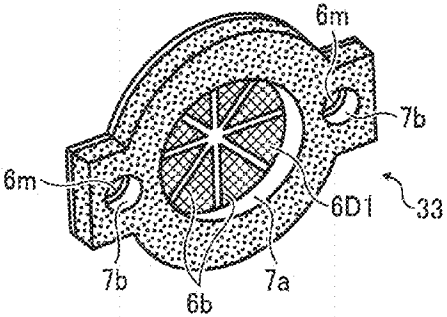

Subsequently, in a third process as shown in FIG. 24C, a process of attaching an unprocessed conductive cloth 6D0 to the pressing member 7, to which the double-sided tape 34 is attached and on which the through hole 7*a* is formed is performed. The conductive cloth 6D0 on which the cuts 6*b* are not formed and the pressing member 7 on which the through hole 7*a* is formed and the double-sided tape 34 is attached are attached to each other by removing the release paper 34*a*. Lastly, in a fourth process as shown in FIG. 24D, die-cutting is performed on the pressing member 7 on which the conductive cloth 6D0 is attached with the double-sided tape 34. In this example, the die-cutting is performed on the conductive cloth 6D0 by using a press forming die 36 illustrated by a dashed line, so that a process on the eight radial cuts 6*b* for forming the conductive cloth 6D1, the two boss holes 6*m*, and the outer shape and a process on the through hole 7*a* of the pressing member 7, the two boss holes 7*b*, and the outer shape are performed simultaneously. Through the above processes, the conductive cloth assembly 33 shown in FIG. 24E is obtained.

In FIGS. 20 and 24A to 24E, the pressing member 7 is used to surely bring the conductive cloth 6D1 into contact with the grounding plate 5 and assure the electrical connection between the conductive cloth and the grounding plate. In contrast, the conductive cloth 6D1 and the pressing member 7 are attached to each other with the double-sided tape 34 to improve the assemble capability of the photoreceptor. In other words, the electrical connection is needed only between the conductive cloth 6D1 and the grounding plate 5, and the double-sided tape 34 for attaching the conductive cloth 6D1 to the pressing member 7 need not have the conductivity.

Figure 26A:
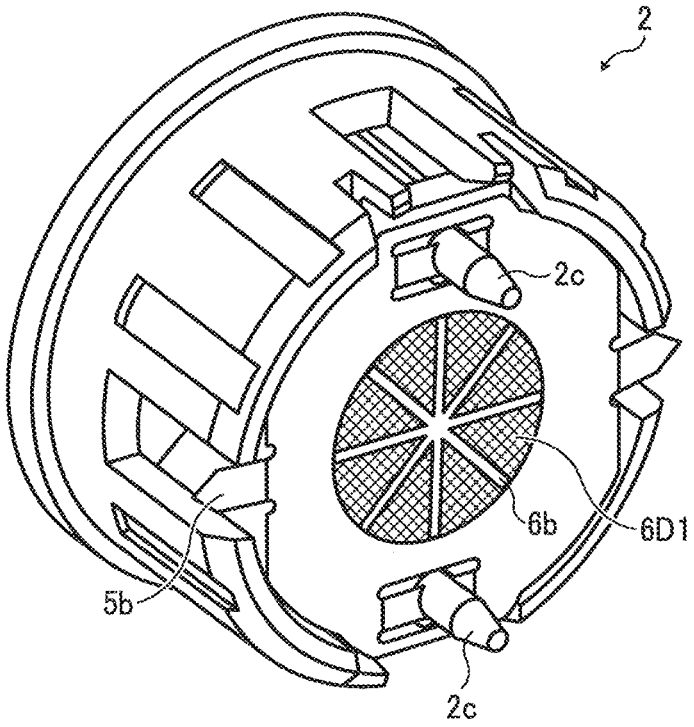
FIGS. 26A to 26C are a perspective view, a front view, and a side view, respectively, for explaining mounting of a grounding plate on the flange of the first example.
Figure 26B:
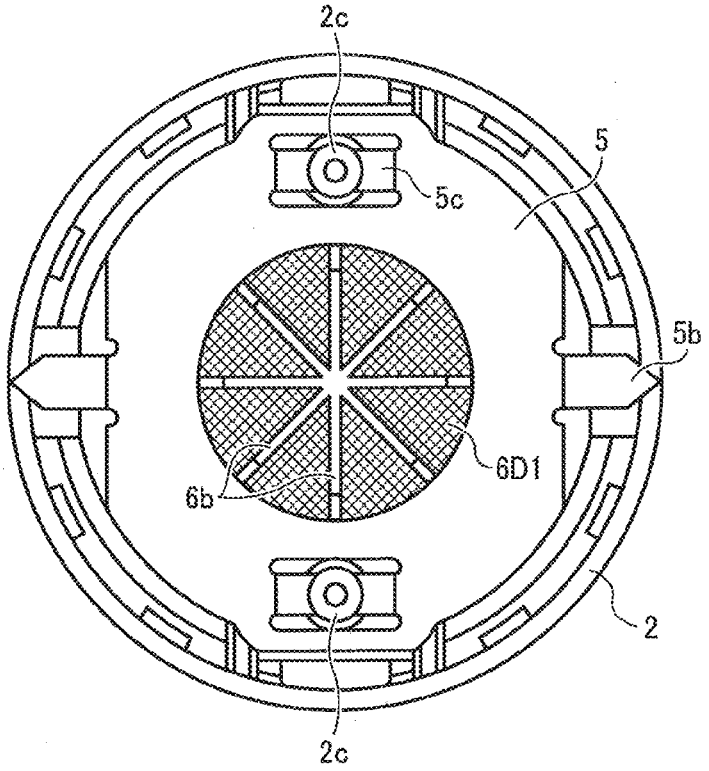
Figure 26C:
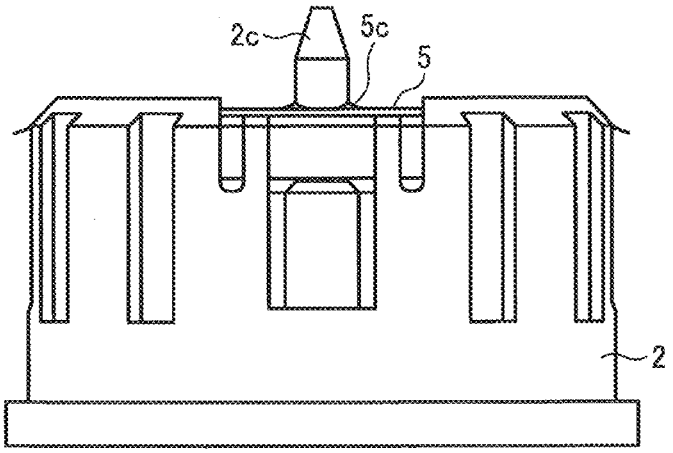

As for a method of assembling the flange assembly 32, in FIG. 20, the surface of the pressing member 7 of the conductive cloth assembly 33 is placed to face the mounting surface 2*b* of the flange 2, and the two bosses 2*c* of the flange 2 are fitted to the boss holes 7*b* and 6*m* of the conductive cloth assembly 33. Subsequently, the boss fixing claws 5*c* of the grounding plate 5 are engaged with the respective bosses 2*c* of the flange 2 protruding from the boss holes 7*b* and 6*m* of the conductive cloth assembly 33. Accordingly, as shown in FIGS. 26A to 26C, the boss fixing claws 5*c* are elastically engaged with and fixed to the respective bosses 2*c* of the flange 2 by spring action, so that the grounding plate 5 is fixedly held on the flange 2.

For mounting the conductive cloth 6D1 on the flange 2, as described above, the two bosses 2*c* of the flange 2 are fitted to the boss holes 6*m*. The inner diameter of each boss hole 6*m* of the conductive cloth 6D1 is set to be greater than the outer diameter of each boss 2*c*. This is because the center point 6*c* of the conductive cloth 6D1 does not necessarily coincide with the center of the shaft 4. Even when the center point 6*c* of the conductive cloth 6D1 and the center of the shaft 4 coincide with each other, the tip of the conductive cloth 6D1 that is opened by the cuts 6*b* comes into contact with the shaft 4. Therefore, because both the centers need not exactly coincide with each other, dimensional tolerance of the conductive cloth 6D1 can be increased, enabling to reduce costs. In this regard, the two bosses 2*c* of the flange 2 function to guide the conductive cloth 6D1 to be mounted on the flange 2. Practically, concave grooves 2*d* of the flange 2 and convex edge portions 6*n* of the conductive cloth 6D1 are engaged with each other as described below, so that the position of the conductive cloth 6D1 relative to the flange 2 is approximately determined.

Figure 25A:
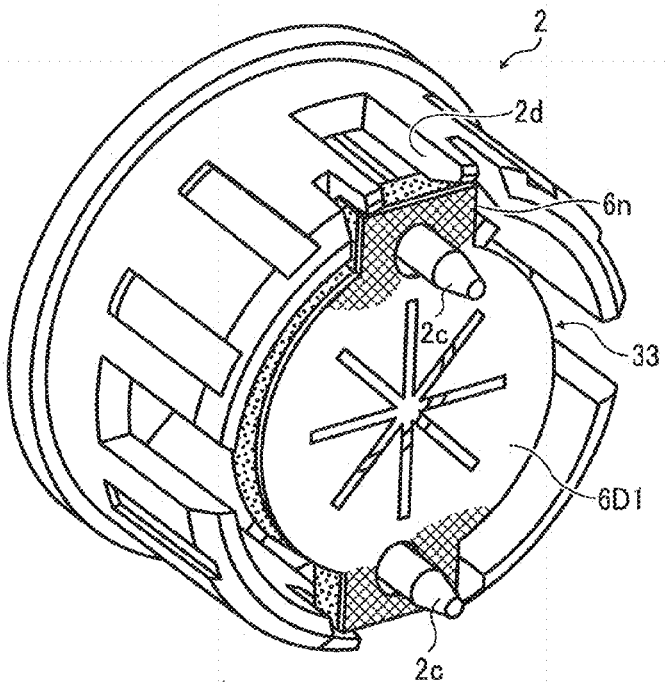
FIGS. 25A and 25B are a perspective view and a front view, respectively, for explaining a positioning structure for mounting the conductive cloth on a flange of the first example.
Figure 25B:
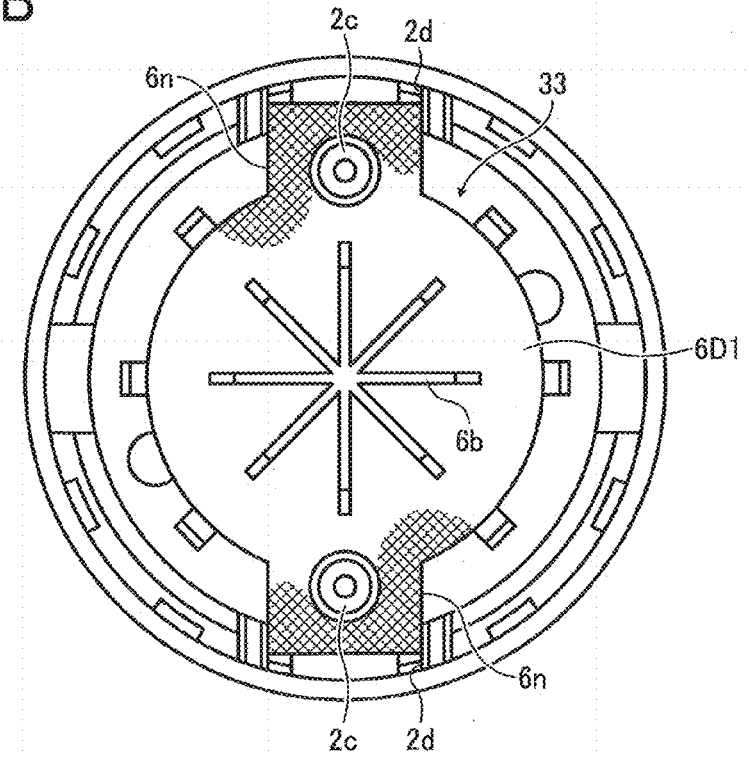

A positioning structure for mounting the conductive cloth 6D1 on the flange 2 is additionally described with reference to FIGS. 25A and 25B. To perform positioning of the conductive cloth 6D1 by fitting the boss holes 6*m* of the conductive cloth 6D1 to the two bosses 2*c* of the flange 2, a sufficient thickness needs to be assured in the vicinity of the boss holes 6*m* of the conductive cloth 6D1. Therefore, fitting dimension is set so that the convex edge portions 6*n* of the conductive cloth 6D1 can be fitted to the concave grooves 2*d* of the flange 2 without displacement to reduce rickety as much as possible. Accordingly, the conductive cloth 6D1 is attached by using the bosses 2*c* of the flange 2 as a guide, and the convex edge portions 6*n* of the conductive cloth 6D1 are fitted to the concave grooves 2*d* of the flange 2, so that the position of the conductive cloth 6D1 relative to the flange 2 is approximately determined.

Figure 27:
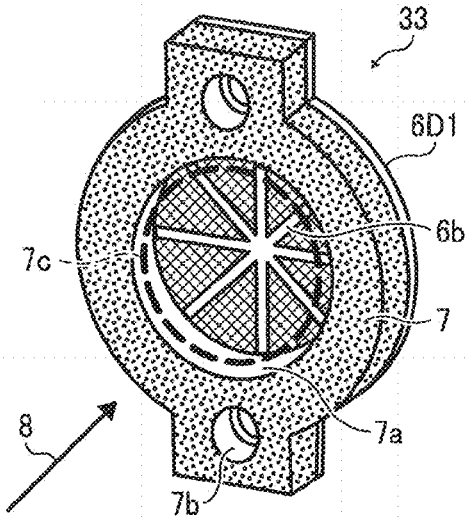
FIG. 27 is a perspective view illustrating a relation between the function of the conductive cloth and a through hole of the pressing member.

The relation between the function of the conductive cloth 6D1 and the through holes 7*a* of the pressing member is additionally explained with reference to FIG. 27. In the first example, similarly to the first embodiment, the contact direction 8 of a shaft (not shown) coming into contact with the conductive cloth 6D1 is set such that the shaft is inserted from the pressing member 7 side of the conductive cloth assembly 33. Therefore, the side where the pressing member is attached in the conductive cloth assembly 33 is the side to come in contact with the shaft (not shown). Accordingly, it is necessary not to place the pressing member 7 in the vicinity of the portion to be in contact with the shaft (not shown), i.e., a pressing-member mounting inhibited portion 7*c* illustrated by a dashed line in the figure, which corresponds to the portions corresponding to the cuts 6*b* formed at the conductive cloth 6D1. Therefore, the through hole 7*a* is formed in the central portion of the pressing member 7.

Furthermore, in FIG. 4 for example, when the structure is such that the shaft 4 is inserted from the gear 3 side, the configuration may be such that the pressing member 7 is placed on the portions corresponding to the cuts 6*b* of the conductive cloth 6D1. When such a configuration is employed, there is an advantage in that the conductive cloth 6D1 can be brought into contact with the shaft 4 with increased strength due to the elasticity of the pressing member 7.

Figure 28:
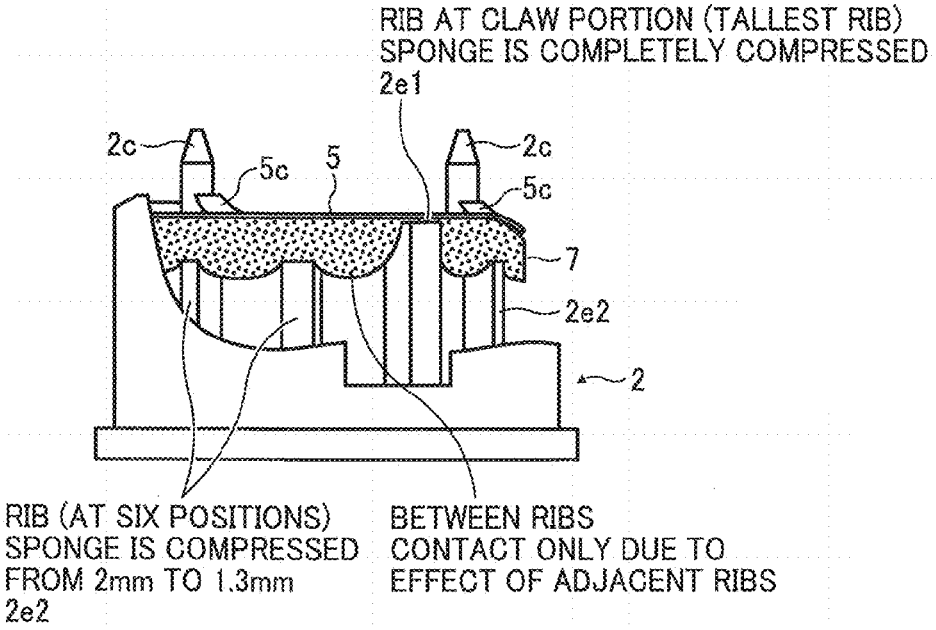
FIG. 28 is a photograph of main parts that illustrates features of mounting the conductive cloth, the pressing member, and the grounding plate on the flange.

The features of the mounting states of the conductive cloth 6D1, the pressing member 7, and the grounding plate 5 on the flange 2 are additionally described with reference to FIG. 28. As shown in FIG. 28, the flange 2 includes eight ribs 2*e*1 and 2*e*2 in total in a radial manner. The conductive cloth 6D1 is placed on the ribs 2e1 and 2e2. Among these ribs 2e1 and 2e2, referring to FIG. 8 for example, the height of a rib at a portion corresponding to two pressure contact portions (claw portions) 5b of the grounding plate to be in contact with the inner wall lAa of the photoreceptor 1 is changed. With this difference in height between the ribs, the following compression state is achieved in the pressing member.

That is, two portions corresponding to the two pressure contact portions 5b are the tall ribs 2e1. The pressing member 7 is pushed until it abuts against the tall ribs 2e1 by the grounding plate 5, so that the pressing member 7 formed of a sponge made of, for example, urethane foam rubber is completely compressed. The pressing member 7 corresponding to the six short ribs 2e2 other than the ribs at the two pressure contact portions 5b is compressed when it is used. Because no component for supporting the tall ribs 2e1 and the short ribs 2e2 downward is arranged between the tall ribs 2e1 and the short ribs 2e2, the ribs are only slightly in contact with each other due to the effect of the adjacent ribs. In this manner, the electrical connection between the grounding plate 5 and the conductive cloth 6D1 is assured mainly at positions where the ribs are arranged. As for the two pressure contact portions (claw portions) 5b of the grounding plate, as described above, the electrical connection is assured by press fitting and fixing the grounding plate 5 to the photoreceptor 1 so that the pressure contact portions (claw portions) 5b are stuck into the inner wall 1Aa of the photoreceptor 1 in the example shown in FIG. 8 for example. Therefore, the configuration is such that the tall ribs 2e1 are arranged at the base portions of the pressure contact portions (claw portions) 5 so that the two pressure contact portions (claw portions) of the grounding plate 5 can stably be deformed using the end portions of the tall ribs 2e1 as a supporting point when the flange assembly 32 is fitted into the photoreceptor 1.

Figure 29:
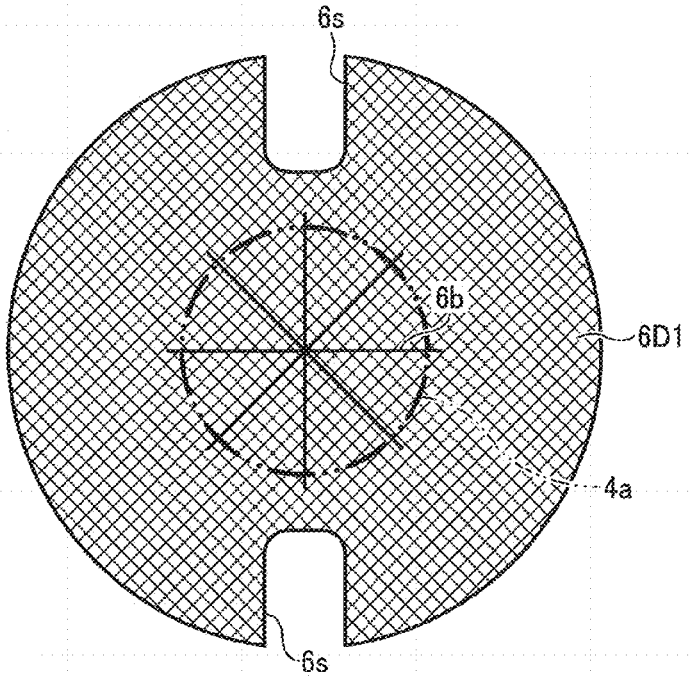
FIG. 29 is a front view of the shape of another example of the conductive cloth of the first example.

According to the above descriptions, the conductive cloth 6D1 may be formed in the shape shown in FIG. 29. In the figure, top and bottom U-shaped grooves 6s are formed so that the process thereof can be made easier than the process of the boss holes 6m of the conductive cloth 6D1 shown in FIG. 20 by taking into account the guiding function of the bosses 2c of the flange 2.

Fifth Modification

Figure 30:
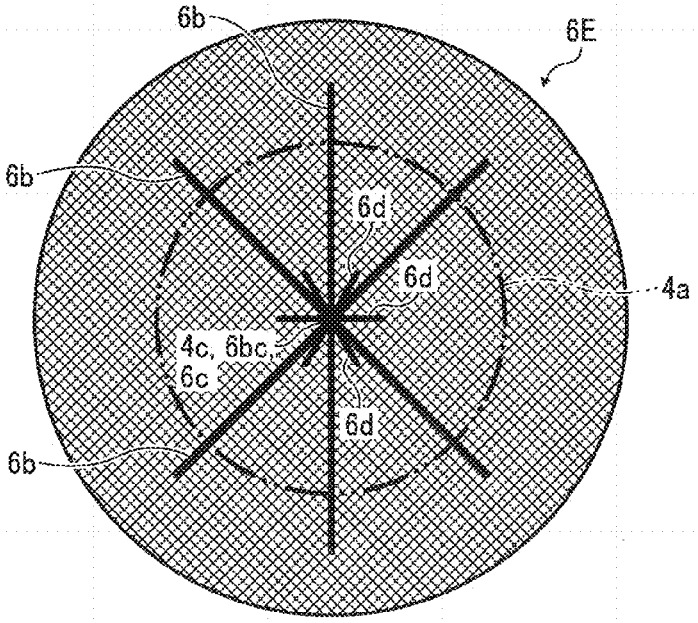
FIG. 30 is a front view of a conductive cloth of a fifth modification.

A conductive cloth 6E of a fifth modification will be described with reference to FIG. 30. The conductive cloth 6E of the fifth modification is different from the conductive cloth 6D shown in FIG. 18 only in that the conductive cloth 6E includes plural (six in this modification) second radial cuts 6d shorter than first radial cuts 6b and extending from the center point 6c in a radial direction of the shaft-outer-diameter shape 4a with angular phases different from the angular phases of the cuts 6b about the center point 6c. The length of the cuts 6d is smaller than that of the cuts 6b, and the cuts 6d are formed at the center point 6c of the conductive cloth 6E inside the shaft-outer-diameter shape in the radial direction of the shaft-outer-diameter shape 4a. The center point 6c of the conductive cloth 6E is an intersection of the plural cuts 6b and the plural cuts 6d, and is also a center 6bc of the plural cuts 6b.

According to the conductive cloth 6E of the fifth modification, for example, if the conductive cloth 6E is employed in FIG. 7, it may be possible to increase the number of contact points between the conductive cloth and the shaft 4. Accordingly, it may be possible to secure more stable electrical connection. Further, like in the fourth modification, the adjacent cuts 6d are disposed at regular angular intervals. However, even though the adjacent cuts are disposed at arbitrarily angular intervals, the same effect may be obtained. Furthermore, even when the lengths of the cuts 6b and 6d are not uniform, the same effect may be obtained.

Moreover, the contact portions of the cuts 6b and 6d of the conductive cloth 6E coming into contact with the shaft 4 may have appropriate rigidity due to the above-mentioned structure, the contact portions do not easily fall down in the direction opposite to the contact direction of the shaft 4, and contact pressure is decreased since the widths of the contact portions in contact with the shaft 4 are decreased toward the shaft center 4c. Accordingly, it may be possible to obtain a low-load electrifying, e.g., grounding, structure. Since the base portions of the contact portions between the cuts 6b, 6d and the shaft 4 are wide and the tip portions thereof are slim, there is an advantage in that the tip portions of the contact portions come into soft contact with the shaft 4 and the body of the contact portions are not easily bent.

Sixth Modification

Figure 31:
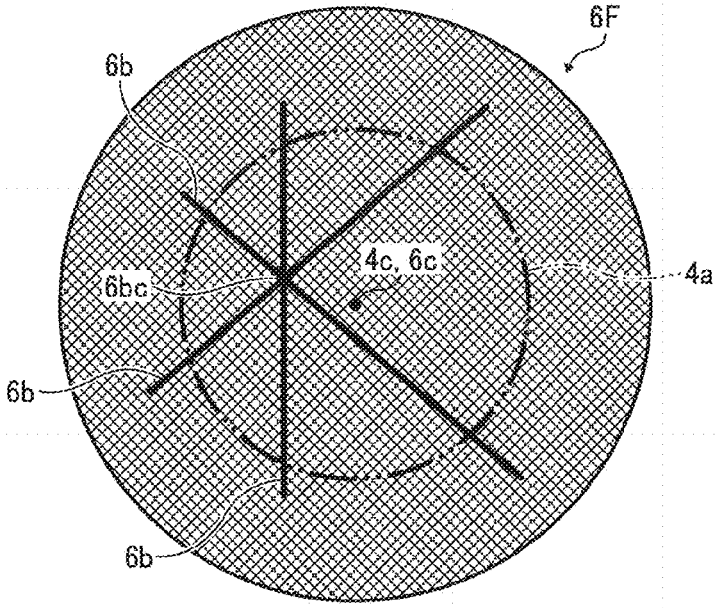
FIG. 31 is a front view of a conductive cloth of a sixth modification.

A conductive cloth 6F of a sixth modification will be described with reference to FIGS. 31 to 33B. FIG. 31 is a front view showing the cuts and shape of the conductive cloth 6F of the sixth modification, and FIG. 32 is a cross-sectional view of one end portion of an image carrier unit of the sixth modification taken along a longitudinal (axial) direction and showing a contact state between tip portions of the conductive cloth 6F and the shaft 4.

Figure 18:
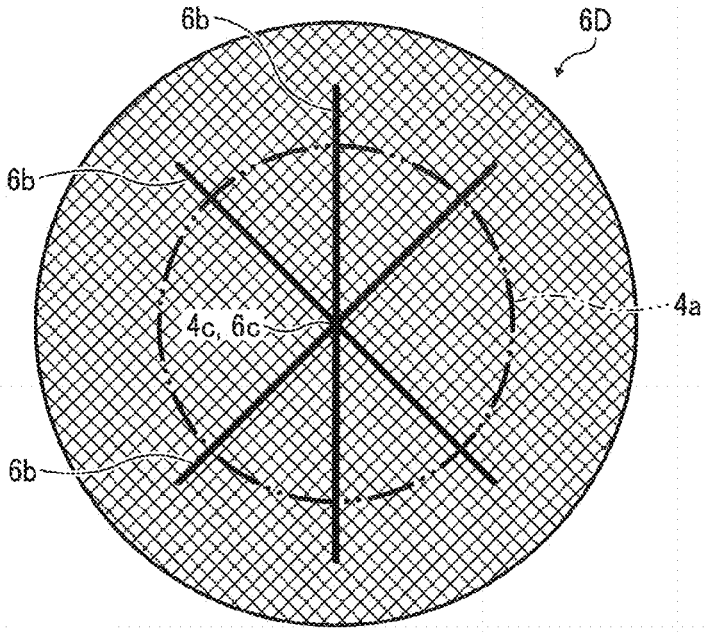
FIG. 18 is a front view of a conductive cloth of a fourth modification.

The conductive cloth 6F of the sixth modification is mainly different from the conductive cloth 6D shown in FIG. 18 in that the center 6bc of plural cuts 6b is deviated from the center point 6c of the conductive cloth 6F and is an arbitrary position within the range of the shaft-outer-diameter shape 4a. The center 6bc of the plural cuts 6b is also the position of the intersection of six cuts 6b.

Figure 32:
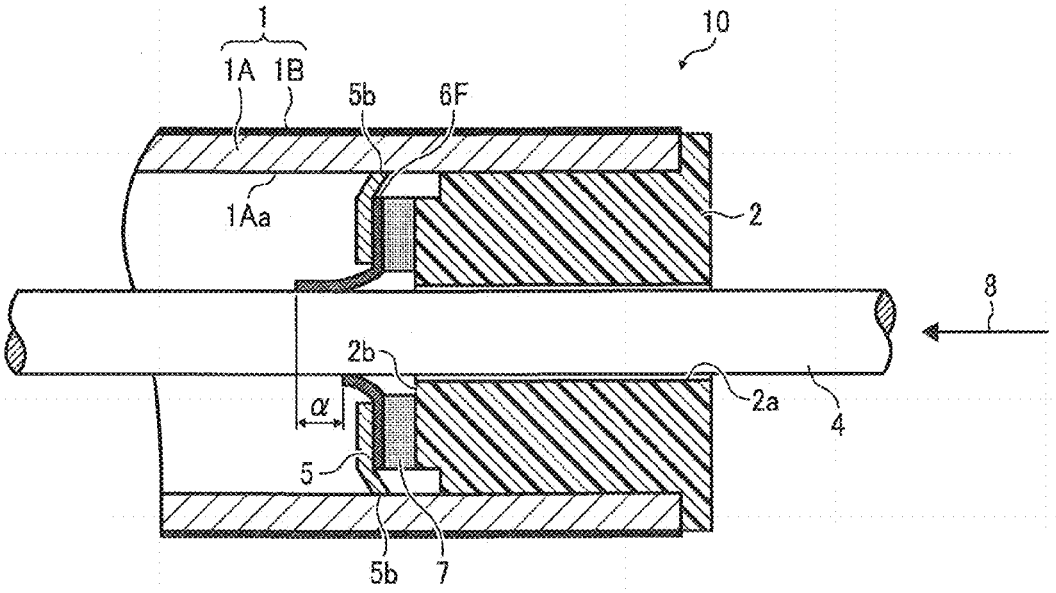
FIG. 32 is a cross-sectional view of one end portion of an image carrier unit of a sixth modification taken along a longitudinal (axial) direction.

According to the conductive cloth 6F of the sixth modification, in addition to the reduction of contact pressure and the improvement of the stability of the electrical connection that is achieved due to plural contact points between the conductive cloth and the shaft 4, the center 6bc of the plural cuts 6b is deviated from the shaft center 4c of the shaft 4 passing through the conductive cloth and the center point 6c of the conductive cloth 6F as shown in FIGS. 31 and 32. Accordingly, the lengths of the contact portions of the tip portions of the conductive cloth 6F (which represents the vicinity of the center 6bc of the plurality of cuts 6b) coming into contact with the shaft 4 are different from each other so as to have the deviation a between the contact positions in FIG. 32. Therefore, the contact positions between the tip portions of the conductive cloth 6F and the shaft 4 are different from each other in the longitudinal direction. As a result, the contact range between the shaft 4 and the conductive cloth is increased, so that the further stability of the electrical connection is expected.

Furthermore, the contact portions of the cuts 6b of the conductive cloth 6F coming into contact with the shaft 4 may have appropriate rigidity due to the above-mentioned structure, the contact portions do not easily fall down in the direction opposite to the contact direction of the shaft 4, and contact pressure is decreased since the widths of the contact portions in contact with the shaft 4 are decreased toward the shaft center 4c. Accordingly, it may be possible to obtain a low-load electrifying, e.g., grounding, structure. Since the base portions of the contact portions between the cuts 6b and the shaft 4 are wide and the tip portions thereof are slim, there is an advantage in that the tip portions of the contact portions come into soft contact with the shaft 4 and the body of the contact portions is not easily bent.

Figure 33A:
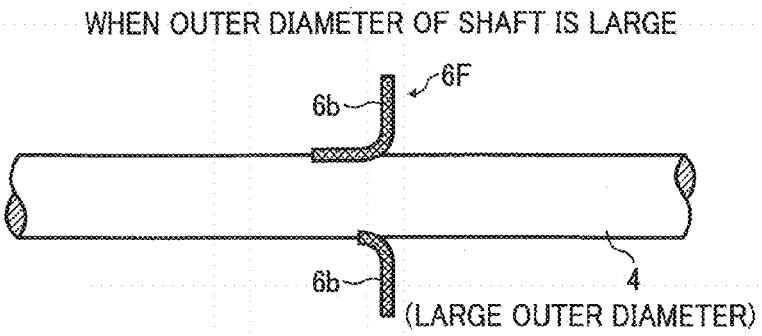
FIGS. 33A and 33B are enlarged perspective views of main parts that illustrate the size of the outer diameter of a shaft of a sixth modification and the fitting state between the shaft and a conductive cloth.
Figure 33B:
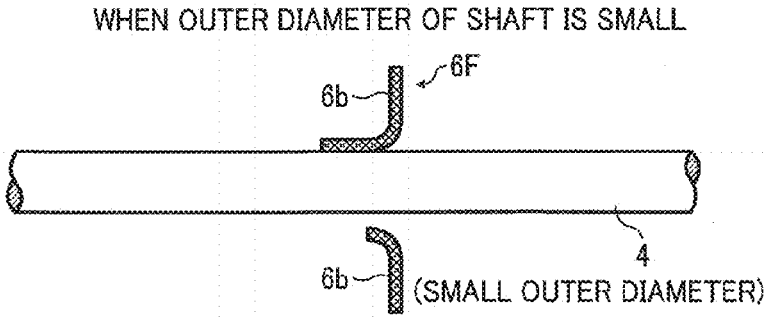

Further, since the position the center 6bc of the plural cuts 6b is deviated from the position of the shaft center 4c, the conductive cloth may be applied to various shafts 4 having different outer diameters. Accordingly, the conductive cloth may have wide application. Since components (shafts) of the same series that are different from each other only in terms of diameter may be used, cost may be reduced. As specific examples, FIG. 33A shows the contact range between the shaft 4 and the tip portions of the conductive cloth 6F when the outer diameter of the shaft 4 is relatively large, and FIG. 33B shows the contact range between the shaft 4 and the tip portions of the conductive cloth 6F when the outer diameter of the shaft 4 is relatively small. Meanwhile, elements other than the shaft 4 and the conductive cloth 6F are not shown in FIGS. 33A and 33B.

Since the outer diameter of the shaft 4 is relatively large in FIG. 33A, the shaft comes into contact with the bending-base portion of the conductive cloth 6F in a contact state shown on the upper side of FIG. 33A and the shaft comes into contact with a target portion of the conductive cloth in a contact state shown on the lower side of FIG. 33A. Since the outer diameter of the shaft 4 is relatively small in FIG. 33B, the shaft 4 does not come into contact with the tip portion of the conductive cloth 6F in the extreme case shown on the lower side of FIG. 33B. However, the shaft comes into contact with a target portion of the conductive cloth on the lower side of FIG. 33B.

Seventh Modification

Figure 34:
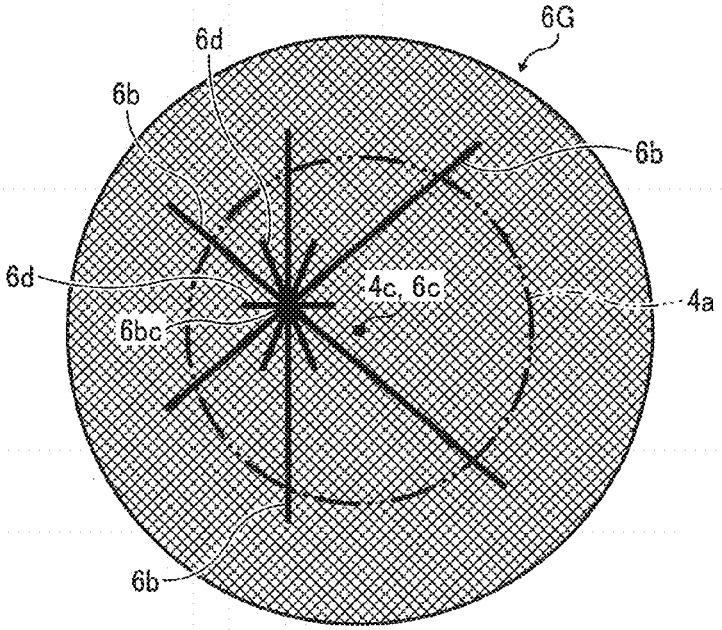
FIG. 34 is a front view of a conductive cloth of a seventh modification.

A conductive cloth 6G of a seventh modification will be described with reference to FIG. 34. The conductive cloth 6G of the seventh modification is mainly different from the conductive cloth 6E shown in FIG. 30 in that the center 6*bc* of plural cuts 6*b* and 6*d* is deviated from the center point 6*c* of the conductive cloth 6G and is at an arbitrary position within the range of the shaft-outer-diameter shape 4*a* under the same technical idea as that of the above-mentioned sixth modification. The center 6*bc* of the plurality of cuts 6*b* and 6*d* is also at the position of the intersection of twelve cuts 6*b* and 6*d* in total.

According to the conductive cloth 6G of the seventh modification, the same advantages and effects as those of the above-mentioned sixth modification are obtained and the number of the contact points between the conductive cloth 6G and the shaft 4 may be larger than that of the contact points between the conductive cloth F of the sixth modification and the shaft 4. Accordingly, it may be possible to further improve the stability of electrical connection.

Furthermore, the contact portions of the cuts 6*b* and 6*d* of the conductive cloth 6G coming into contact with the shaft 4 may have appropriate rigidity due to the above-mentioned structure, the contact portions do not easily fall down in the direction opposite to the contact direction of the shaft 4, and contact pressure is decreased since the widths of the contact portions in contact with the shaft 4 are decreased toward the shaft center 4*c*. Accordingly, it may be possible to obtain a low-load electrifying, e.g., grounding, structure. Since the base portions of the contact portions between the cuts 6*b*, 6*d* and the shaft 4 are wide and the tip portions thereof are slim, there is an advantage in that the tip portions of the contact portions come into soft contact with the shaft 4 and the body of the contact portions are not easily bent.

Various modifications of the pattern and shape of the "cutout portions" and the combination of the "cutout portions" and "cuts" of the conductive cloth of the first embodiment will be described below.

Eighth Modification

Figure 35:
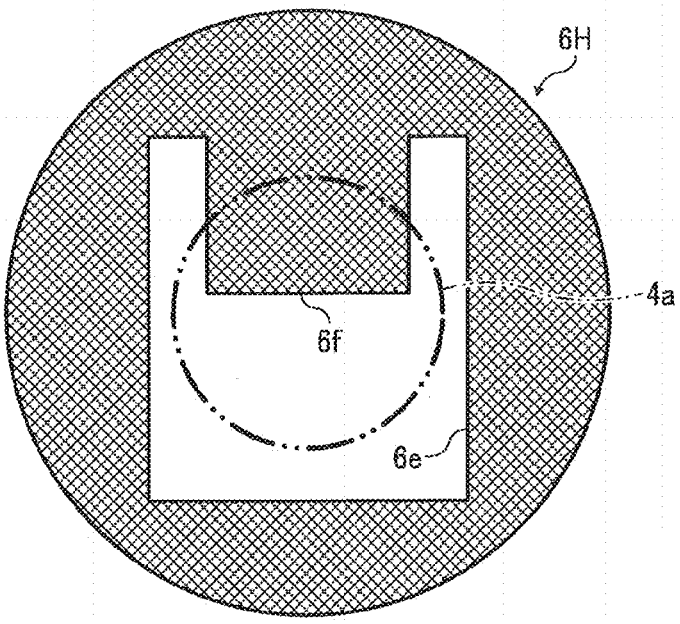
FIG. 35 is a front view of a conductive cloth of an eighth modification.

Conductive cloths 6H and 6I of an eighth modification will be described with reference to FIGS. 35 and 36. The eighth modification is mainly different from the conductive cloth 6, which includes plural cuts 6*a* as shown in FIGS. 5 to 7, in that the conductive cloth 6H including a cutout portion 6*e* is used. As shown in FIG. 35, the shaft 4 may be inserted and pass through the cutout portion, and the cutout portion 6*e* includes a contact portion 6*f* for allowing the conductive cloth 6H to come into contact with the shaft 4 while the conductive cloth is bent when the shaft 4 passes through the cutout portion. The contact portion 6*f* is formed in a simple rectangular shape, and is formed integrally with the conductive cloth 6H so as to be suspended from the upper portion of the cutout portion 6*e*.

Conductive cloths, which includes various "cutout portions," including the conductive cloth 6H of this modification are superior to the conductive cloths 6 and 6A to 6G of the first embodiment, the first example, and the first to seventh modifications in that the contact range and contact pressure between the shaft 4 and the conductive cloth may be accurately adjusted through the conception of the shape of the "cutout portions".

According to this modification, for example, at portions of the conductive cloth 6H, which are other than the cutout portion 6*e* of the conductive cloth 6H and the contact portion 6*f* where the conductive cloth contacts the shaft 4 in FIGS. 5 to 7, when the shaft 4 and the flat plate portion 5*p* of the grounding plate 5 come into contact with each other, it may be possible to secure the electrical connection between the shaft 4 and the grounding plate 5 via the conductive cloth 6H.

Figure 36:
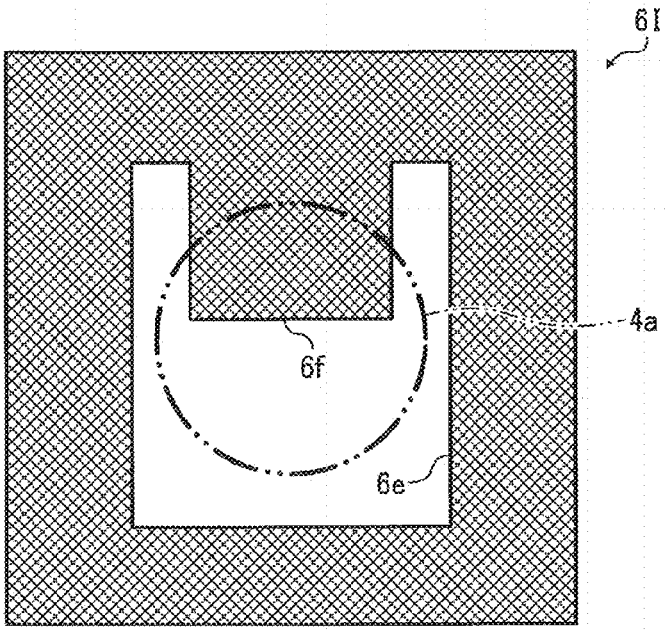
FIG. 36 is a front view of another conductive cloth of the eighth modification.

Further, the shape of the outer periphery of the conductive cloth is not limited to a circular shape like the conductive cloth 6I shown in FIG. 36. An arbitrary shape, such as a polygonal shape and a curved shape, may be selected as the shape of the outer periphery of the conductive cloth. Further, a preferable shape, such as a shape corresponding to a mounting portion or a mounting position or a shape to be easily formed, may be selected as the shape of the outer periphery of the conductive cloth.

Ninth Modification

Figure 37:
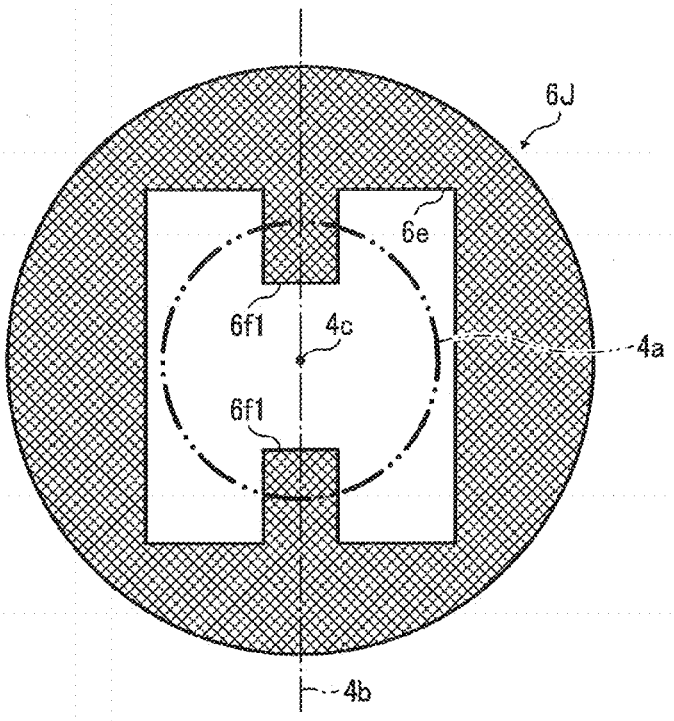
FIG. 37 is a front view of a conductive cloth of a ninth modification.

A conductive cloth 6J of a ninth modification will be described with reference to FIG. 37. The conductive cloth 6J of the ninth modification is different from the conductive cloth 6H shown in FIG. 35 only in that the conductive cloth includes contact portions 6*f*1. As shown in FIG. 37, each of the contact portions 6*f*1 has the contact area smaller than that of the contact portion 6*f*, and the contact portions 6*f*1 are formed at plural positions (two positions in this modification). One contact portion 6*f*1 is disposed so as to be suspended from a portion of the cutout portion 6*e*, that is, an upper portion of the cutout portion 6*e* in FIG. 37. The other contact portion 6*f*1 is disposed so as to rise from the lower portion of the cutout portion 6*e*, and is symmetric to one contact portion 6*f*1 with respect to a center line 4*b* passing through the shaft center 4*c*.

According to this modification, the number of contact points between the shaft 4 and the conductive cloth 6J is increased. Accordingly, it may be possible to secure stable electrical connection. Meanwhile, in FIG. 37, the respective contact portions 6*f*1 have been disposed at positions symmetrical to each other with respect to the center line 4*b*. However, the respective contact portions may be disposed at arbitrary positions.

Tenth Modification

A conductive cloth 6K of a tenth modification will be described with reference to FIGS. 38 to 39B. The conductive cloth 6K of the tenth modification is different from the conductive cloth 6H shown in FIG. 35 only in that a line contact portion 6*g*, which allows the tip portion of the conductive cloth 6K to substantially come into line-contact with the shaft when the shaft 4 passes through the conductive cloth, is formed instead of the contact portion 6*f* as shown in FIGS. 38 and 39B.

Figure 38:
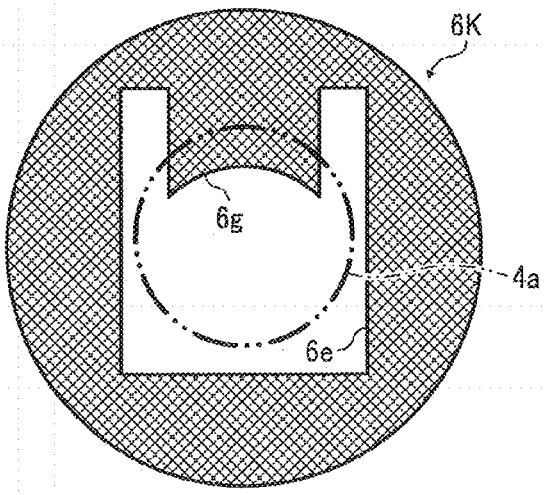
FIG. 38 is a front view of a conductive cloth of a tenth modification.
Figure 39A:
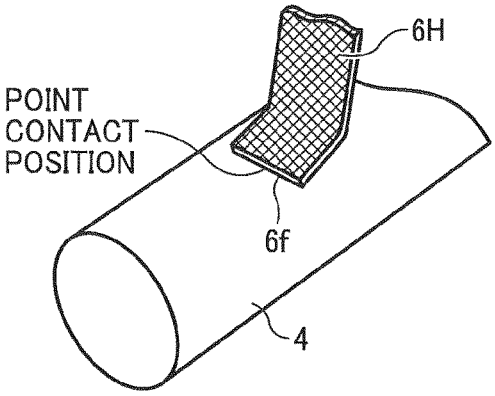
FIGS. 39A and 39B are enlarged perspective views of main parts that illustrate a contact state between the conductive cloth and a shaft of the eighth and the tenth modifications.
Figure 39B:
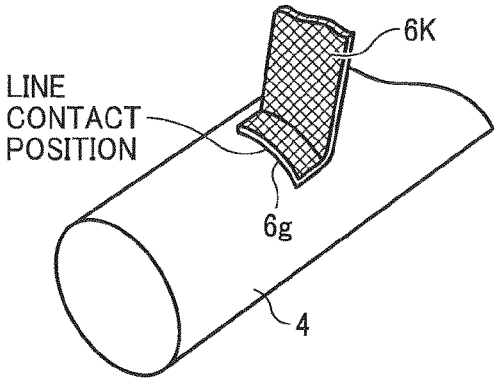

When the shaft 4 passes through the conductive cloth 6K and the line contact portion 6*g* comes into contact with the outer periphery of the shaft 4 as shown in FIGS. 38 and 39B, the shape of the line contact portion 6*g* is set so that the line contact portion comes into line contact with the shaft while overlapping the shaft so as to follow the shape of the outer periphery of the shaft. Accordingly, the contact range is increased in this modification due to the linear contact between the shaft 4 and the line contact portion 6*g* as compared with the case shown in FIG. 39A. Accordingly, it may be possible to secure stable electrical connection.

Meanwhile, if the conductive cloth 6H shown in FIG. 35 is used, the contact portion comes into point contact with the outer periphery of the shaft 4 as shown in FIG. 39A due to the simple line shape of the contact portion 6*f* of the conductive cloth 6H when the shaft 4 passes through the conductive cloth 6H. For this reason, substantially the same increase of the contact range as the contact range of the conductive cloth 6K of the tenth modification is not expected.

Eleventh Modification

Figure 40:
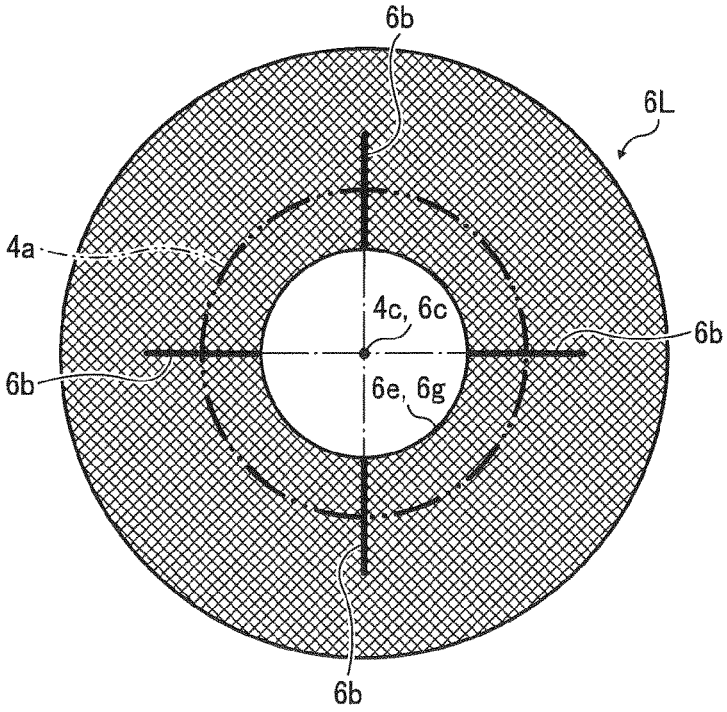
FIG. 40 is a front view of a conductive cloth of an eleventh modification.

A conductive cloth 6L of an eleventh modification will be described with reference to FIG. 40. The conductive cloth 6L of the eleventh modification corresponds to the combination of the conductive cloth 6D of the fourth modification shown in FIG. 18 and the conductive cloth 6K of the tenth modification shown in FIG. 38. That is, the conductive cloth 6L includes the cutout portion 6*e* that includes a line contact portion 6*g* formed on the substantially entire inner periphery of the cutout portion, and plural cuts 6*b* that extend from the center point 6*c* of the conductive cloth 6L to the outside of the shaft-outer-diameter shape 4*a* in a radial direction.

According to this modification, plural line contact portions 6*g* and plural radial cuts 6*b* are used together. Accordingly, it may be possible to further increase the range of a line contact position as compared with the conductive cloth 6K shown in FIG. 38. The shapes of the cutout portion 6*e* and the line contact portion 6*g* are determined by the number of cuts 6*b*. The number of cuts has been four in this modification, but may be set to an arbitrary value.

Twelfth Modification

Figure 41:
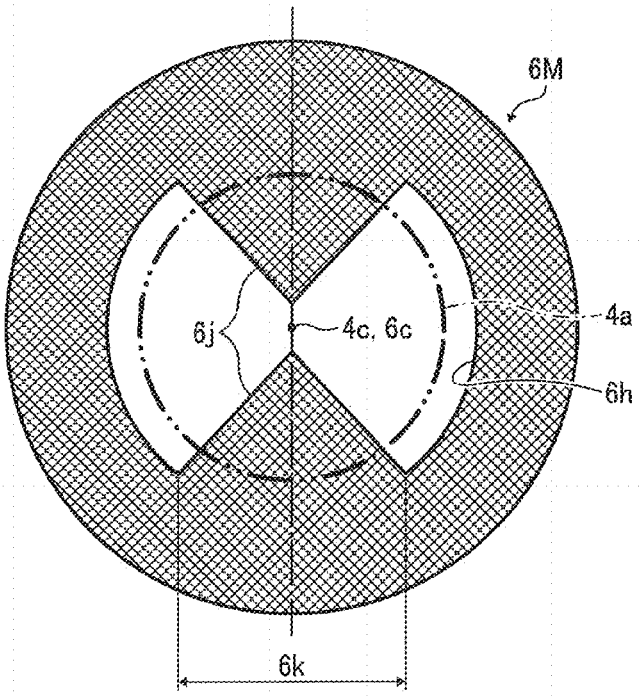
FIG. 41 is a front view of a conductive cloth of a twelfth modification.

A conductive cloth 6M of a twelfth modification will be described with reference to FIG. 41. The conductive cloth 6M of the twelfth modification is mainly different from the conductive cloth 6K shown in FIG. 38 in that a cutout portion 6*h* including contact portions 6*j* is used instead of the cutout portion 6*e* including the line contact portion 6*g*. For example, if the conductive cloth 6M is employed in FIG. 8, the shape of the contact portion 6*j* is set so that the contact area of the contact portion is reduced toward the shaft center 4*c* when the shaft 4 passes through the conductive cloth and the conductive cloth comes into contact with the outer periphery of the shaft.

The contact portions 6*j* and the cutout portion 6*h* are formed at the conductive cloth 6M so as to be symmetrical to each other with respect to a center line that passes through the shaft center 4*c* and the center point 6*c* of the conductive cloth 6M. For example, if the conductive cloth 6M is employed in FIG. 8, the contact portion 6*j* is formed in a triangular shape so that the width 6*k* of the tip portion of the conductive cloth 6M is gradually decreased toward the shaft center 4*c* from a bending position of the conductive cloth 6M. In other words, the contact portion 6*j* is formed in a triangular shape so that the width 6*k* is gradually decreased from the inner periphery of the cutout portion 6*h* toward the shaft center 4*c* and the center point 6*c* of the conductive cloth 6M.

According to this modification, the contact portion 6*j* of the conductive cloth 6M may have appropriate rigidity due to the above-mentioned structure, the contact portion does not easily fall down in a direction opposite to the contact direction of the shaft 4, and contact pressure is decreased since the width 6*k* is decreased toward the shaft center 4*c*. Accordingly, it may be possible to obtain a low-load electrifying, e.g., grounding structure. Since the base portion of the contact portion 6*j* is wide and the tip portion thereof is slim, there is an advantage in that the tip portion of the contact portion comes into soft contact with the shaft 4 and the body of the contact portion is not easily bent.

Thirteenth Modification

The conductive cloth 6M of a thirteenth modification will be described with reference to FIG. 42. In the thirteenth modification, the conductive cloths 6 and 6A to 6M described above are used in an electrifying structure such as a grounding structure between, for example, the shaft 4 of the image carrier unit 10 and the frame 14 as a casing of the process cartridge 58 shown in FIG. 2.

The process cartridge 58 includes, as described above with reference to FIGS. 1 and 2, the frame 14 as a casing supporting member for integrally supporting the image carrier unit 10 including the image carrier 1 and the like, the charging roller 11 included in the charging device, the cleaning blade 13 included in the cleaning device, and the developing roller 12 included in the developing device. The process cartridge 58 is detachably mounted on the main body frame 51 of the color image forming apparatus 50 via the frame 14.

Figure 42:
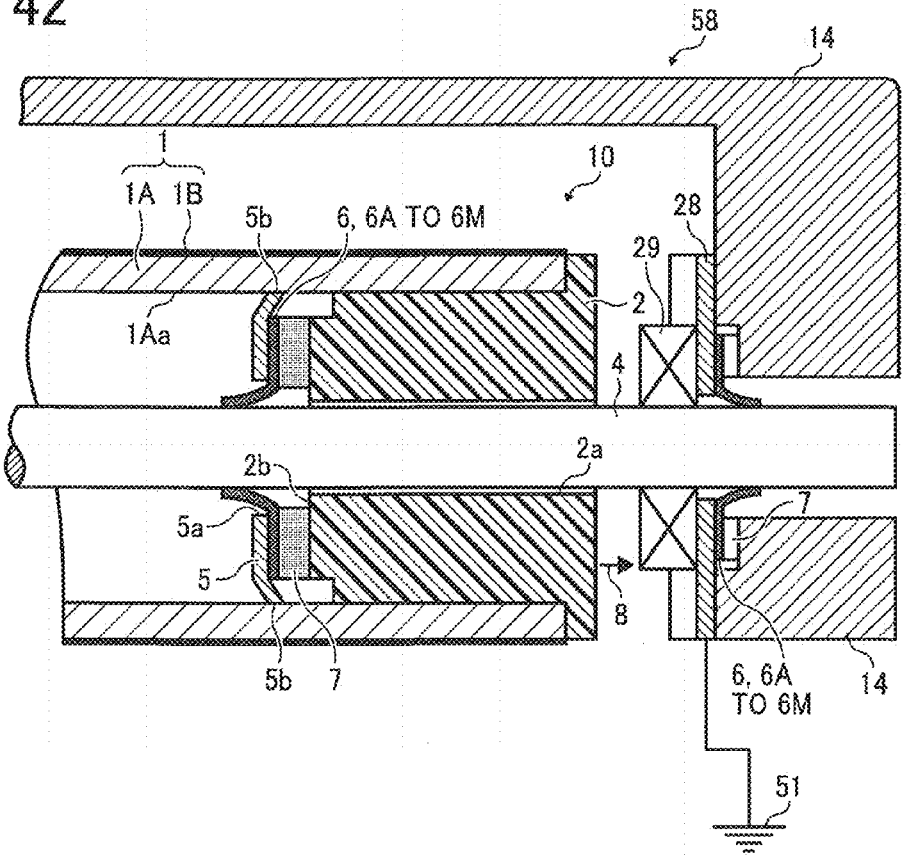
FIG. 42 is a cross-sectional view of one end portion of an image carrier unit of a thirteenth modification taken along a longitudinal (axial) direction, which illustrates a grounding structure for electrically connecting a shaft of the image carrier unit and a stay via a conductive cloth.

In FIG. 42, when the image carrier unit 10 is mounted on and supported by the frame 14 of the process cartridge 58, one end portion (a right end portion in FIG. 42) of the shaft 4 is supported by the frame 14. When one end portion (the right end portion in FIG. 42) of the shaft 4 of the image carrier unit 10 passes through the conductive cloth 6, the conductive cloth 6 is bent and comes into contact with the outer peripheral surface of the shaft 4, so that the shaft 4 and a stay 28 to be electrified (grounded) are electrically connected to each other via the conductive cloth 6.

One end portion (a right end portion in FIG. 42) and the other end portion (a left end portion in FIG. 42) of the shaft 4 are supported via bearings 29 each being formed of, for example, a sliding bearing. Each of the bearings 29 is mounted on and fixed to the frame 14 of the process cartridge 58 detachably mounted on the main body frame 51 in FIG. 42. Each of the bearings 29 is not specially structured such that conductive grease is applied as employed in the electrifying, e.g., grounding, mechanism of the shaft 4 of the related technology, or such that the conductivity can be assured. Therefore, general and versatile bearings can be used. The stay 28 is formed of a material, which is excellent in conductivity, for example, a metal sheet such as a steel plate.

The conductive cloth 6 includes cuts through which the shaft 4 can pass. The stay 28 and the conductive cloth 6 come into contact with each other at portions other than the cuts.

As a method of making the stay 28 come into contact with the conductive cloth 6, the pressing member 7 is disposed between the frame 14 and the conductive cloth 6, and the conductive cloth 6 and the pressing member 7 are pressed by the stay 28, so that the pressing member 7 is elastically deformed so as to be compressed and the conductive cloth 6 may more reliably come into contact with the stay 28. Therefore, electrical connection is stably secured with time. In FIG. 42, the bearings 29, the stay 28, the conductive cloth 6, the pressing member 7, and the frame 14 are assembled in this order from the left side to the right side as shown in the figure, so that a part of the process cartridge 58 is formed. In the grounding structure shown in FIG. 42, the stay 28 and the conductive cloth 6 come into contact with each other in overlapping regions other than the cuts of the conductive cloth 6. Accordingly, the stay 28 and the conductive cloth 6 are electrically connected to each other.

When one end portion of the shaft 4 of the image carrier unit 10 is inserted in the insertion direction 8 as shown in FIG. 42, the end portion of the shaft 4 passes through the cuts formed at the conductive cloth 6 of the frame 14 and the conductive cloth 6 is bent and comes into contact with the shaft 4. In this case, since the stay 28 and the conductive cloth 6 are fixed and interposed between the bearing 29 and the frame 14, the shaft 4, the conductive cloth 6, and the stay 28 come into contact with each other. Accordingly, the shaft 4 and the stay 28 may be electrically connected to each other. When the process cartridge 58 is mounted on the main body frame 51 in FIG. 42, the process cartridge 58 comes into contact with an electrical connection portion (not shown) of the main body frame 51, so that electrical connection is maintained. Since the surface of the shaft 4 and the electrical connection portion of the main body frame 51 are electrically connected to each other and the main body frame 51 is electrified or grounded as described above, the photoreceptor 1 may be grounded via the shaft 4.

As for the contact between the conductive cloth 6 and the shaft 4, it may be possible to obtain appropriate contact pressure between the conductive cloth 6 and the shaft 4 since the conductive cloth 6 itself is bent. Further, as for the shape of the conductive cloth 6, it may be possible to obtain the above-mentioned performance by the simple shape that is formed by a very simple work of forming the cuts at the conductive cloth 6. The conductive cloth 6 contains metal. However, since the metal is not a main material, generation of abnormal sound and poor electrical connection originating from oxidation, which are problems in the related technology, do not occur.

The thirteenth modification is not limited to the above. If the advantages and effects that may be obtained by the pressing member 7 are not desired to that extent, the pressing member 7 may be removed similarly to the first embodiment. Furthermore, the thirteenth modification is not limited to the example using the conductive cloth 6 similar to that of the second embodiment. It is possible to apply any one of the conductive cloths 6A to 6M, which are illustrated together with the conductive cloth 6 in FIG. 29. In this case, it goes without saying that the advantages and effects described above can be assured.

Fourteenth Modification

A fourteenth modification will be described with reference to FIG. 43. In the fourteenth modification, the conductive cloths 6 and 6A to 6M described above are used in an electrifying structure such as a grounding structure between, for example, the shaft 4 of the image carrier unit 10 and the frame 14 as a casing of the process cartridge 58 shown in FIG. 2. The fourteenth modification is different from the thirteenth modification shown in FIG. 42 in that bearings 30, the pressing member 7, the conductive cloth 6, and the frame 14 are assembled in this order from the left side to the right side as shown in the figure, so that a part of the process cartridge 58 is formed.

Figure 43:
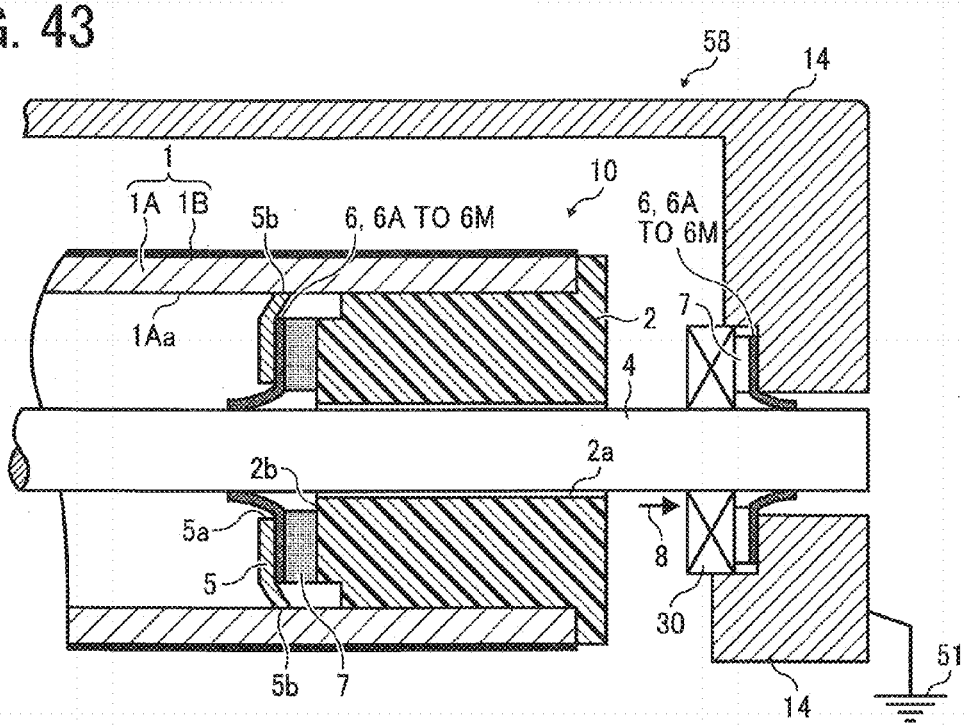
FIG. 43 is a cross-sectional view of one end portion of an image carrier unit of a fourteenth modification taken along a longitudinal (axial) direction, which illustrates a grounding structure for electrically connecting a shaft of the image carrier unit and a frame via a conductive cloth.

In FIG. 43, when the image carrier unit 10 is mounted on and supported by the frame 14 of the process cartridge 58, one end portion (a right end portion in FIG. 43) of the shaft 4 is supported by the frame 14. When one end portion (the right end portion in FIG. 43) of the shaft 4 of the image carrier unit 10 passes through the conductive cloth 6, the conductive cloth 6 is bent and comes into contact with the outer peripheral surface of the shaft 4, so that the shaft 4 and the frame 14 to be electrified (grounded) are electrically connected to each other via the conductive cloth 6.

One end portion (a right end portion in FIG. 43) and the other end portion (a left end portion in FIG. 43) of the shaft 4 are supported via the bearings 30. Each of the bearings 30 is mounted on and fixed to the frame 14 of the process cartridge 58 detachably mounted on the main body frame 51 in FIG. 43. The frame 14 is formed of a material, which is excellent in conductivity, for example, a metal sheet such as a steel plate. Each of the bearings 30 is not specially structured such that conductive grease is applied as employed in the electrifying, e.g., grounding, mechanism of the shaft 4 of the related technology, or such that the conductivity can be assured. Therefore, general and versatile bearings can be used.

The conductive cloth 6 includes cuts through which the shaft 4 can pass. The frame 14 and the conductive cloth 6 come into contact with each other at portions other than the cuts.

As a method of making the frame 14 come into contact with the conductive cloth 6, the pressing member 7 is disposed between the bearings 30 and the conductive cloth 6, and the conductive cloth 6 and the pressing member 7 are pressed by the frame 14, so that the pressing member 7 is elastically deformed so as to be compressed and the conductive cloth 6 may more reliably come into contact with the frame 14. Therefore, electrical connection is stably secured with time. In FIG. 43, the bearings 30, the pressing member 7, the conductive cloth 6, and the frame 14 are assembled in this order from the left side to the right side as shown in the figure, so that a part of the process cartridge 58 is formed. The frame 14 and the conductive cloth 6 come into contact with each other in overlapping regions other than the cuts of the conductive cloth 6. Accordingly, the frame 14 and the conductive cloth 6 are electrically connected to each other.

When one end portion of the shaft 4 of the image carrier unit 10 is inserted in the insertion direction 8 as shown in FIG. 43, the shaft 4 passes through the cuts formed at the conductive cloth 6 and the conductive cloth 6 is bent and comes into contact with the shaft 4. In this case, since the frame 14 and the conductive cloth 6 are fixed and interposed between the bearings 30 and the shaft 4, the conductive cloth 6, and the frame 14 come into contact with each other. Accordingly, the shaft 4 and the frame 14 may be electrically connected to each other, so that a part of the process cartridge 58 is formed. When the process cartridge 58 is mounted on the main body frame 51 in FIG. 43, the frame 14 comes into contact with an electrical connection portion (not shown) of the main body frame 51, so that electrical connection is maintained. Since the surface of the shaft 4 and the electrical connection portion of the main body frame 51 are electrically connected to each other and the main body frame 51 is electrified or grounded as described above, the shaft 4 may be grounded.

Fifteenth Modification

A fifteenth modification will be described with reference to FIG. 44. In the fifteenth modification, the conductive cloths 6 and 6A to 6M described above are used in an electrifying structure such as a grounding structure between, for example, the shaft 4 of the image carrier unit 10 and the frame 14 as a casing of the process cartridge 58 shown in FIG. 2.

The fifteenth modification is mainly different from the fourteenth modification shown in FIG. 43 in that a conductive cloth 6Z without cuts or cutout portions (through-contact portions) is used instead of the conductive cloth 6 or the conductive cloths 6 and 6A to 6M and the pressing member 7 is removed.

Figure 44:
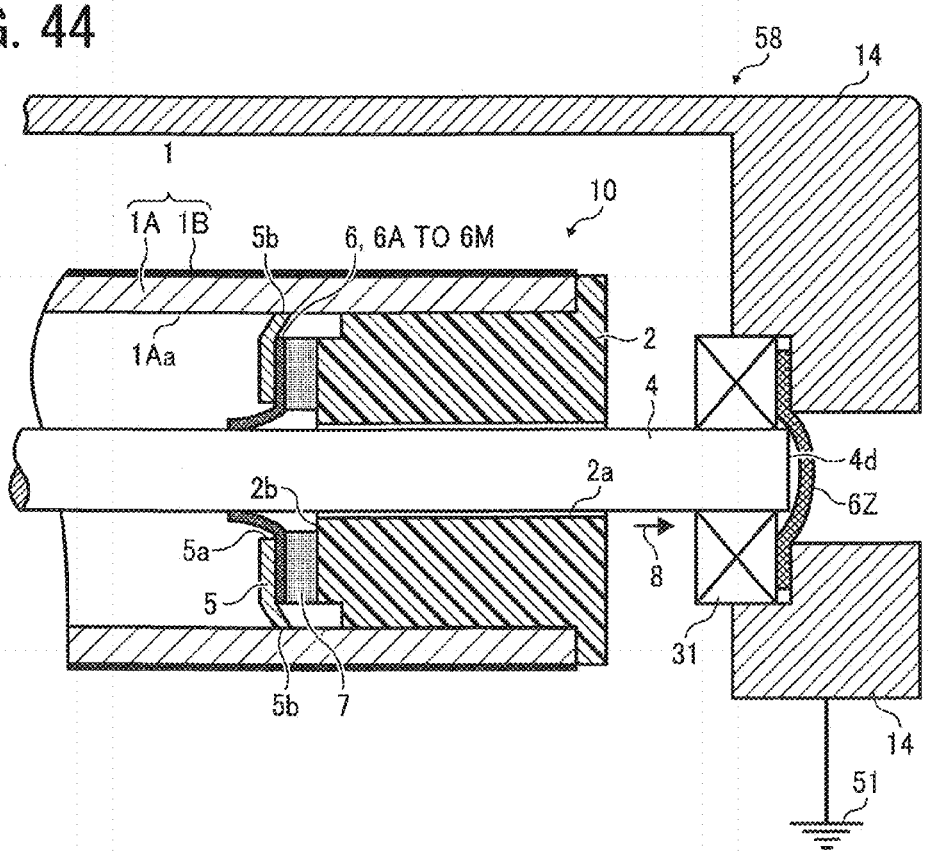
FIG. 44 is a cross-sectional view of one end portion of an image carrier unit of a fifteenth modification taken along a longitudinal (axial) direction, which illustrates a grounding structure for electrically connecting a shaft of the image carrier unit and a frame via a conductive cloth without cuts.

Bearings 31, the conductive cloth 6Z, and the frame 14 are assembled in this order from the left side to the right side as shown in FIG. 44, so that the process cartridge 58 is formed. In this case, an end face 4*d* of one end portion of the shaft 4 of the image carrier unit 10 is pressed against the conductive cloth 6Z without the through-contact portions in the insertion direction 8 and bends the conductive cloth, so that the shaft 4 and the frame 14 are electrically connected via the conductive cloth 6Z. When the process cartridge 58 is mounted on the main body frame 51 in FIG. 44, the frame 14 comes into contact with an electrical connection portion (not shown) of the main body frame 51, so that electrical connection is maintained. Since the surface of the shaft 4 and the electrical connection portion of the main body frame 51 are electrically connected to each other and the main body frame 51 is electrified or grounded as described above, the shaft 4 may be grounded.

Second Embodiment

Figure 45:
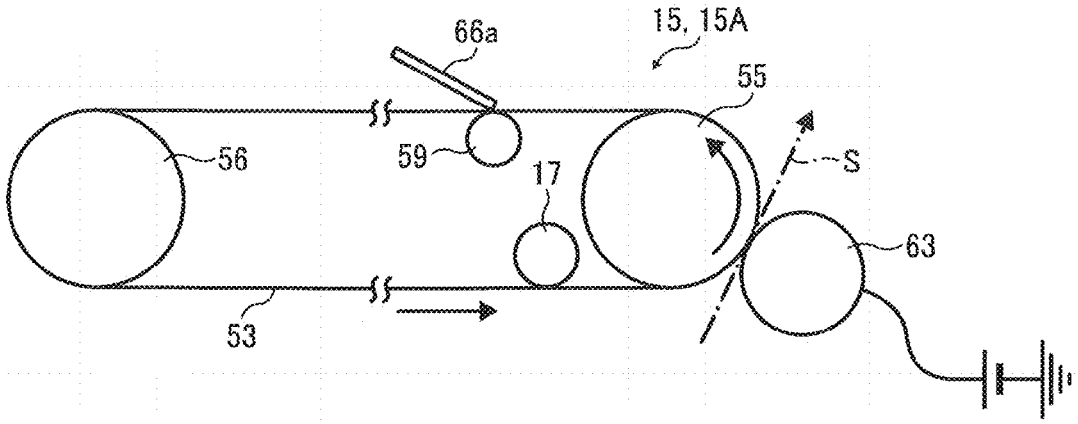
FIG. 45 is a schematic front view of an intermediate transfer belt device of a second embodiment.

A belt unit according to a second embodiment will be described with reference to FIGS. 45 and 46. For easy understanding of the second embodiment, the structure and operation of an intermediate transfer belt unit 15, which includes the intermediate transfer belt 53 shown in FIG. 1 and the like, will be additionally described first with reference to FIG. 45. FIG. 45 is an enlarged front view of main parts of the transfer belt device of FIG. 1 to which this embodiment has been applied.

As partially described above, in FIG. 45, the intermediate transfer belt 53 is driven in the direction of an arrow thanks to the rotation of the driving roller 55 that is rotationally driven by a driving motor (not shown) in the direction of the arrow. When the front end portion of a toner image formed on the intermediate transfer belt 53 reaches a secondary transfer position as shown by a dashed dotted line, a sheet S is fed and a transfer bias is applied to the secondary transfer roller 63, so that the toner image is moved and transferred to the sheet S. In FIG. 45, a cleaning roller 17 cleans the back surface of the belt by coming into rolling contact with the back surface of the belt.

To increase a conveying force that is applied to the intermediate transfer belt 53 by the driving roller 55, a conductive metal roller is used as a cylindrical conductive base member 55A (see FIG. 46) and the surface of the conductive metal roller is coated with a rubber material having a gripping property. A portion of secondary transfer current, which is generated by a bias applied to the secondary transfer roller 63, flows to the ground through the sheet S and the intermediate transfer belt 53. In order to allow the current, which flows from the secondary transfer roller 63, to flow to the ground through the above-mentioned path, carbon, titanium, or the like is incorporated in a coating layer 55B (see FIG. 46) of the driving roller 55 so that the volume resistivity of the coating layer is controlled in the range of $1.0\times10^4$ to $10^8$ Ωcm.

As described above, part of the surface of the driving roller 55 is coated with a conductive material different from a material of the metal roller.

However, filming occurs on the surface of the driving roller 55 in the late stage of the durable period of the intermediate transfer belt unit 15 due to the ingredients of the intermediate transfer belt 53, foreign materials entering the inside of the belt, toner, and the like. As a result, resistance is increased. If a secondary transfer bias is repeatedly applied under this condition, the coating layer 55B of the driving roller 55 is charged and abnormal discharge occurs with time. As a result, discharge marks remain on the image. Further, a current at the time of discharge flows back to a high-voltage power source of the secondary transfer roller 63, so that abnormality may occur on a high-voltage base. This problem of abnormal discharge tends to be significantly generated during the well-known control for discharging toner attached to the surface of the secondary transfer roller 63 to the intermediate transfer belt 53 by alternately applying positive and negative biases to the secondary transfer roller 63.

Figure 46:
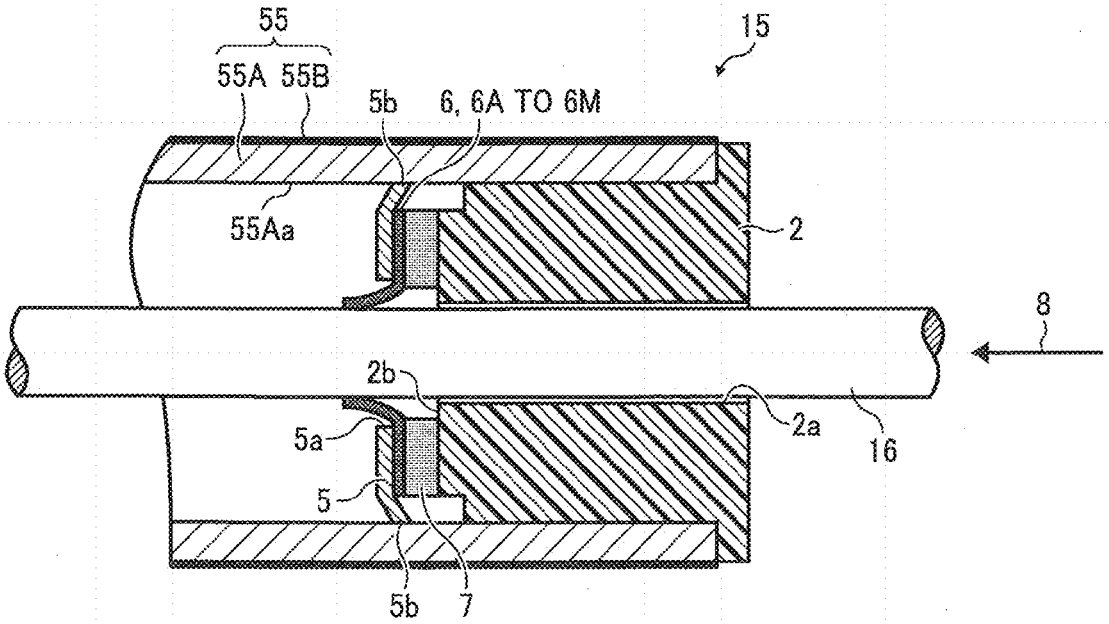
FIG. 46 is a cross-sectional view of one end portion of the intermediate transfer belt unit of the second embodiment taken along a longitudinal (axial) direction.

Accordingly, in order to solve the above-mentioned problem, the intermediate transfer belt unit 15 of FIG. 46 to which a mechanism for electrifying (grounding) a rotator according to the embodiment is applied has been employed in the driving roller 55. A static eliminating cloth as well as a conductive sheet may be used. From experiments or the like, it is found that if a material having a volume resistivity of $1.0\times10^5$ Ωcm or less is selected as a material of the static eliminating cloth, the backflow of current to the high-voltage base and abnormality of the high-voltage base do not occur even though the above-mentioned positive and negative biases are alternately applied to the secondary transfer roller 63.

The second embodiment is mainly different from the first embodiment in that the intermediate transfer belt unit 15 shown in FIGS. 45 and 46 is used in addition to the image carrier unit 10 shown in FIG. 2 and the like. The second embodiment is the same as the color image forming apparatus 50 of the first embodiment except for this difference. Meanwhile, for simplicity of the drawings, the intermediate transfer belt 53 and the like will not be shown and only main parts will be shown in the intermediate transfer belt unit 15 shown in FIG. 46 and an intermediate transfer belt unit 15A shown in FIG. 47 to be described below. The particular structure and the like of the second embodiment will be described below with reference to the above-mentioned difference.

In the intermediate transfer belt unit 15 shown in FIG. 45 to which this embodiment is applied, at least the driving roller 55 between the driving and driven rollers 55 and 56 is a hollow rotary member that includes the coating layer 55B on the cylindrical conductive base member 55A. In this embodiment, both the driving and driven rollers 55 and 56 may be the hollow rotary member. However, for simplicity of the description, the driving roller 55 will be described on behalf of the rollers.

As shown in detail in FIGS. 45 and 46, the intermediate transfer belt unit 15 includes the driving roller 55 as the hollow rotary member; a flange 2 that is fixed to at least one end portion of the driving roller 55; a conductive shaft 16 which passes through the hole 2*a* formed at the central portion of the flange 2 and is made of a metal and by which the driving roller 55 is rotatably supported; and the same conductive cloth 6 and pressing member 7 as those of the first embodiment. The intermediate transfer belt unit includes the grounding plate 5. The grounding plate allows the conductive cloth 6 to be bent in an insertion direction 8 and come into contact with the shaft 16 when the shaft 16 passes through the conductive cloth 6 in the insertion direction 8; and includes a flat plate portion that comes into contact with the conductive cloth 6 and is mounted on the flange 2 and a pair of pressure contact portions 5*b* that is pressed and fixed to the conductive base member 55A of the driving roller 55. The conductive base member 55A of the driving roller 55 and the shaft 16 are electrically connected to each other through the contact between the grounding plate and the conductive cloth 6.

The pressure contact portions 5*b* of the grounding plate 5 are fixed to an inner wall 55Aa of the conductive base member 55A of the driving roller 55 as described above, so that the pressure contact portions are electrically connected to the conductive base member 55A, and part of the conductive cloth 6 comes into contact with and are electrically connected to the flat plate portion 5*p* of the grounding plate 5. Accordingly, the flat plate portion 5*p* (base end portion) of the grounding plate 5 corresponds to an object to be electrified, and the coating layer 55B of the driving roller 55 corresponds to an object to be electrified. Therefore, in this embodiment, part of the conductive cloth comes into contact with the flat plate portion 5*p* of the grounding plate 5 that is an object to be grounded, and the other part of the conductive cloth 6 is bent to come into contact with the shaft as a contact member.

A gear (not shown), to which a rotational driving force is transmitted from a driving motor (not shown) having the structure similar to the structure of the image carrier unit 10 shown in FIGS. 3 and 4, is fixed to the other end portion (a left end portion in FIG. 46) of the driving roller 55. Accordingly, the driving roller 55 is driven so as to be rotated about the shaft 16. The shaft 16 is supported by a pair of side plates (not shown) of the intermediate transfer belt unit that is disposed on both sides of the intermediate transfer belt 53. The side plates of the intermediate transfer belt unit are fixed to a metal sheet (not shown). The metal sheet is made of, for example, stainless steel and mounted on the main body frame 51 shown in FIG. 1 and electrically grounded. Accordingly, the end portions of the conductive shaft 16 are electrically connected to the side plates of the intermediate transfer belt unit, so that the shaft 16 is grounded. As described above, the side plates of the intermediate transfer belt unit that are electrically connected to the metal sheet (not shown), which is mounted on the main body frame 51 and electrically grounded, form an electrical connection unit for electrically grounding the shaft 16.

The conductive cloth 6 of this embodiment includes cuts through which the shaft 16 instead of the shaft 4 of the first embodiment passes, and comes into contact with the grounding plate 5 and with the conductive cloth 6 at portions other than the cuts. That is, in this embodiment, as shown in FIG. 46, the profile shape of the outer periphery of the conductive cloth 6 is formed to be larger than the diameter of the through hole 5*a*. Accordingly, the conductive cloth comes into contact with the grounding plate in a region where the conductive cloth overlaps the flat plate portion 5*p* of the grounding plate 5. Therefore, the grounding plate 5 and the conductive cloth 6 are electrically connected to each other.

In FIG. 46, a method of assembling a driving roller unit, which forms the intermediate transfer belt unit 15, may be easily understood and performed by substituting the "image carrier 1" of the first embodiment with the "driving roller 55", substituting the "inner wall 1Aa of the conductive base member 1A" with the "inner wall 55Aa of the conductive base member 55A", and substituting the "shaft 4" with the "shaft 16". Accordingly, the method of assembling a driving roller unit will not be partially detailed in the description.

Further, when the grounding plate 5, the conductive cloth 6, and the pressing member 7 are fixed to the flange 2 and the flange 2 is press-fitted into the driving roller 55, the conductive base member 55A and the grounding plate 5 come into contact with each other, the grounding plate 5 and the conductive cloth 6 come into contact with each other, and the conductive cloth 6 and the shaft 16 come into contact with each other. As a result, the conductive base member 55A and the shaft 16 may be finally electrically connected to each other. In this case, as a method of making the grounding plate 5 come into contact with the conductive cloth 6, the pressing member 7 is disposed between the flange 2 and the conductive cloth 6 and the conductive cloth 6 and the pressing member 7 are pressed by the grounding plate 5, so that the pressing member 7 is elastically deformed so as to be compressed and the conductive cloth 6 may more reliably come into contact with the grounding plate 5. Therefore, electrical connection is stably secured with time.

When a rotational driving force of the driving motor is transmitted to the gear (not shown) that meshes with a driving force transmitting member such as a gear train connected to a driving unit (not shown) in FIG. 45, the driving roller 55 is rotationally driven in the direction of an arrow shown in FIG. 45. Accordingly, the grounding plate 5 is also rotated together with the flange 2, the conductive cloth 6, and the pressing member 7 in the direction of the arrow shown in FIG. 45, and the bent portions of the conductive cloth 6 are rotated while sliding on and coming into contact with the outer peripheral surface of the shaft 16. In this case, since the conductive cloth 6 has conductivity and appropriate lubricity, it may be possible to secure stable electrical connection with time without the generation of abnormal sound and oxidation even though the conductive cloth comes in contact with the shaft 16 that is a sliding object. Further, since a conductive lubricant for reducing sliding resistance (for example, conductive grease or the like) does not need to be applied when metals slide on each other, it may also be possible to reduce a load imposed on environmental. Therefore, it may be possible to form and provide the environment-friendly intermediate transfer belt unit 15 and the color image forming apparatus 50 shown in FIG. 1.

As for the contact between the conductive cloth 6 and the shaft 4, it may be possible to obtain appropriate contact pressure between the conductive cloth and the shaft 4 since the conductive cloth 6 itself is bent. Further, as for the shape of the conductive cloth, it may be possible to obtain the above-mentioned performance by the simple shape that is formed by a very simple work of forming the cuts in the conductive cloth 6. The conductive cloth 6 contains metal therein. However, since the metal is not a main material, generation of abnormal sound and poor electrical connection originating from oxidation, which are problems in the related technology, does not occur.

The intermediate transfer belt unit 15 is not limited thereto. When advantages and effects obtained by the pressing member 7 are not desired to that extent, the pressing member 7 may be removed from the intermediate transfer belt unit 15. That is, referring to FIG. 46, the pressing member 7 may be removed from the structure shown in FIG. 46 and the grounding plate 5 may be fixed and held on the mounting surface 2*b* of the flange 2 with only the conductive cloth 6 interposed therebetween.

Moreover, the second embodiment is not limited to an example using the conductive cloth 6, and any one of the conductive cloth 6, which is shown in FIGS. 46, and 6A to 6M, which are denoted in FIG. 46, may be used. In such case, there is no doubt that the above-mentioned advantages and effects are obtained.

Sixteenth Modification of Second Embodiment

Figure 47:
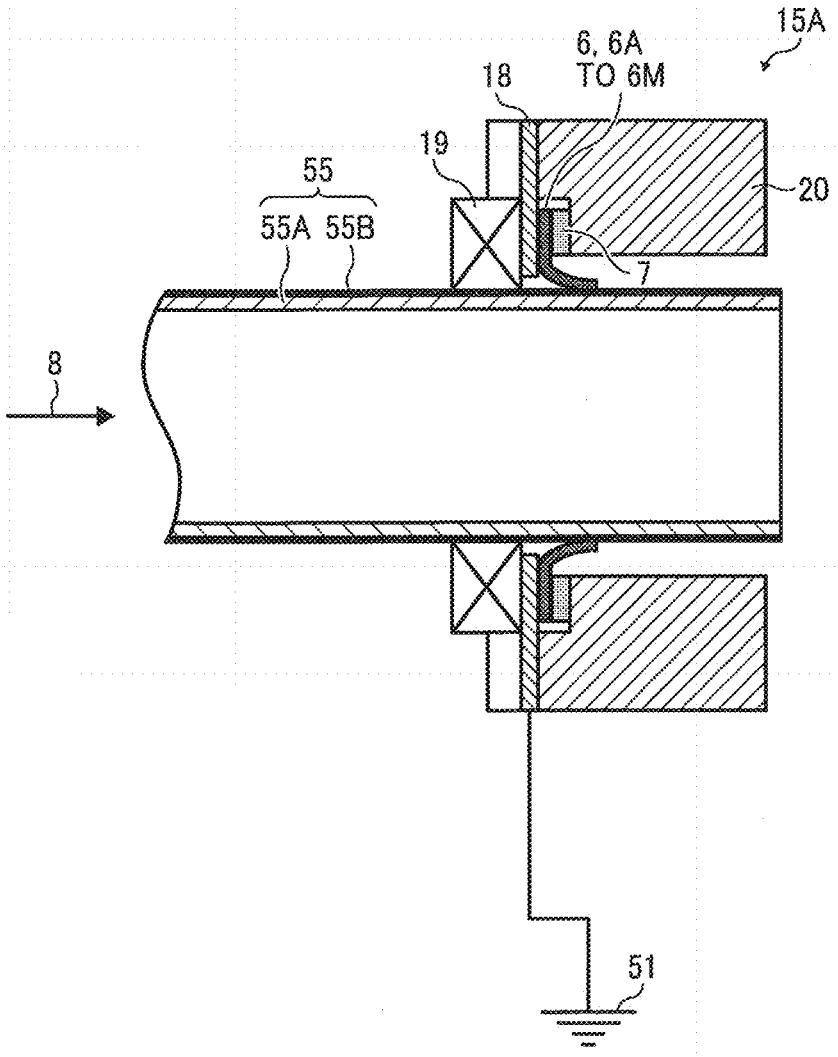
FIG. 47 is a cross-sectional view of one end portion of an intermediate transfer belt unit of a sixteenth modification taken along a longitudinal (axial) direction.

A sixteenth modification of the second embodiment will be described with reference to FIG. 47. The sixteenth modification is mainly different from the second embodiment shown in FIGS. 45 and 46 in that the intermediate transfer belt unit 15A shown in FIG. 47 is used instead of the intermediate transfer belt unit 15 shown in FIG. 46. The sixteenth modification is the same as the second embodiment except for this difference.

When the driving roller 55 as at least one of the driving roller 55 (hereinafter, a "driving roller 55, which is a hollow rotary member," will be described on behalf of rollers like in the second embodiment) as a driving rotary member and the driven roller 56 as a driven rotary member passes through the conductive cloth 6, the conductive cloth 6 is bent and comes into contact with the surface of the driving roller 55 and the driving roller 55 and a stay 18 as an object to be grounded are electrically connected to each other by the conductive cloth 6 in the intermediate transfer belt unit 15A as shown in detail in FIGS. 45 and 47.

One end portion (a right end portion in FIG. 47) and the other end portion (a left end portion in FIG. 47) of the driving roller 55 are rotatably supported by bearings 19 such as rolling bearings. Each of the bearings 19 is mounted and fixed to a unit frame 20 that is detachably mounted on the main body frame 51 shown in FIG. 47. A general/all-purpose bearing, which is not specifically formed, that is, does not have conductivity or is not supplied with conductive grease employed in the mechanism for electrifying, e.g., grounding, a rotator in the related technology, may be used as each of the bearings 19. The stay 18 is formed of a material, which is excellent in conductivity, for example, a metal sheet such as a steel plate.

The conductive cloth 6 includes cuts through which the driving roller 55 instead of the shaft 16 of the second embodiment may pass, and comes into contact with the stay 18 and the conductive cloth 6 at portions other than the cuts.

As a method of making the stay 18 come into contact with the conductive cloth 6, the pressing member 7 is disposed between the unit frame 20 and the conductive cloth 6 and the conductive cloth 6 and the pressing member 7 are pressed by the stay 18, so that the elastic material of the pressing member 7 is compressed. Accordingly, the conductive cloth 6 may stably come into contact with the stay 18. Therefore, electrical connection is stably secured with time. The bearing 19, the stay 18, the conductive cloth 6, the pressing member 7, and the unit frame 20 are assembled in this order from the left side to the right side as shown in FIG. 47, so that a sub-unit (sub-assembly) of the intermediate transfer belt unit 15A is formed. In the sub-unit of the intermediate transfer belt unit 15A, the stay 18 and the conductive cloth 6 come into contact with each other in overlapping regions other than the cuts of the conductive cloth 6. Accordingly, the stay 18 and the conductive cloth 6 are electrically connected to each other.

When the driving roller 55 is inserted in the insertion direction 8 as shown in FIG. 47, the driving roller 55 passes through the cuts formed at the conductive cloth 6 of the sub-unit of the intermediate transfer belt unit 15A and the conductive cloth 6 is bent and comes into contact with the driving roller 55. In this case, since the stay 18 and the conductive cloth 6 are fixed and interposed between the bearing 19 and the unit frame 20, the driving roller 55, the conductive cloth 6, and the stay 18 come into contact with each other. Accordingly, the driving roller 55 and the stay 18 may be electrically connected to each other and the intermediate transfer belt unit 15A is formed. When the intermediate transfer belt unit is mounted on the main body frame 51 in FIG. 47, the intermediate transfer belt unit 15A comes into contact with an electrical connection portion (not shown) of the main body frame 51, so that electrical connection is maintained. Since the surface of the driving roller 55 and the electrical connection portion of the main body frame 51 are electrically connected to each other and the main body frame 51 is electrified or grounded as described above, the driving roller 55 may be grounded.

A gear (not shown), to which a rotational driving force is transmitted from a driving motor (not shown) having the structure similar to the structure of the image carrier unit 10 shown in FIGS. 3 and 4, is fixed to the other end portion (a left end portion in FIG. 47) of the driving roller 55. Accordingly, the driving roller 55 is rotationally driven while it is supported by the respective bearings 19.

When a rotational driving force of a driving unit (not shown) is transmitted to the gear that meshes with a driving force transmitting member such as a gear train connected to the driving unit in FIG. 47, the driving roller 55 is rotated in the direction of the arrow shown in FIG. 45 and the bent portions of the conductive cloth 6 are rotated while sliding on and coming into contact with the outer peripheral surface of the driving roller 55. In this case, since the conductive cloth 6 has conductivity and appropriate lubricity, it may be possible to secure stable electrical connection with time without generation of abnormal sound and occurrence of oxidation even though the conductive cloth comes in contact with the driving roller 55 that is a sliding object. Further, since a conductive lubricant for reducing sliding resistance (for example, conductive grease or the like) does not need to be applied when metals slide on each other, it may also be possible to reduce a load imposed on environment. Therefore, it may be possible to form and provide the environment-friendly intermediate transfer belt unit 15A and the color image forming apparatus 50 shown in FIG. 1.

As for the contact between the conductive cloth 6 and the driving roller 55, it may be possible to obtain appropriate contact pressure between the conductive cloth and the driving roller 55 since the conductive cloth 6 itself is bent. Further, as for the shape of the conductive cloth, it may be possible to obtain the above-mentioned performance by the simple shape that is formed by a very simple work of forming the cuts at the conductive cloth 6. The conductive cloth 6 contains metal. However, since the metal is not a main material, generation of abnormal sound and poor electrical connection originating from oxidation, which are problems in the related technology, do not occur.

The intermediate transfer belt unit 15A is not limited thereto. When advantages and effects obtained due to the pressing member 7 are not desired to that extent, the pressing member 7 may be removed from the intermediate transfer belt unit 15A. Moreover, the sixteenth modification is not limited to an example using the same conductive cloth 6 as the conductive cloth of the second embodiment, and any one of the conductive cloth 6, which is shown in FIG. 47) and 6A to 6M, which are denoted in FIG. 47, may be used. In this case, there is no doubt that the above-mentioned advantages and effects are obtained.

In the second embodiment and the sixteenth modification, each of the intermediate transfer belt units 15 and 15A, which is disposed in the intermediate transfer belt device including an intermediate transfer belt as an intermediate transfer body, has been exemplified as a belt unit. The belt unit is not limited thereto. It goes without saying that the belt unit may be a belt unit provided in any one of an image carrier belt device that includes an image carrier belt including any one of an electrophotographic photoreceptor layer, an electrostatic recording dielectric layer, and a magnetic recording magnetic layer (for example, a photoreceptor belt including an electrophotographic photoreceptor layer) and a transfer conveying belt device including a transfer conveying belt as a transfer conveying body, or may an image forming apparatus including any one of them.

Third Embodiment

Figure 48:
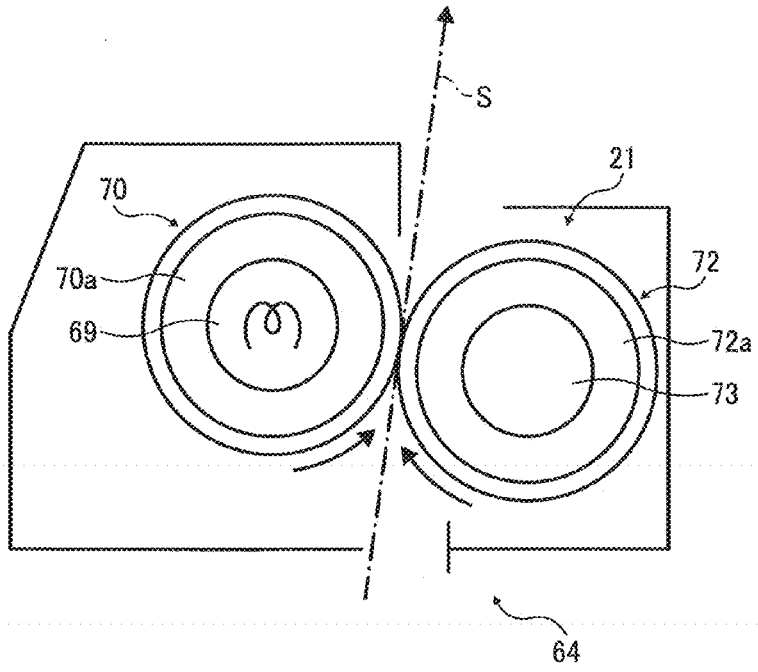
FIG. 48 is a schematic front view of a fixing device of a third embodiment.

A fixing unit according to a third embodiment will be described with reference to FIGS. 48 and 49. The fixing device 64 shown in FIG. 1 will be additionally described first with reference to FIG. 48. FIG. 48 is an enlarged front view of a main part of the fixing device 64 of FIG. 1 to which this embodiment has been applied.

In FIG. 48, the fixing device 64 includes a heating roller 70 as a heating member and a pressurizing roller 72 as a pressurizing member. The heating roller 70 includes a heater 69 as a heat source and a rubber layer 70*a* as an elastic layer. The pressurizing roller 72 forms a nip portion by coming into press contact with the heating roller 70. The fixing device includes a well-known structure that conveys a sheet S on which an unfixed toner image is formed, makes the sheet pass through the nip portion, and fixes the unfixed toner image to the sheet S.

The pressurizing roller 72 includes a rubber layer 72*a* as an elastic layer that is formed on the outer periphery of a conductive core shaft 73, which is made of metal, as a rotating shaft. Usually, the heating roller 70 is a driving rotary member that is rotationally driven by a driving unit (not shown), and the pressurizing roller 72 is a driven rotary member that is rotated while coming into press contact with the heating roller 70.

Figure 49:
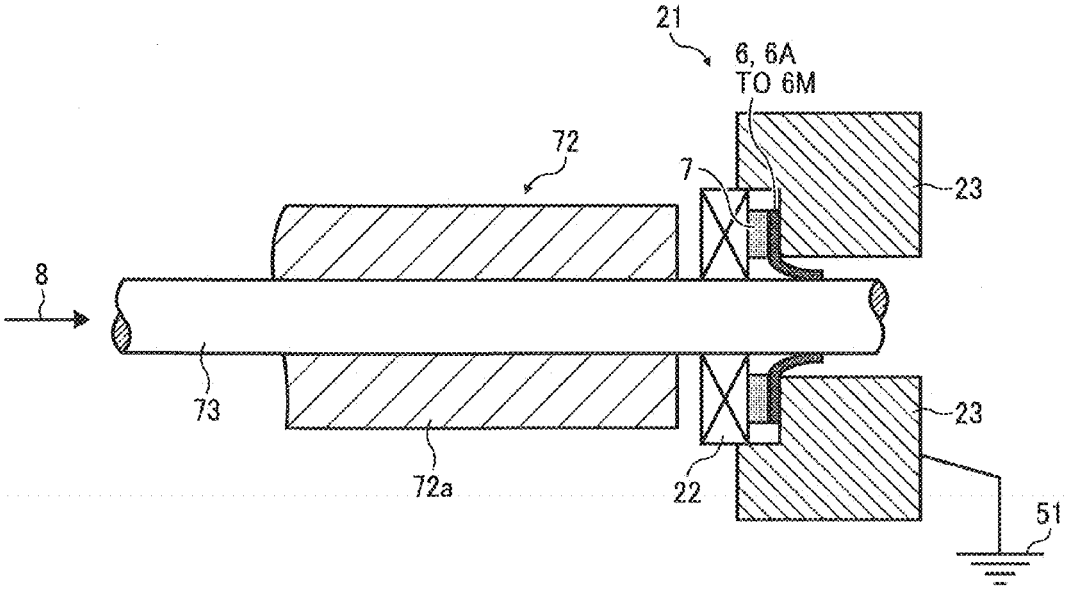
FIG. 49 is a cross-sectional view of one end portion of the fixing unit of the third embodiment taken along a longitudinal (axial) direction.

The third embodiment is mainly different from the first embodiment in that a fixing unit 21 shown in FIGS. 48 and 49 is used in addition to the image carrier unit 10 shown in FIG. 2 and the like. The third embodiment is the same as the color image forming apparatus 50 of the first embodiment except for this difference.

When the core shaft 73 of the pressurizing roller 72 as at least one of the heating roller 70 and the pressurizing roller 72 (hereinafter, the "pressurizing roller 72" will be described on behalf of rollers) passes through the conductive cloth 6, the conductive cloth 6 is bent and comes into contact with the core shaft 73 and the core shaft 73 and a support frame 23 as an object to be electrified are electrically connected to each other by the conductive cloth 6 in the fixing unit 21 as shown in FIG. 49.

One end portion (a right end portion in FIG. 49) and the other end portion (a left end portion in FIG. 49) of the core shaft 73 of the pressurizing roller 72 are rotatably supported by bearings 22. Each of the bearings 22 is mounted and fixed to the support frame 23 that is detachably mounted on the main body frame 51 shown in FIG. 49. The support frame 23 is formed of a material, which is excellent in conductivity, for example, a metal sheet such as a steel plate. A general/all-purpose bearing, which is not specifically formed, that is, does not have conductivity or is not supplied with conductive grease employed in the mechanism for electrifying, e.g., grounding, a rotator in the related technology, may be used as each of the bearings 22.

The conductive cloth 6 includes cuts through which the core shaft 73 of the pressurizing roller 72 instead of the shaft 4 of the first embodiment may pass, and comes into contact with the support frame 23 and the conductive cloth 6 at portions other than the cuts.

As a method of making the support frame 23 come into contact with the conductive cloth 6, the pressing member 7 is disposed between the bearing 22 and the conductive cloth 6 and the conductive cloth 6 and the pressing member 7 are pressed by the support frame 23, so that the elastic material of the pressing member 7 is compressed. Accordingly, the conductive cloth 6 may stably come into contact with the support frame 23. Therefore, electrical connection is stably secured with time. The bearing 22, the pressing member 7, the conductive cloth 6, and the support frame 23 are assembled in this order from the left side to the right side as shown in FIG. 49, so that a sub-unit (sub-assembly) of the fixing unit 21 is formed. In the sub-unit of the fixing unit 21, the support frame 23 and the conductive cloth 6 come into contact with each other in overlapping regions other than the cuts of the conductive cloth 6. Accordingly, the support frame 23 and the conductive cloth 6 are electrically connected to each other.

When the core shaft 73 of the pressurizing roller 72 is inserted in the insertion direction 8 as shown in FIG. 49, the core shaft 73 passes through the cuts formed at the conductive cloth 6 of the sub-unit of the fixing unit 21 and the conductive cloth 6 comes into contact with the core shaft 73 of the pressurizing roller 72 while being bent. In this case, since the support frame 23 and the conductive cloth 6 are fixed and interposed between the bearing 22 and the support frame 23, the core shaft 73, the conductive cloth 6, and the support frame 23 come into contact with each other. Accordingly, the core shaft 73 and the support frame 23 may be electrically connected to each other and the fixing unit 21 is formed. When the fixing unit 21 is mounted on the main body frame 51 in FIG. 49, the support frame 23 comes into contact with an electrical connection portion (not shown) of the main body frame 51, so that electrical connection is maintained. Since the surface of the core shaft 73 of the pressurizing roller 72 and the electrical connection portion of the main body frame 51 are electrically connected to each other and the main body frame 51 is grounded as described above, the core shaft 73 of the pressurizing roller 72 may be electrified or grounded.

A gear (not shown), to which a rotational driving force is transmitted from a driving motor (not shown) having the structure similar to the structure of the image carrier unit 10 shown in FIGS. 3 and 4, is fixed to the other end portion (a left end portion in FIG. 49) of the core shaft 73 of the pressurizing roller 72 and the core shaft 73 of the pressurizing roller 72 is supported by the respective bearings 22 and rotationally driven. The core shaft 73 of the pressurizing roller 72 is rotated in the direction of an arrow shown in FIG. 48, and the bent portions of the conductive cloth 6 are rotated while sliding on and coming into contact with the outer peripheral surface of the core shaft 73 of the pressurizing roller 72. In this case, since the conductive cloth 6 has conductivity and appropriate lubricity, it may be possible to secure stable electrical connection with time without generation of abnormal sound and occurrence oxidation even though the conductive cloth comes in contact with the core shaft 73 that is a sliding object. Further, since a conductive lubricant for reducing sliding resistance (for example, conductive grease or the like) does not need to be applied when metals slide on each other, it may also be possible to reduce a load imposed on environment. Therefore, it may be possible to form and provide the environment-friendly fixing unit 21 and the color image forming apparatus 50 shown in FIG. 1.

As for the contact between the conductive cloth 6 and the core shaft 73, it may be possible to obtain appropriate contact pressure between the conductive cloth and the core shaft 73 since the conductive cloth 6 itself is bent. Further, as for the shape of the conductive cloth, it may be possible to obtain the above-mentioned performance by the simple shape that is formed by a very simple work of forming the cuts in the conductive cloth 6. The conductive cloth 6 contains metal. However, since the metal is not a main material, generation of abnormal sound and poor electrical connection originating from oxidation, which are problems in the related technology, do not occur.

The fixing unit 21 is not limited thereto. When advantages and effects obtained by the pressing member 7 are not desired to that extent, the pressing member 7 may be removed from the fixing unit 21 like in the second embodiment. Moreover, the third embodiment is not limited to an example using the same conductive cloth 6 as the conductive cloth of the second embodiment, and any one of the conductive cloth 6, which is shown in FIGS. 49, and 6A to 6M, which are denoted in FIG. 49, may be applied. In this case, there is no doubt that the above-mentioned advantages and effects are obtained.

Seventeenth Modification of Third Embodiment

Figure 50:
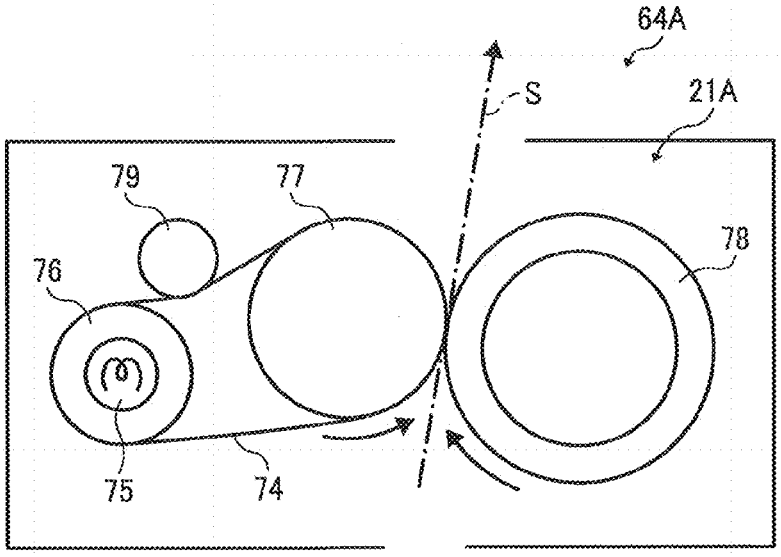
FIG. 50 is a schematic front view of a fixing device of a seventeenth modification.

A fixing unit according to a seventeenth modification of the third embodiment will be described with reference to FIGS. 50 and 51. FIG. 50 is a front view of a fixing device 64A using a fixing belt, and FIG. 51 is an enlarged cross-sectional view of main parts of the fixing device 64A to which this embodiment has been applied.

Figure 51:
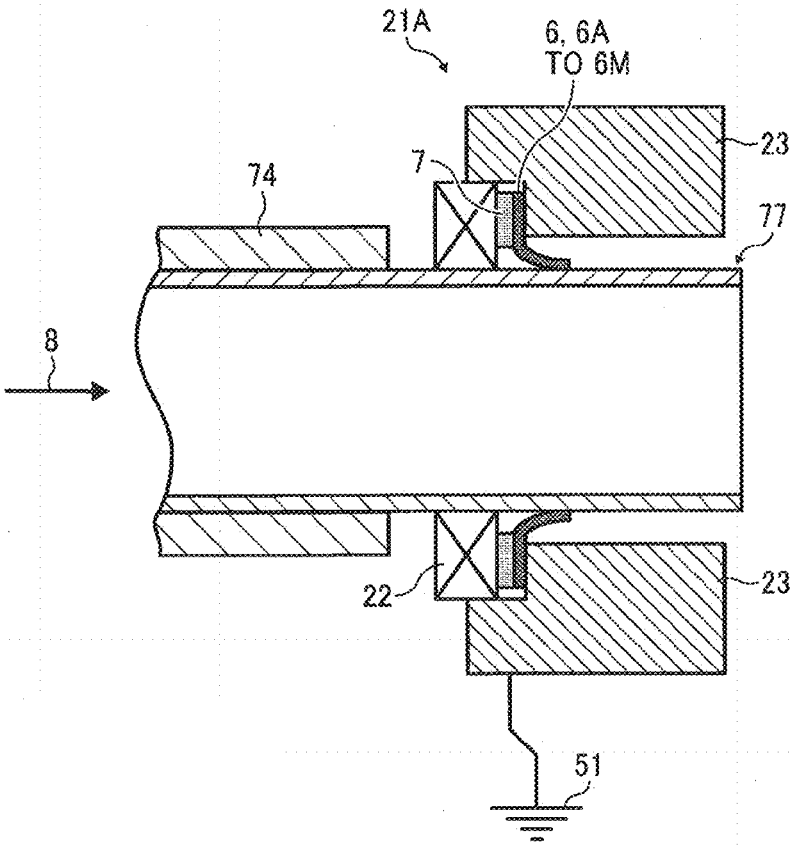
FIG. 51 is a cross-sectional view of one end portion of the fixing unit of the seventeenth modification taken along a longitudinal (axial) direction.

The seventeenth modification of the third embodiment is mainly different from the third embodiment shown in FIGS. 48 and 49 in that the fixing device 64A is used instead of the fixing device 64 and a fixing unit 21A is used instead of the fixing unit 21 as shown in FIGS. 50 and 51.

In FIG. 50, the fixing device 64A includes an endless fixing belt 74, a heating roller 76 as a heating member in which a heater 75 as a heat source is built, a fixing roller 77 as a fixing member that stretches the fixing belt 74 together with the heating roller 76, a pressurizing roller 78 as a pressurizing member that forms a nip portion by coming into press contact with the fixing roller 77, and a tension roller 79 that applies predetermined tension to the fixing belt by coming into press contact with the fixing belt 74. The fixing device includes a well-known structure that conveys a sheet S on which an unfixed toner image is formed, makes the sheet pass through the nip portion, and fixes the unfixed toner image to the sheet S. In this embodiment, for example, the fixing roller 77 is formed of a hollow roller as a hollow rotary member that is made of a conductive metal.

As shown in FIG. 51, the fixing unit 21A includes at least one of a heating roller 76, the fixing roller 77, and a pressurizing roller 78 (hereinafter, the "fixing roller 77" will be described on behalf of rollers). The fixing roller as a hollow roller passes through the conductive cloth 6, the conductive cloth is bent and comes into contact with the fixing roller 77. So the fixing roller 77 and the support frame 23 as an object to be electrified are electrically connected to each other by the conductive cloth 6 in the fixing unit 21A as shown in FIG. 51.

One end portion (a right end portion in FIG. 51) and the other end portion (a left end portion in FIG. 51) of the fixing roller 77 are rotatably supported by bearings 22 like in the third embodiment. The conductive cloth 6 includes cuts through which the fixing roller 77 instead of the core shaft 73 of the third embodiment may pass, and comes into contact with the support frame 23 and the conductive cloth 6 at portions other than the cuts.

A method of making the support frame 23 come into contact with the conductive cloth 6 is the same as that of the third embodiment. The conductive cloth 6 and the pressing member 7 are pressed by the support frame 23, so that the elastic material of the pressing member 7 is compressed. Accordingly, the conductive cloth 6 may stably come into contact with the support frame 23. Therefore, electrical connection is stably secured with time. The bearing 22, the pressing member 7, the conductive cloth 6, and the support frame 23 are assembled in this order from the left side to the right side as shown in FIG. 51, so that a sub-unit (sub-assembly) of the fixing unit 21A is formed. In the sub-unit of the fixing unit 21A, the support frame 23 and the conductive cloth 6 come into contact with each other in overlapping regions other than the cuts of the conductive cloth 6. Accordingly, the support frame 23 and the conductive cloth 6 are electrically connected to each other.

When the fixing roller 77 is inserted in the insertion direction 8 as shown in FIG. 51, the fixing roller 77 passes through the cuts formed at the conductive cloth 6 of the sub-unit of the fixing unit 21A and the conductive cloth 6 is bent and comes into contact with the fixing roller 77. In this case, since the support frame 23 and the conductive cloth 6 are fixed and interposed between the bearing 22 and the support frame 23, the fixing roller 77, the conductive cloth 6, and the support frame 23 come into contact with one another. Accordingly, the fixing roller 77 and the support frame 23 may be electrically connected to each other and the fixing unit 21A is formed. When the fixing unit 21A is mounted on the main body frame 51 in FIG. 51, the support frame 23 comes into contact with an electrical connection portion (not shown) of the main body frame 51, so that electrical connection is maintained. Since the surface of the fixing roller 77 and the electrical connection portion of the main body frame 51 are electrically connected to each other and the main body frame 51 is electrified or grounded as described above, the fixing roller 77 may be grounded.

The other end portion (a left end portion in FIG. 51) of the fixing roller 77 is configured to receive a rotational driving force from a driving unit (not shown), so that the fixing roller 77 is rotationally driven while being supported by the respective bearings 22. The fixing roller 77 is rotated in the direction of an arrow shown in FIG. 50, and the bent portions of the conductive cloth 6 are rotated while sliding on and coming into contact with the outer peripheral surface of the fixing roller 77. In this case, since the conductive cloth 6 has conductivity and appropriate lubricity, it may be possible to secure stable electrical connection with time without generation of abnormal sound and occurrence of oxidation even though the conductive cloth comes in contact with the fixing roller 77 that is a sliding object. Further, since a conductive lubricant for reducing sliding resistance (for example, conductive grease or the like) does not need to be applied when metals slide on each other, it may also be possible to reduce a load imposed on environment. Therefore, it may be possible to form and provide the environment-friendly fixing unit 21A and the color image forming apparatus 50 shown in FIG. 1.

As for the contact between the conductive cloth 6 and the fixing roller 77, it may be possible to obtain appropriate contact pressure between the conductive cloth and the fixing roller 77 since the conductive cloth 6 itself is bent. Further, as for the shape of the conductive cloth, it may be possible to obtain the above-mentioned performance by the simple shape that is formed by a very simple work of forming the cuts in the conductive cloth 6. The conductive cloth 6 contains metal. However, since the metal is not a main material, poor electrical connection originating from oxidation and generation of abnormal sound, which are problems in the related technology, do not occur.

The fixing unit 21A is not limited thereto. When advantages and effects obtained by the pressing member 7 may not be desired to that extent, the pressing member 7 may be removed from the fixing unit 21A like in the third embodiment. Moreover, the seventeenth modification is not limited to an example using the same conductive cloth 6 as the conductive cloth of the second embodiment, and any one of the conductive cloth 6, which is shown in FIGS. 51, and 6A to 6M, which are denoted in FIG. 51, may be applied. In this case, it goes without saying that the above-mentioned advantages and effects are obtained.

Fourth Embodiment

Figure 52A:
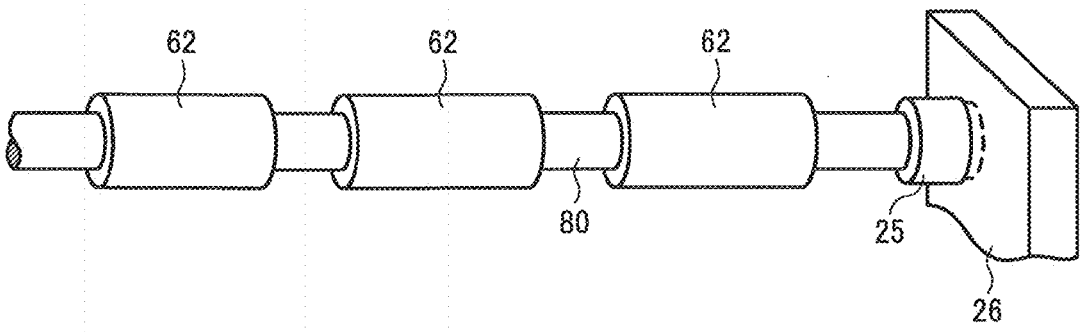
FIG. 52A is a perspective view of main parts of a sheet conveying unit of a fourth embodiment.
Figure 52B:
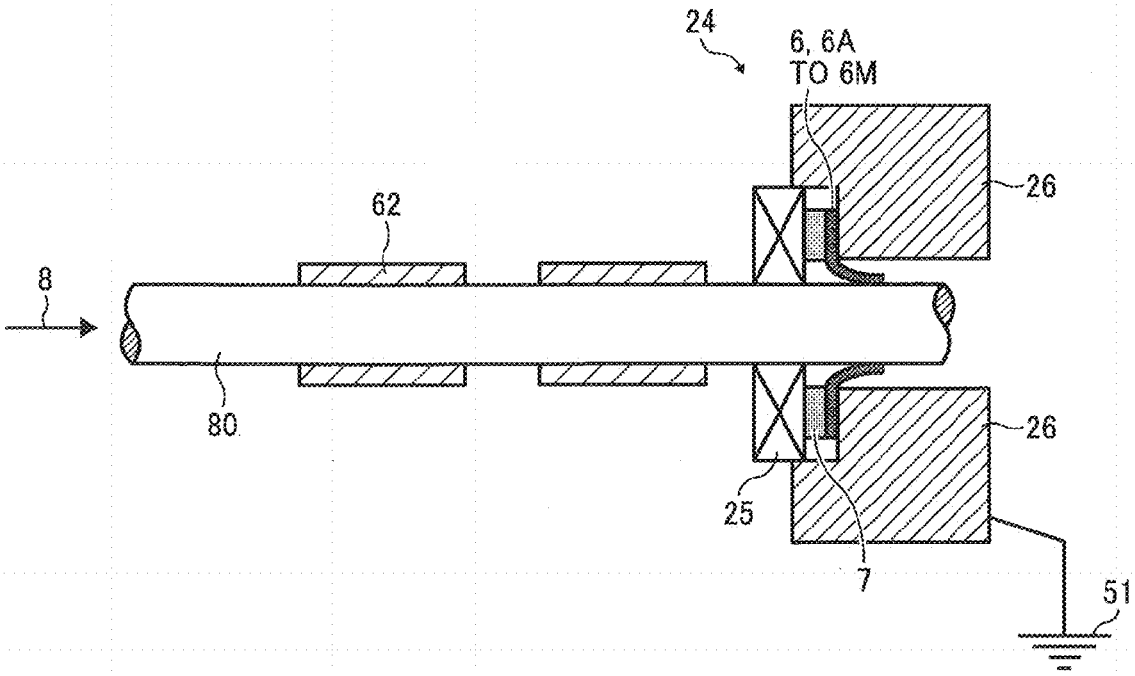
FIG. 52B is a cross-sectional view of one end portion of the sheet conveying unit taken along a longitudinal (axial) direction.

A sheet conveying unit according to a fourth embodiment will be described with reference to FIGS. 52A and 52B. FIG. 52A is a perspective view of a disposition portion where, for example, the resist rollers 62 as sheet conveying members appropriately disposed on a sheet conveying path between the sheet discharge roller 65 and the sheet feed roller 61 of FIG. 1 are disposed. FIG. 52B is an enlarged front view of a main part of the disposition portion, to which this embodiment has been applied, for the resist rollers 62.

In FIG. 52A, each of the resist rollers 62 is made of a material such as rubber, which has a high friction coefficient against a sheet, and is formed in the shape of a skewer around a rotary shaft 80 as a rotating shaft that is made of, for example, a conductive metal. Both end portions of the rotary shaft 80 of the resist roller 62 are rotatably supported by bearings 25 as support members.

The fourth embodiment is mainly different from the first embodiment in that a sheet conveying unit 24 shown in FIG. 52B is used in addition to the image carrier unit 10 shown in FIG. 2 and the like. The fourth embodiment is the same as the color image forming apparatus 50 of the first embodiment except for this difference.

As shown in FIG. 52B, the sheet conveying unit 24 according to this embodiment is rotatably supported by the bearings 25 such as rolling bearings by which the rotary shaft 80 of the resist roller 62 is rotatably supported, and electrifies, e.g., grounds, static electricity that is generated by triboelectric charge between the resist rollers 62 and a sheet. When the rotary shaft 80 passes through the conductive cloth 6, the conductive cloth 6 is bent and comes into contact with the rotary shaft 80 and the rotary shaft 80 and a support frame 26 as an object to be electrified are electrically connected to each other by the conductive cloth 6.

One end portion (a right end portion in FIG. 52B) and the other end portion (a left end portion in FIG. 52B) of the rotary shaft 80 of the resist roller 62 are rotatably supported by the bearings 25. Each of the bearings 25 is mounted and fixed to the support frame 26 that is detachably mounted on the main body frame 51 shown in FIG. 52B. The support frame 26 is formed of a material, which is excellent in conductivity, for example, a metal sheet such as a steel plate. A general/all-purpose bearing, which is not specifically formed, that is, does not have conductivity or is not supplied with conductive grease employed in the mechanism for electrifying, e.g., grounding, a rotator in the related technology, may be used as each of the bearings 25.

The conductive cloth 6 includes cuts through which the rotary shaft 80 of the resist roller 62 instead of the shaft 4 of the first embodiment may pass, and comes into contact with the support frame 26 and the conductive cloth 6 at portions other than the cuts.

As a method of making the support frame 26 come into contact with the conductive cloth 6, the pressing member 7 is disposed between the bearing 25 and the conductive cloth 6 and the conductive cloth 6 and the pressing member 7 are pressed by the support frame 26, so that the elastic material of the pressing member 7 is compressed. Accordingly, the conductive cloth 6 may stably come into contact with the support frame 26. Therefore, electrical connection is stably secured with time. The bearing 25, the pressing member 7, the conductive cloth 6, and the support frame 26 are assembled in this order from the left side to the right side as shown in FIG. 52A, so that a sub-unit (sub-assembly) of the sheet conveying unit 24 is formed. In the sub-unit of the sheet conveying unit 24, the support frame 26 and the conductive cloth 6 come into contact with each other in overlapping regions other than the cuts of the conductive cloth 6. Accordingly, the support frame 26 and the conductive cloth 6 are electrically connected to each other.

When the rotary shaft 80 of the resist roller 62 is inserted in the insertion direction 8 as shown in FIG. 52B, the rotary shaft 80 passes through the cuts formed at the conductive cloth 6 of the sub-unit of the sheet conveying unit 24 and the conductive cloth 6 is bent and comes into contact with the rotary shaft 80 of the resist roller 62. In this case, since the conductive cloth 6 and the pressing member 7 are fixed and interposed between the bearing 25 and the support frame 26, the rotary shaft 80, the conductive cloth 6, and the support frame 26 come into contact with each other. Accordingly, the rotary shaft 80 and the support frame 26 may be electrically connected to each other and the sheet conveying unit 24 is formed. When the sheet conveying unit 24 is mounted on the main body frame 51 in FIG. 52B, the support frame 26 comes into contact with an electrical connection portion (not shown) of the main body frame 51, so that electrical connection is maintained. Since the surface of the rotary shaft 80 of the resist roller 62 and the electrical connection portion of the main body frame 51 are electrically connected to each other and the main body frame 51 is electrified or grounded as described above, the rotary shaft 80 of the resist roller 62 may be grounded.

A gear (not shown), to which a rotational driving force is transmitted from a driving motor (not shown) having the structure similar to the structure of the image carrier unit 10 shown in FIGS. 3 and 4, is fixed to the other end portion (a left end portion in FIG. 52B) of the rotary shaft 80 of the resist roller 62; the rotary shaft 80 of the resist roller 62 is rotated while being supported by the respective bearings 25; and the bent portions of the conductive cloth 6 are rotated while sliding on and coming into contact with the outer peripheral surface of the rotary shaft 80 of the resist roller 62. In this case, since the conductive cloth 6 has conductivity and appropriate lubricity, it may be possible to secure stable electrical connection with time without the generation of abnormal sound and oxidation even though the conductive cloth comes in contact with the rotary shaft 80 that is a sliding object. Further, since a conductive lubricant for reducing sliding resistance (for example, conductive grease or the like) does not need to be applied when metals slide on each other, it may also be possible to reduce a load imposed on environment. Therefore, it may be possible to form and provide the environment-friendly sheet conveying unit 24 and the color image forming apparatus 50 shown in FIG. 1.

As for the contact between the conductive cloth 6 and the rotary shaft 80, it may be possible to obtain appropriate contact pressure between the conductive cloth and the rotary shaft 80 since the conductive cloth 6 itself is bent. Further, as for the shape of the conductive cloth, it may be possible to obtain the above-mentioned performance by the simple shape that is formed by a very simple work of forming the cuts in the conductive cloth 6. The conductive cloth 6 contains metal. However, since the metal is not a main material, generation of abnormal sound and poor electrical connection originating from oxidation, which are problems in the related technology, do not occur.

The sheet conveying unit 24 is not limited thereto. When advantages and effects obtained by the pressing member 7 are not desired to that extent, the pressing member 7 may be removed from the sheet conveying unit 24. Moreover, the fourth embodiment is not limited to an example using the same conductive cloth 6 as the conductive cloth of the first embodiment, and any one of the conductive cloth 6, which is shown in FIG. 52B, and 6A to 6M, which are denoted in FIG. 52B, may be applied. In this case, it goes without saying that the above-mentioned advantages and effects are obtained.

Fifth Embodiment

A sheet conveying unit according to fifth embodiment will be described with reference to FIG. 53. A sheet conveying unit 24Z according to a fifth embodiment shown in FIG. 53 is a principal embodiment of the invention.

The sheet conveying unit 24Z of the fifth embodiment is mainly different from the sheet conveying unit 24 shown in FIG. 52B in that the conductive cloth 6Z without cuts or a cutout portion (through-contact portion) is used instead of the conductive cloth 6 or the conductive cloths 6 and 6A to 6M and the pressing member 7 is removed.

Figure 53:
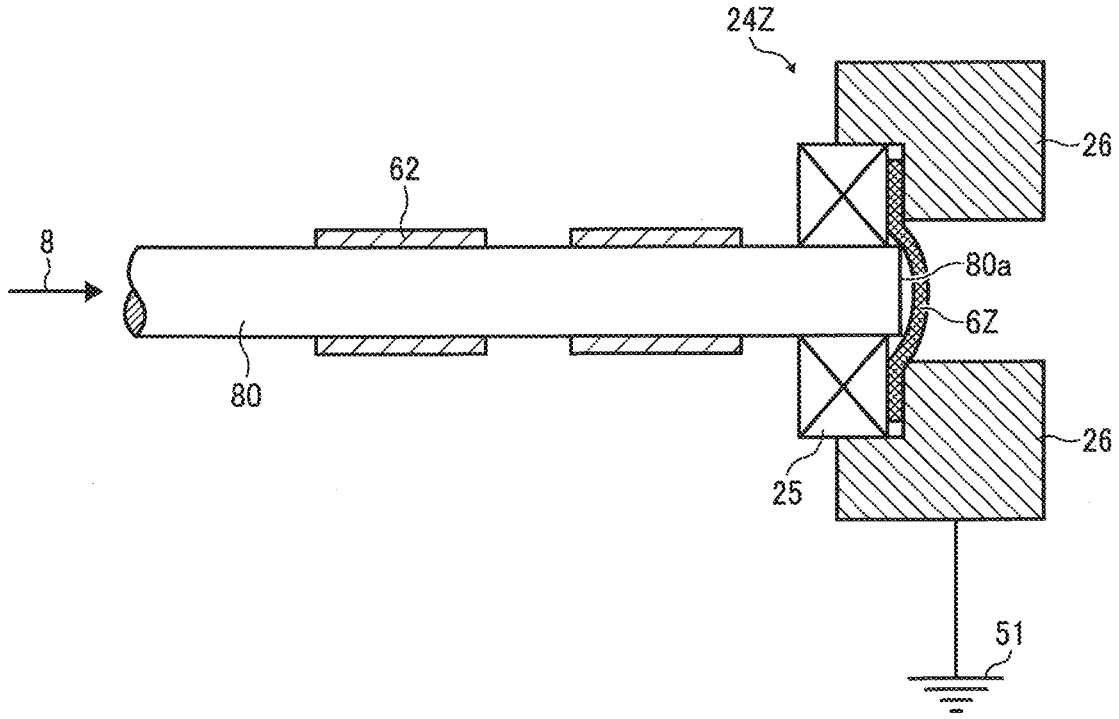
FIG. 53 is a cross-sectional view of one end portion of a sheet conveying unit of a fifth embodiment taken along a longitudinal (axial) direction.

The bearing 25, the conductive cloth 6Z, and a support frame 26 are assembled in this order from the left side to the right side as shown in FIG. 53, so that a sub-unit (sub-assembly) of the sheet conveying unit 24Z is formed. In this case, an end face 80*a* of one end portion of the rotary shaft 80 is pressed against the conductive cloth 6Z without through-contact portions in the insertion direction 8 and bends the conductive cloth, so that the sheet conveying unit 24Z may be formed.

Since this embodiment is as described above, it may be considered that a method of electrifying, e.g., grounding, a rotator according to the invention has been used in this embodiment.

Meanwhile, it may be possible to form the sheet conveying unit 24Z by moving the sub-unit (sub-assembly) of the sheet conveying unit 24Z to the left side from the right side in FIG. 53 while stopping the rotary shaft 80 without moving the rotary shaft, instead of forming the sheet conveying unit 24Z by pressing the end face 80*a* of one end portion of the rotary shaft 80 against the conductive cloth 6Z without through-contact portions in the insertion direction 8 and bending the conductive cloth. That is, the insertion direction 8 is relative (which is the same in the respective embodiments and the respective modifications).

An example using a conductive cloth, which is a cloth-like conductive member, has been described in each embodiment and each modification. However, a conductive sheet, which is a sheet-like conductive member having flexibility, may also be used. It is preferable that a material having a volume resistivity of $1.0\times10^6$ Ωcm or less be selected as a material of the conductive sheet.

Since each of the first to fourth embodiments, the first example, and the first to seventeenth modifications is as described above, it may be considered that a method of electrifying, e.g., grounding a rotator according to the invention has been used in each of the first to fourth embodiments, the first example, and the first to seventeenth modifications.

That is, there is provided a method of electrifying (grounding) a rotator using a cloth-like or sheet-like conductive member that has flexibility and is used in any one of an electrophotographic image forming apparatus, an electrostatic recording image forming apparatus, and a magnetic recording image forming apparatus. When the object to be electrified (grounded) is electrically connected to any one contact member of the rotator, a rotating shaft rotating together with the rotator, and a shaft where the rotator is rotatably supported, through the conductive member, at least one through-contact portion of a cut and a cutout portion, where an end face of the contact member orthogonal to a longitudinal direction of the contact member is inserted and passes and which allows the conductive member to come into contact with the contact member while the conductive member is bent when the end portion passes through the through-contact portion, is previously formed, and the object to be electrified (grounded) and the contact member are electrified or grounded through the conductive member by making the contact member be inserted into and pass through the through-contact portion.

Meanwhile, instead of previous formation of at least one through-contact portion of cuts and a cutout portion, which allow the conductive member to come into contact with the contact member while the conductive member is bent when the end portion passes through the conductive member, at the conductive member, an edge-shaped tool or the like, which can form at least one through-contact portion of cuts and a cutout portion, may be detachable mounted on the end portion of the contact member. This is merely a technique item that is easily deduced from the invention.

Figure 54A:
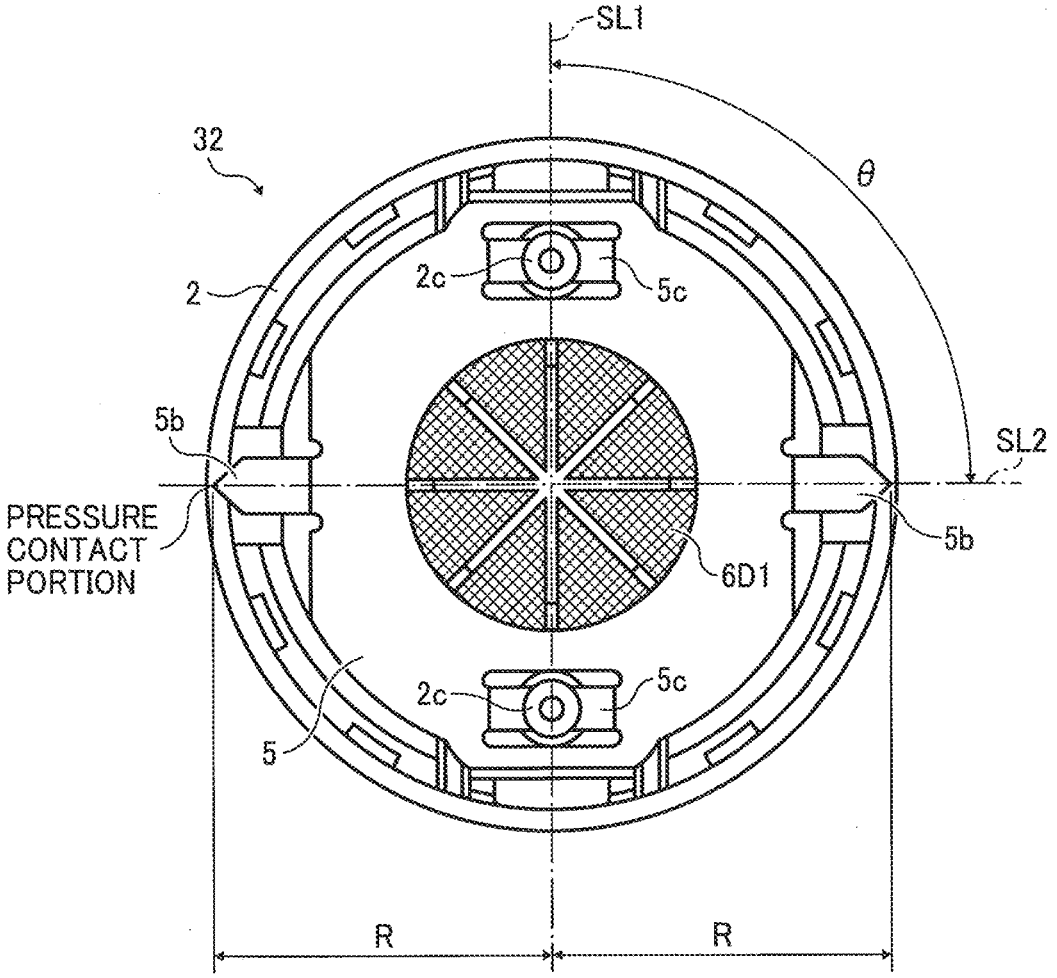
FIG. 54A is a front view illustrating a positional relation between pressure contact portions (claw portions) of the grounding plate and bosses of the flange in the flange assembly of the first example.
Figure 54B:
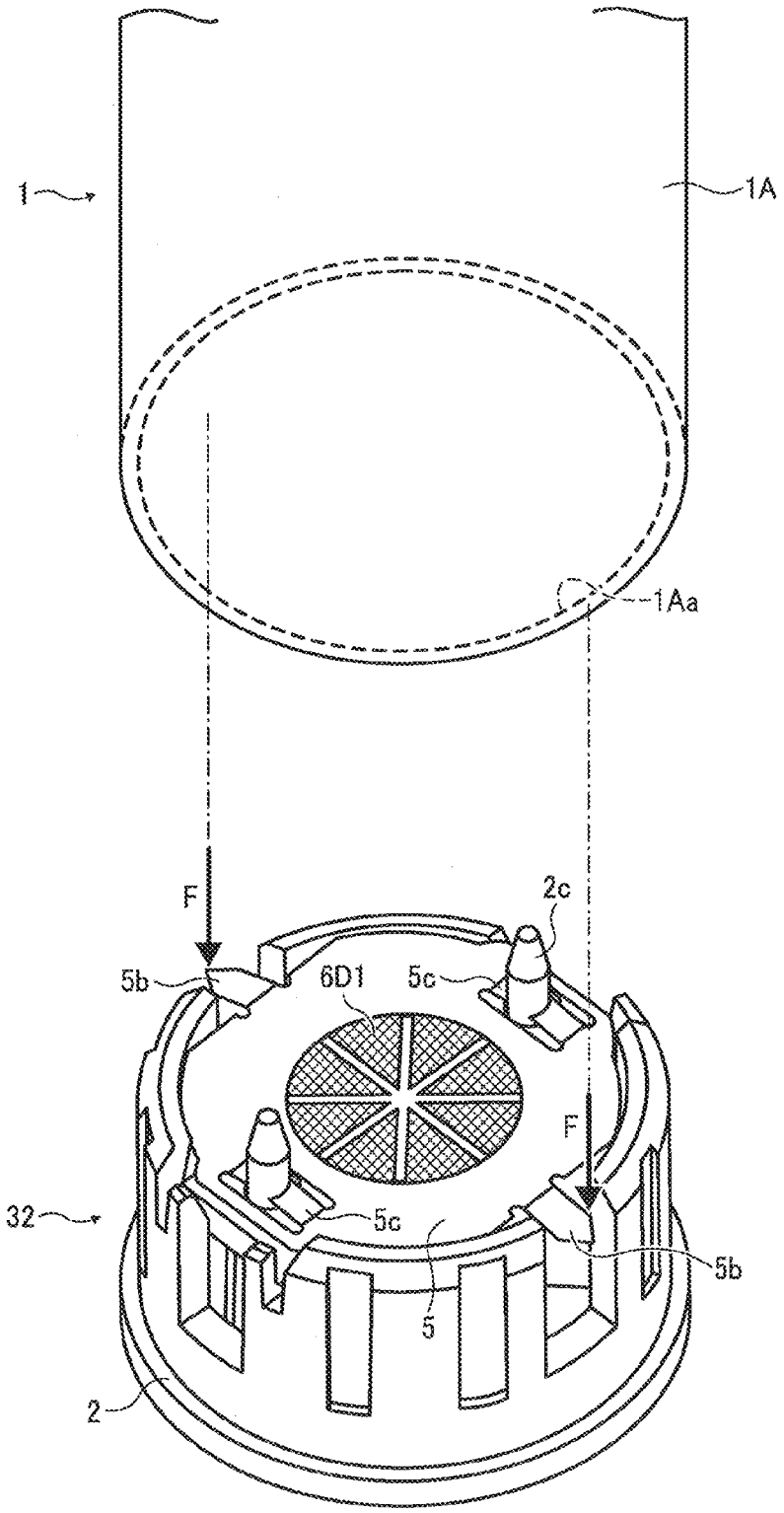
FIG. 54B is an exploded perspective view of main parts for explaining load applied to the pressure contact portions (claw portions) of the grounding plate when the flange assembly is press-fitted into the inside of a photoreceptor.
Figure 55A:
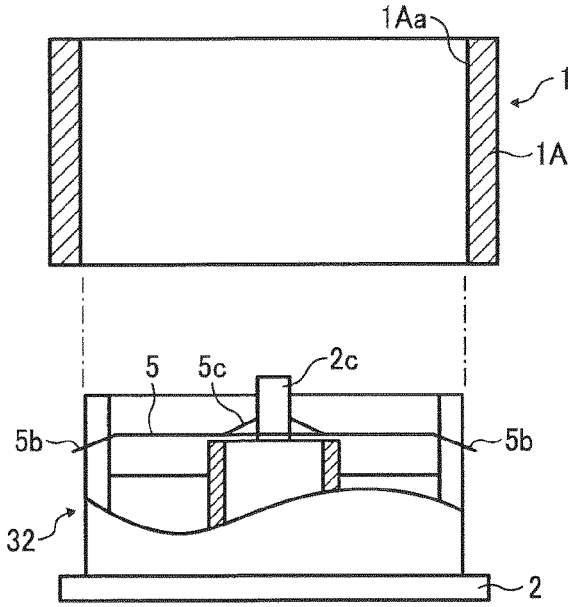
FIG. 55A is a cross-sectional view illustrating a state before the flange assembly of the first example is press-fitted into the inside of the photoreceptor.
Figure 55B:
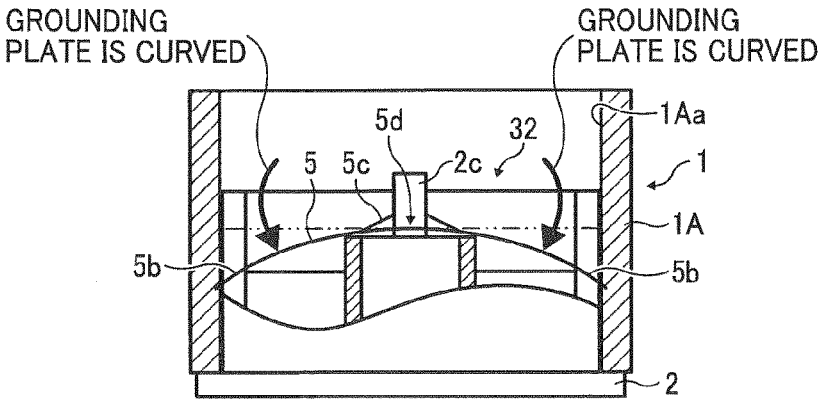
FIG. 55B is a cross-sectional view illustrating a state after the flange assembly of the first example is press-fitted into the inside of the photoreceptor.

With reference to FIGS. 54A to 55B, explanation is given of a positional relation between the pressure contact portions (claw portion) 5*b* being triangular protrusions formed on the grounding plate 5 and the bosses 2*c* of the flange 2 for pressing the conductive cloth 6D1 to fasten and fix the conductive cloth to the flange 2. FIG. 54A is a front view illustrating the positional relation between the pressure contact portions (claw portions) 5*b* of the grounding plate 5 and the bosses 2*c* of the flange 2 in the flange assembly 32 of the first example. FIG. 54B is an exploded perspective view of main parts for explaining load applied in the vicinity of the pressure contact portions (claw portions) 5*b* of the grounding plate 5 when the flange assembly 32 is press-fitted into the inside of the photoreceptor 1. FIG. 55A is a cross-sectional view illustrating a state before the flange assembly 32 is press-fitted into the inside of the photoreceptor 1. FIG. 55B is a cross-sectional view illustrating a state after the flange assembly 32 is press-fitted into the inside of the photoreceptor 1.

In FIGS. 54A to 55B, an example is illustrated in which the conductive cloth 6D1 of the first example shown in FIGS. 19, 20, and the like is used instead of the conductive cloth 6 forming the image carrier unit 10 of the first embodiment shown in FIG. 8. In FIGS. 55A and 55B, the conductive cloth 6D1 and the pressing member 7 are not shown for simplicity of illustration.

As described in the first embodiment and the first example, and also as shown in FIG. 55B, when the flange assembly 32 is press-fitted to the inner wall 1Aa of the conductive base member 1A as a base tube of the photoreceptor 1, the pressure contact portions (claw portions) 5*b* of the grounding plate 5 are pushed, so that the grounding plate 5 is curved as a whole. Because a phase angle between the positions of the bosses 2*c* of the flange 2 (corresponding to the middle positions between the boss fixing claws 5*c* being turned portions of the grounding plate 5) and the positions of the pressure contact portions (claw portions) 5*b* of the grounding plate 5 is set to about 90°, even when the pressure contact portions 5*b* are deformed and the grounding plate 5 itself is curved, the bosses 2*c* positioned on a line orthogonal to a line connecting the curved deformed portions can hardly be displaced. Therefore, it is possible to prevent the bosses 2*c* and the boss fixing claws 5*c* of the grounding plate 5 from being loosened. As a result, the fixation state of the grounding plate 5 can firmly be maintained.

This is described in detail below. As shown in FIGS. 54A to 55B, when the grounding plate 5 is press-fitted and fixed to the photoreceptor 1 such that the pressure contact portions (claw portions) 5*b* break into and bite into the inner wall 1Aa of the conductive base member 1A being the base tube of the photoreceptor 1, the two pressure contact portions (claw portions) 5*b* of the grounding plate 5 forming the flange assembly 32 ensure electrical connection between the grounding plate 5 and the conductive base member 1A of the photoreceptor 1. As shown in FIG. 55A, tips of the pressure contact portions 5*b* extend to the outside of the outer circumferential surfaces of the press-fitted portions of the flange 2, so that when the flange assembly 32 with the conductive cloth 6D1 is press-fitted, the tips break into the inner wall 1Aa of the conductive base member 1A of the photoreceptor 1. Therefore, as shown in FIG. 54B, when the flange assembly 32 is press-fitted into the photoreceptor 1, loads F indicated by arrows in the figure are applied to the pressure contact portions 5*b* of the grounding plate 5. Because the loads F are applied to the pressure contact portions 5*b*, the loads F in the directions of arrows are applied to the grounding plate 5, so that the grounding plate 5 itself is curved as shown in FIG. 55B.

In FIG. 54A, the positions of the bosses 2*c* as a slipping preventing members for fixing the grounding plate 5 to the flange 2 and sticking the grounding plate 5 and the conductive cloth 6D1 to each other are set to two, a line SL1 passing through three points (the boss 2*c*, the center of the photoreceptor 1, and the other boss 2*c*) matches the center line (straight line) passing through the center of the photoreceptor, and a phase difference (angle) θ between the positions of the pressure contact portions 5*b* and the positions of the bosses 2*c* is set to about 90°. Here, the center of the photoreceptor 1 means the center of the flange 2. That is, a line SL2 passing through the pressure contact portion 5*b*, the center of the photoreceptor 1, and the other pressure contact portion 5*b* is set to be orthogonal (perpendicular) to the line SL1 passing through the boss 2*c*, the center of the photoreceptor 1, and the other boss 2*c*.

FIG. 55B illustrates the state of the grounding plate 5 when the flange assembly 32 is press-fitted to the conductive base member 1A of the photoreceptor 1. Because the pressure contact portions 5*b* of the grounding plate 5 are positioned opposite to each other across the center of the photoreceptor 1 (i.e., the center of the flange 2), when the flange assembly 32 is press-fitted to the conductive base member 1A, the pressure contact portions 5*b* of the grounding plate 5 break into the inner wall lAa of the conductive base member 1A and the loads F are applied to the pressure contact portions 5*b*, so that the grounding plate 5 itself is curved using the position orthogonal to the line SL2 passing through the pressure contact portion 5*b*, the center of the photoreceptor 1, and the other pressure contact portion 5*b* as the center of the curve. Furthermore, when the positions of the two pressure contact portions 5*b* of the grounding plate 5 are set similarly to the above and the shape of the grounding plate 5 is set to be approximately symmetric, the position of a center 5*d* of the grounding plate 5 shown in FIG. 55B becomes the center of the curve. Therefore, it is possible to make the amounts of displacement of the pressure contact portions 5*b* of the grounding plate 5 uniform at the both ends when the flange assembly 32 is press-fitted to the conductive base member 1A of the photoreceptor 1. Furthermore, it is possible to curve the grounding plate 5 in a symmetrical manner with respect to a line orthogonal to the line SL2 passing through the center 5*d*. Moreover, it is possible to match the center 5*d* of the curve of the grounding plate 5 with the center position of the grounding plate 5, i.e., the center of the photoreceptor 1.

Because the grounding plate 5 has the shape as described above (i.e., the pressure contact portions 5*b* of the grounding plate 5 are positioned opposite to each other across the center of the photoreceptor 1 (i.e., the center of the flange 2), the shape of the grounding plate 5 itself is set to be approximately symmetric, and the angle between the pressure contact portions 5*b* and the bosses 2*c* is set to 90°), the grounding plate is curved using the line SL1 passing through the boss 2*c*, the center of the photoreceptor 1, and the other boss 2*c* as the center of the curve. Therefore, the grounding plate 5 can hardly be displaced at the center 5*d* on the line SL1, i.e., at the center of the curve of the grounding plate 5, and the amount of displacement increases as a distance from the center increases, i.e., toward the pressure contact portions 5*b*. As described above, because the positions of the bosses 2*c* for fixing the grounding plate 5 are on the line SL1 passing through the center 5*d* of the curve, it is possible to suppress the amount of displacement of the grounding plate 5 at the bosses 2*c* that fix the grounding plate 5. Therefore, it is possible to prevent the bosses 2*c* and the boss fixing claws (turned portions) 5*c* of the grounding plate 5 from being loosened, and firmly maintain the fixation state of the grounding plate 5.

Figure 56A:
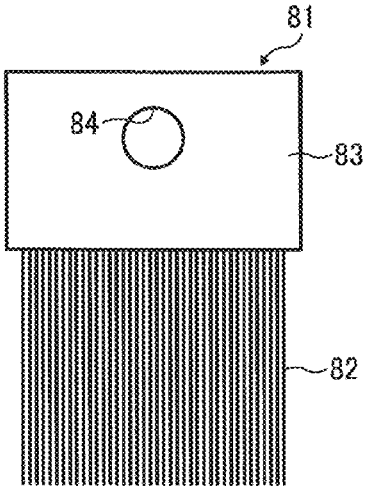
FIG. 56A is a front view of a metal brush.

With reference to FIGS. 56A to 64B, explanation is given of the advantage of the conductive cloth according to the present invention in terms of stabilization of electrical connection in comparison with a metal brush as a comparative example. FIG. 56A is a front view of a metal brush 81. FIG. 56B is a side view of the metal brush 81.

The metal brush is formed of metal fiber aggregate, and seemingly has a number of contact points in contact with a contact member. However, only small part of the surface of the metal fiber aggregate of the metal brush is used for making electrical connection. Furthermore, each metal fiber comes into contact with a shaft (contact member) of the photoreceptor only at one point. On the other hand, because the conductive cloth is woven with conductive fibers and the surface of the conductive cloth is uneven, it is possible to obtain a plurality of contact points coming into contact with the shaft of the photoreceptor. With use of the conductive cloth, the number of contact points to be in contact with the shaft of the photoreceptor can be even increased than that of the metal brush, so that the stability of the electrical connection can be improved. This is described in detail below.

First, a method of using the metal brush will be described below.

Figure 56B:
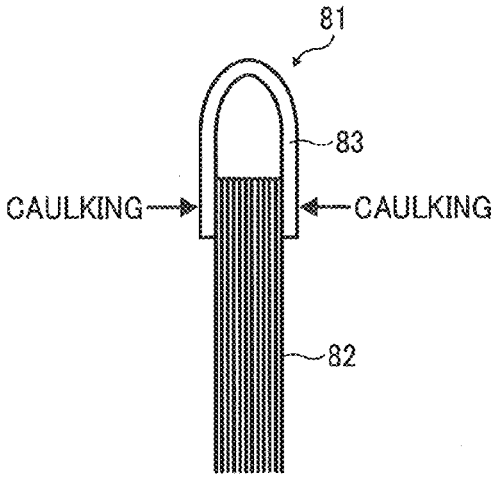
FIG. 56B is a side view of the metal brush.

As shown in FIGS. 56A and 56B, the metal brush 81 is formed by aggregating metal fibers 82 made of metal such as stainless steel (hereinafter, abbreviated as "SUS") like a brush. More specifically, the metal fibers 82 are aggregated in the same direction and an end portion of the aggregate is caulked by a fixing sheet-metal 83. The fixing sheet-metal 83 may be made of SUS or normal metal; however, aluminum is generally used because of flexibility as a metal and resistivity to rust to make the caulking easy and improve adhesiveness to the metal fibers 82 when the caulking is performed. Therefore, the metal fibers 82 in the form of a brush and the fixing sheet-metal 83 for holding the metal fibers are electrically connected to each other.

As for the method of bringing the metal brush into contact with the contact member, two methods are mainly employed.

Figure 57A:
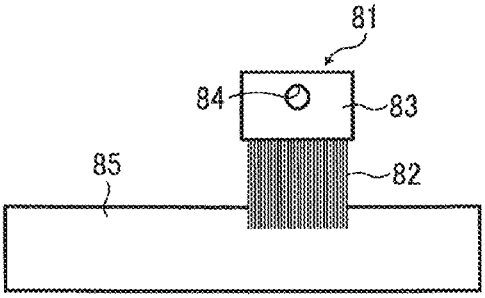
FIG. 57A is a front view of main parts for explaining a method of putting the metal brush on a rotary shaft in the direction parallel to the rotary shaft.
Figure 57B:
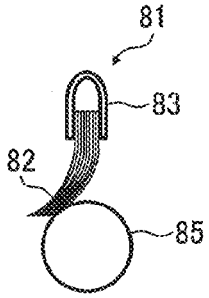
FIG. 57B is a side view of the metal brush and the rotary shaft shown in FIG. 57A.

(1) As shown in FIGS. 57A and 57B, one of the methods is to put the metal brush 81 on a rotary shaft 85 being the contact member in the direction parallel to the rotary shaft. In this method, the whole area of the metal brush 81 is used, and the metal brush 81 is disposed so that a tip portion thereof is bent when brought into contact with the shaft 85. Accordingly, the pressing force is applied to the shaft 85 by the metal brush 81, so that the contact state can be stabilized.

Figure 58A:
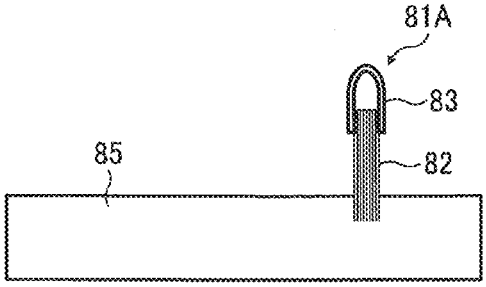
FIG. 58A is a front view of the main parts for explaining a method of putting the metal brush on the rotary shaft in the direction orthogonal to the rotary shaft.
Figure 58B:
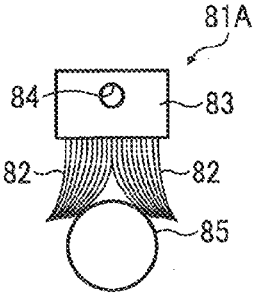
FIG. 58B is a side view of the metal brush and the rotary shaft shown in FIG. 58A.

(2) As shown in FIGS. 58A and 58B, the other of the methods is to put a metal brush 81A on the rotary shaft 85 in the direction orthogonal to the rotary shaft. In this method, the thickness of the metal brush 81A is used, and the metal brush 81A is put on shaft 85 so that the metal brush 81A is parted in the center thereof. Because the contact width is decreased compared with the method (1) described above, the contact area of the metal brush 81A is decreased.

In FIGS. 56A to 58B, a reference numeral 84 denotes a mount hole for fitting the bosses 2*c* of the flange 2 when the metal brushes 81 and 81A are assembled with the flange 2 to form a flange assembly to be described below.

Figure 59A:
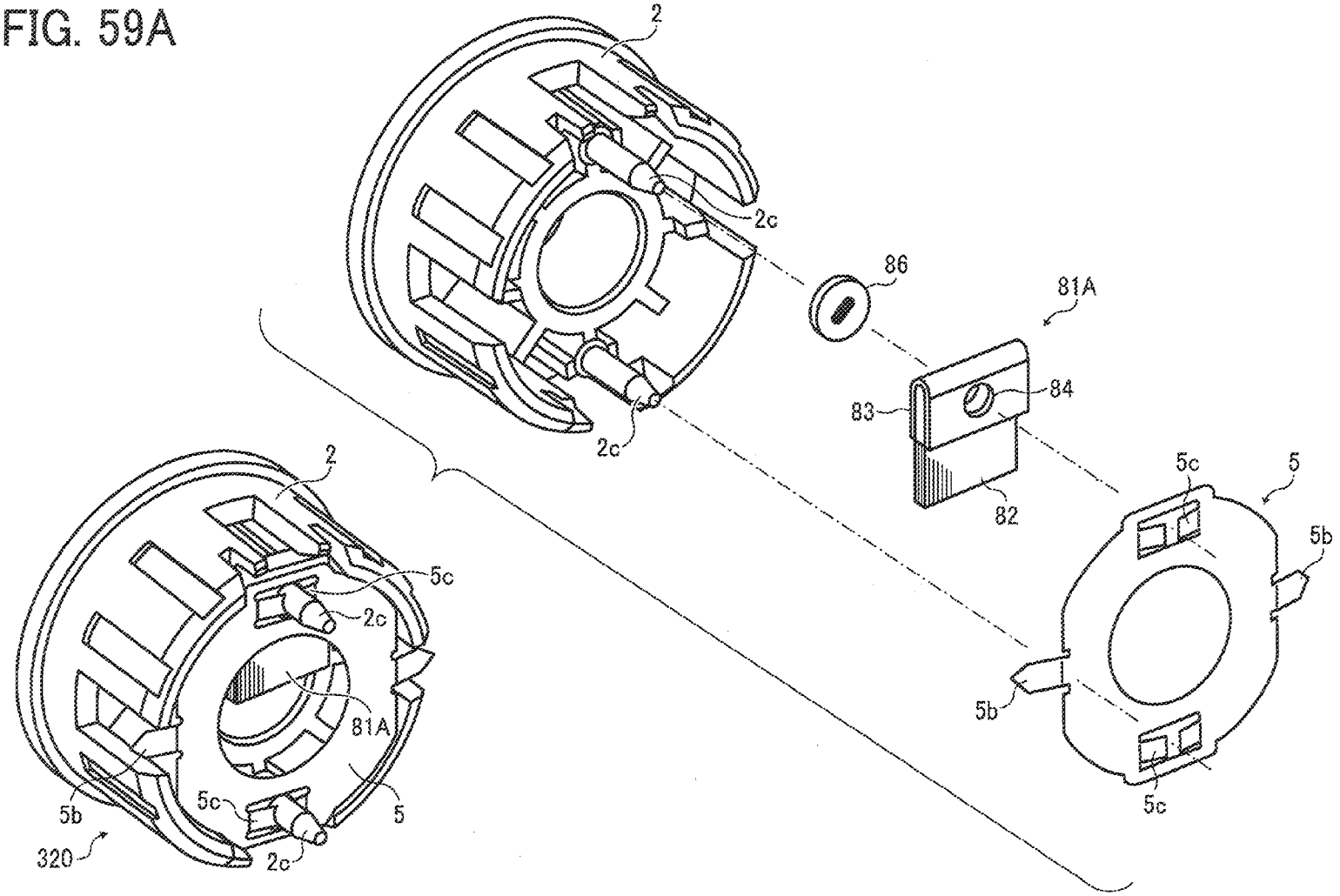
FIG. 59A is an exploded perspective view of a configuration for assembling the metal brush with the flange.
Figure 59B:
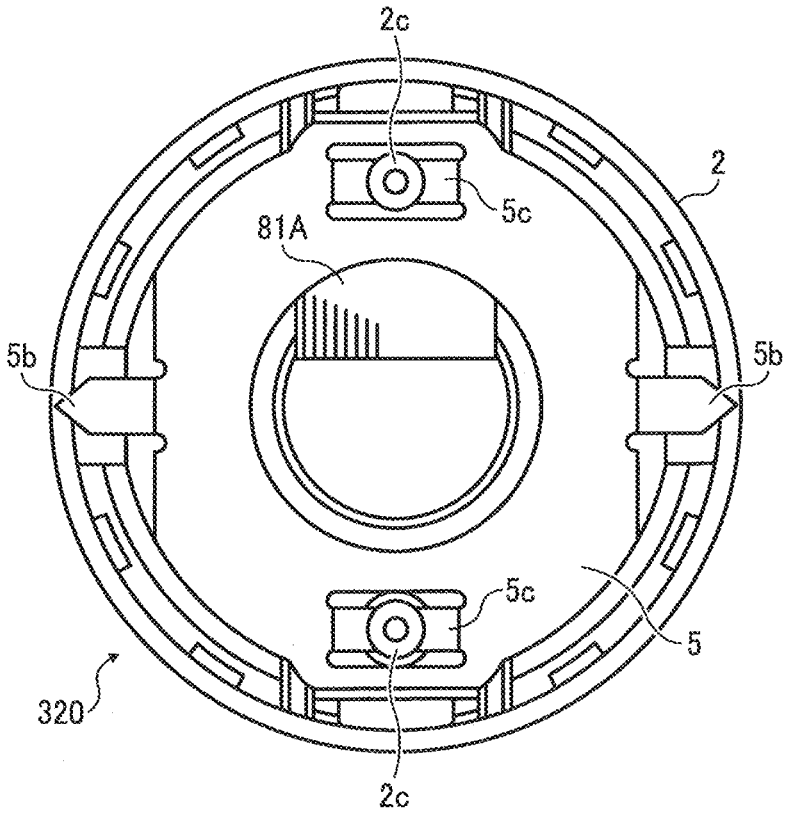
FIG. 59B is a front view of the metal brush assembled with the flange shown in FIG. 59A.

With reference to FIGS. 59A and 59B, a detailed configuration of the flange assembly equipped with the metal brush will be described below. A flange assembly 320 in which the metal brush 81A shown in FIGS. 58A and 58B for example is assembled with the flange 2 (temporary flange to be fitted into the photoreceptor) is formed such that, as shown in FIG. 59A, a rubber ring 86 is fitted to one of the two bosses 2*c* of the flange 2, and then the metal brush 81A is mounted on the rubber ring. Thereafter, the grounding plate 5 is mounted on the metal brush 81A, so that the flange assembly 320 is formed. Because the grounding plate 5 has the boss fixing claws (turned portions) 5*c* as described above, when the grounding plate is fitted using the bosses 2*c* of the flange, the grounding plate is not slipped out. Furthermore, the fixing sheet-metal 83 by which the metal fibers 82 of the metal brush 81 are caulked comes into contact with the grounding plate 5 because the rubber ring 86 is compressed. This configuration is for the method (2) described above in which "the metal brush is put on the rotary shaft 85 in the direction orthogonal to the rotary shaft". In the configuration for the method (2) described above, components are mounted in the axial direction and the mount positions of the components can be simplified. Therefore, this configuration is generally employed.

Figure 60A:
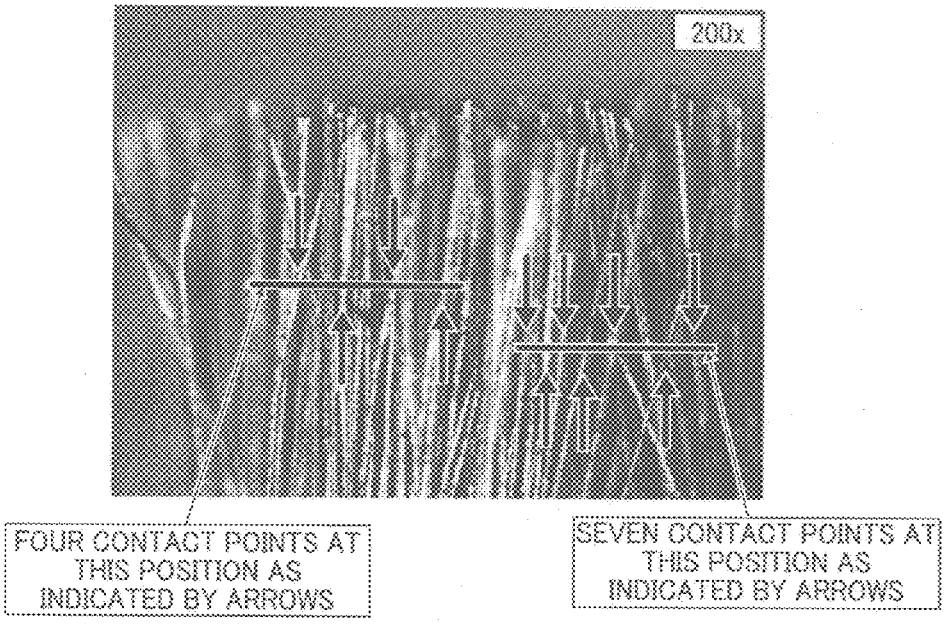
FIG. 60A is an enlarged micrograph at magnification of 200× for explaining a contact position and contact points of metal fiber portions of the metal brush.
Figure 60B:
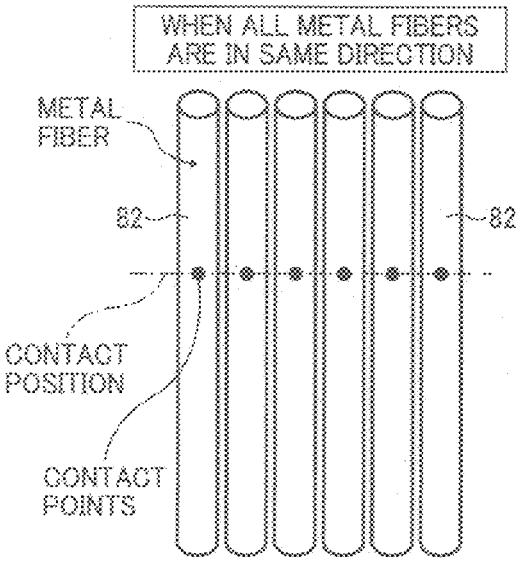
FIG. 60B is a schematic diagram illustrating a contact position and contact points when all of the metal fibers are in the same direction.
Figure 60C:
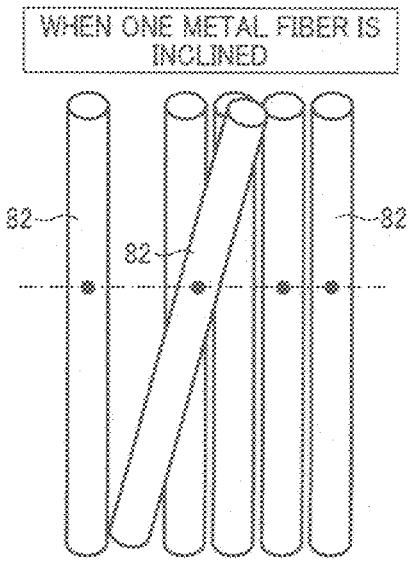
FIG. 60C is a schematic diagram illustrating a contact position and contact points when one of the metal fiber is inclined.

With reference to FIGS. 60A to 60C, a contact position and contact points of the metal brush will be examined below. FIG. 60A is an enlarged micrograph at magnification of 200× for explaining a contact position and contact points of the metal fibers 82 of the metal brush 81A. FIG. 60B is a schematic diagram illustrating a contact position and contact points when all of the metal fibers 82 of the metal brush 81A are in the same direction. FIG. 60C is a schematic diagram illustrating a contact position and contact points when one of the metal fibers 82 of the metal brush 81 is inclined.

A lateral contact point of the contact member coming into contact with the metal brush will be explained below using the example of the metal brush 81A shown in FIGS. 58A and 58B for example. Among the aggregated metal fibers 82, only the metal fibers 82 on the surface in contact with the contact member (the shaft 85) actually come into contact with the contact member (the shaft 85) and function to make electrical connection with the contact member. That is, in the photograph shown in FIG. 60A, only the metal fibers 82 on the outermost part of the metal brush 81A are effective to make the electrical connection among the aggregated metal fibers 82. Furthermore, although the metal fibers 82 in the form of a brush are aggregated in the same direction as a whole, each of the metal fibers 82 may be in a different direction or overlap each other in an actual state. The metal fibers 82 in different directions intersect or overlap each other, so that concave and convex portions are formed. Therefore, portions to be in contact with the contact member are reduced.

Referring to FIGS. 60B and 60C, when the metal fibers 82 are in the same direction, six contact points are obtained as shown in FIG. 60B. However, even when one of the metal fibers 82 is in a different direction as shown in FIG. 60C, the contact points are decreased to four. In the actual metal brush 81A, as shown in the photograph of FIG. 60A, the diameter of each of the metal fibers 82 is about 0.015 mm while a solid line in the photograph of the figure is about 0.45 mm long. When all of the metal fibers 82 are aggregated in the same direction, the number of contact points in contact with arbitrary portions becomes 0.45 mm/0.015 mm=30. However, as shown in the photograph of FIG. 60A, each of the metal fibers 82 is in a different direction, the number of contact points is greatly decreased to four or seven in the portion of the same width.

Figure 61:
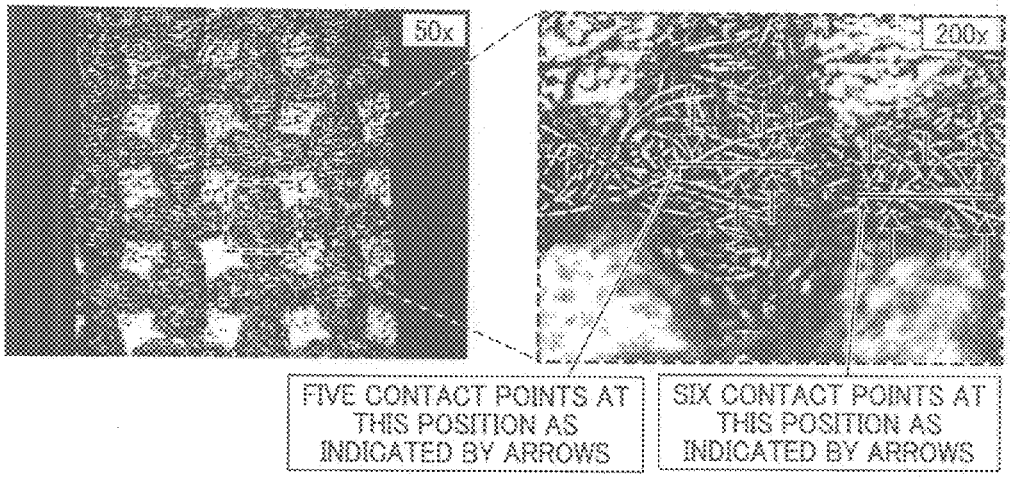
FIG. 61 is a micrograph at magnification of 50× and 200× for explaining a lateral contact position and lateral contact points between the contact member and the conductive cloth.

With reference to FIG. 61, lateral contact points between the contact member (the shaft 85) and the conductive cloth of the present invention are described below with use of an example of the conductive cloth shown in FIG. 9A for example. The conductive cloth is woven with the conductive fibers as described above. The woven state is not uniform, so that the lateral contact points are not at contact positions at regular intervals. Actually, as shown in the micrographs of FIG. 61, the number of contact points may be five or six in the portion of the same width. Thus, the number of lateral contact points becomes approximately equal to the number of contact points of the metal brush described above.

Figure 62A:
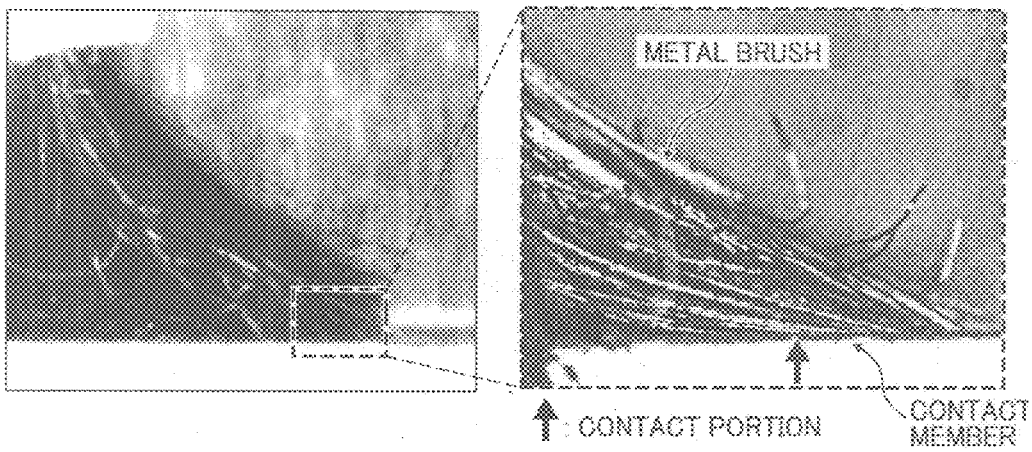
FIG. 62A is a micrograph showing vertical contact points between the contact member and the metal brush.

With reference to FIG. 62A, explanation is given of vertical contact points between the contact member and the metal brush. The photographs of FIG. 62A show a contact member in the form of a flat surface as an example. When the metal brush is brought into contact with the contact member, a brush portion (metal fibers) is bent and comes into contact with the contact member as shown in the photograph of left side of FIG. 62A. As shown in the photograph of right side of FIG. 62A, only the outermost metal fibers among the aggregate of the metal brush come into contact with the contact member. As for each of the metal fibers coming into contact with the contact member, the number of contact points of each metal fiber is one.

Figure 62B:
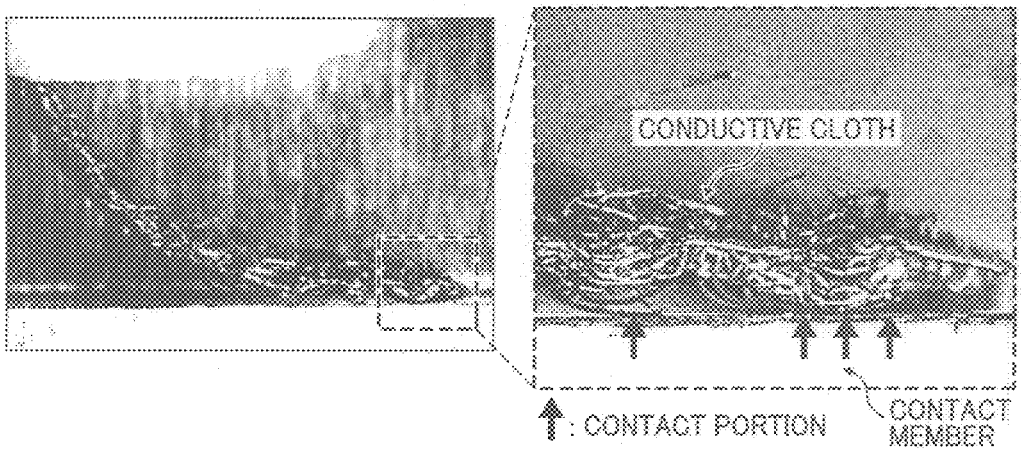
FIG. 62B is a micrograph showing vertical contact points between the contact member and the conductive cloth.

With reference to FIG. 62B, explanation is given of vertical contact points between the contact member and the conductive cloth of the present invention. The photographs of FIG. 62B show a contact member in the form of a flat surface as an example. When the conductive cloth is brought into contact with the contact member, the conductive cloth is bent and comes into contact with the contact member as shown in the photograph of left side of FIG. 62B. Because the conductive cloth is woven with the conductive fibers in a net-like manner, the surface is uneven. When the conductive cloth is brought into contact with the contact member, convex portions on the surface come into contact with the contact member, so that a plurality of contact points is obtained (four in the photograph).

Figure 63A:
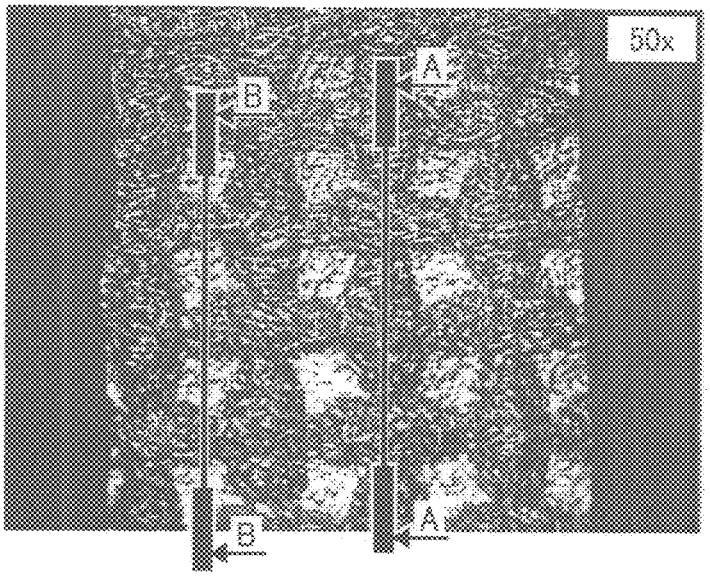
FIG. 63A is a micrograph of a conductive cloth.
Figure 63B:
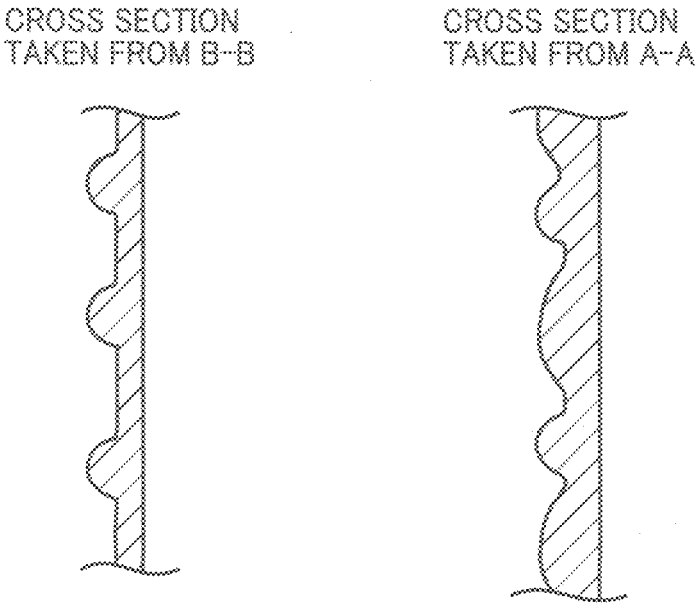
FIG. 63B is a schematic cross-sectional view taken along A-A and B-B of the micrograph shown in FIG. 63A.

Furthermore, it can be seen from the micrograph of FIG. 63A that the cross section of the conductive cloth is uneven. The image of each cross section (B-B and A-A) of the conductive cloth is shown in FIG. 63B.

Figure 64A:
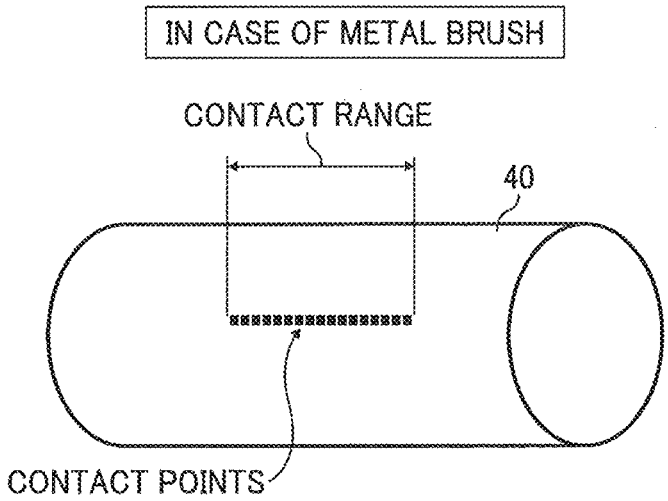
FIG. 64A is an explanatory diagram illustrating a contact range and contact points between the metal brush and a shaft.
Figure 64B:
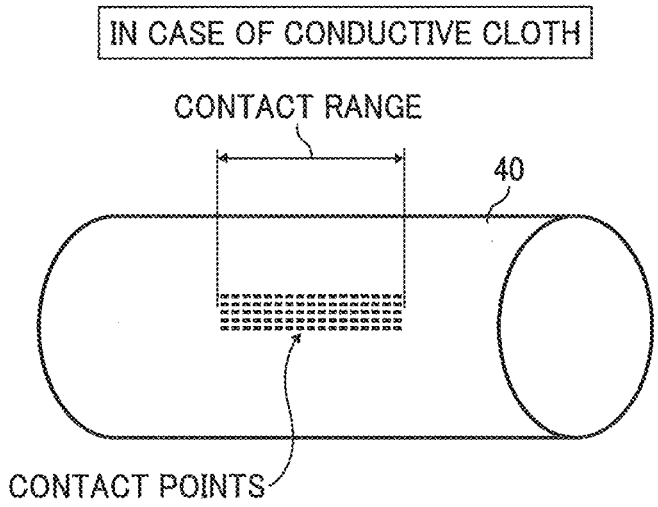
FIG. 64B is an explanatory diagram illustrating a contact range and contact points between the conductive cloth and the shaft.

According to the above description, when metal brush and the conductive cloth are brought into contact with a contact member being a columnar shaft 40 in the same manner in FIGS. 64A and 64B, the contact range and the contact points between the metal brush and the shaft 40 make the same straight line in the axial direction of the shaft 40 and in a spot-like manner as shown in FIG. 64A.

On the other hand, the contact range and the contact points between the conductive cloth and the shaft 40 make a width with respect to the axial direction of shaft 40 in a spot-like manner as shown in FIG. 64B. In this manner, when the conductive cloth and the metal brush are brought into contact with the shaft 40 as the same contact member, the conductive cloth can have more contact points than the metal brush.

SECOND EXAMPLE

Figure 65A:
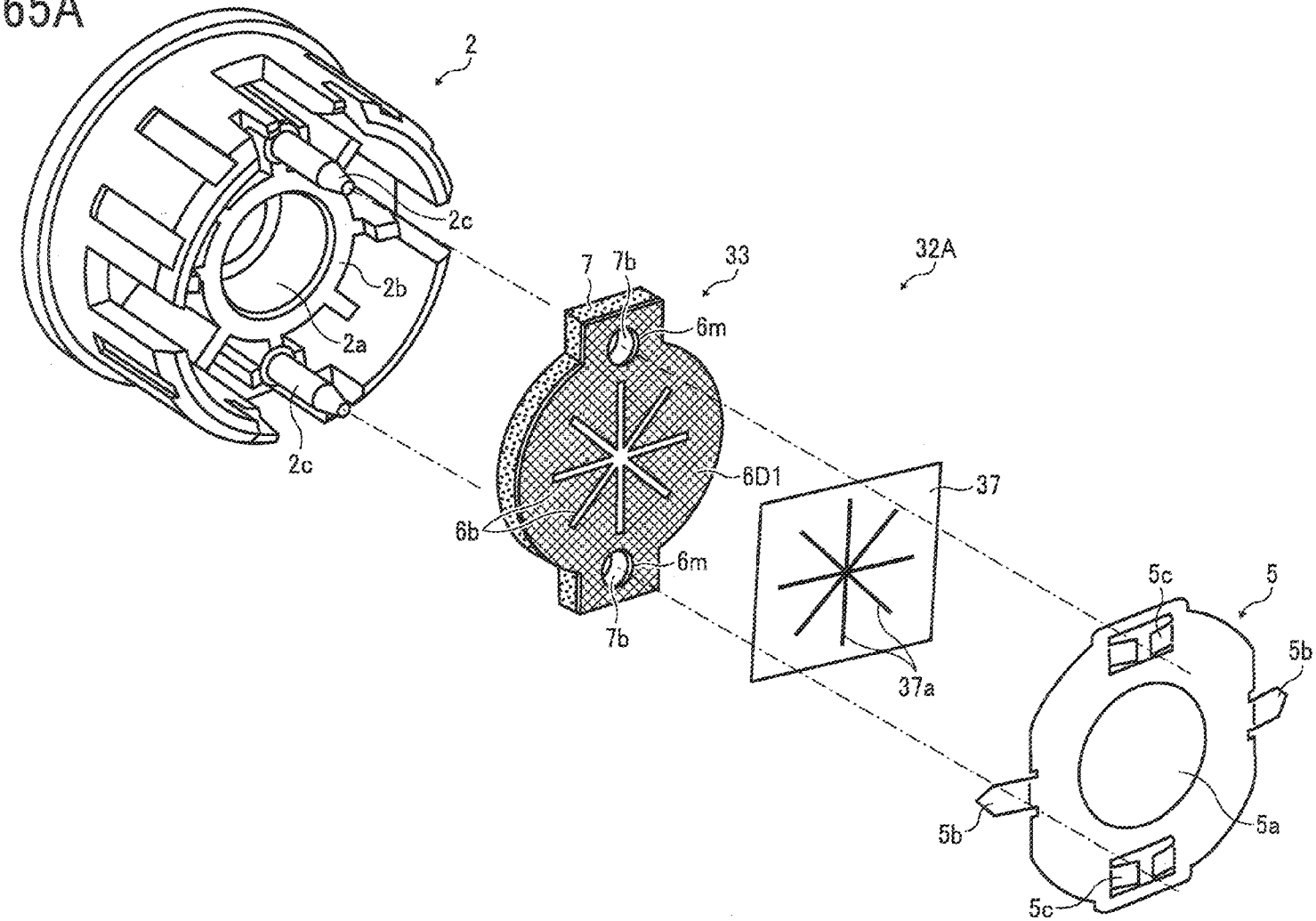
FIG. 65A is an exploded perspective view of a configuration of a flange assembly according to a second example.

With reference to FIGS. 65A to 69, a second example will be described below in which a contact point is settled by putting and firmly pressing an elastic body (PET sheet) onto the back side of the conductive cloth. FIG. 65A is an exploded perspective view of a configuration of a flange assembly according to a second example. FIG. 65B is a diagram for explaining the configuration of the flange assembly of the second example, and particularly, a front view illustrating the state before the grounding plate 5 is mounted. FIGS. 66A to 66C are photographs showing perspective illustration of exploded parts of the flange 2 for explaining a transition state for assembling the flange assembly of the second example.

As described in the first embodiment and the first example, the pressing force of the conductive cloth with only the cuts is small at the time of contact with the contact member, so that the contact may become unstable by high-temperature soaking or the like. Therefore, according to the second example, an elastic body is added in addition to the conductive cloth so that the pressing force against the contact member can be increased and the contact with the contact member can be stabilized. More specifically, a polyethylene terephthalate (hereinafter, abbreviated as "PET") sheet is sandwiched between the grounding plate and the conductive cloth while a portion where the grounding plate and the conductive cloth come into direct contact with each other is maintained.

Problems and concerns with use of only the conductive cloth will be described below. In the method in which the cuts are formed on the conductive cloth and the conductive cloth is curved or bent to come into contact with the contact member, the contact pressure against the contact member is obtained by only the pressing force due to the bent of the conductive cloth. The pressing force due to the flexibility and the elastic restoration of the conductive cloth itself is small, and when the conductive cloth is left under high-temperature environment, the conductive cloth may be deformed permanently. When the conductive cloth is in the above state, the contact with the contact member may become unstable and the electrical connection may be disconnected. Therefore, in the present example, a means for increasing the pressing force is arranged as described below to stabilize the electrical connection compared with the first example.

The basic configuration of the second example is made such that the conductive cloth assembly 33 (see the conductive cloth assembly 33 shown in FIG. 20 for example) described in the first example is mounted on the flange 2, and a PET sheet 37 as the elastic body is mounted on the conductive cloth assembly. Furthermore, the grounding plate 5 is press-fitted onto the PET sheet 37 so that the conductive cloth 6D1 and the PET sheet 37 are sandwiched between the flange 2 and the grounding plate 5.

Figure 65B:
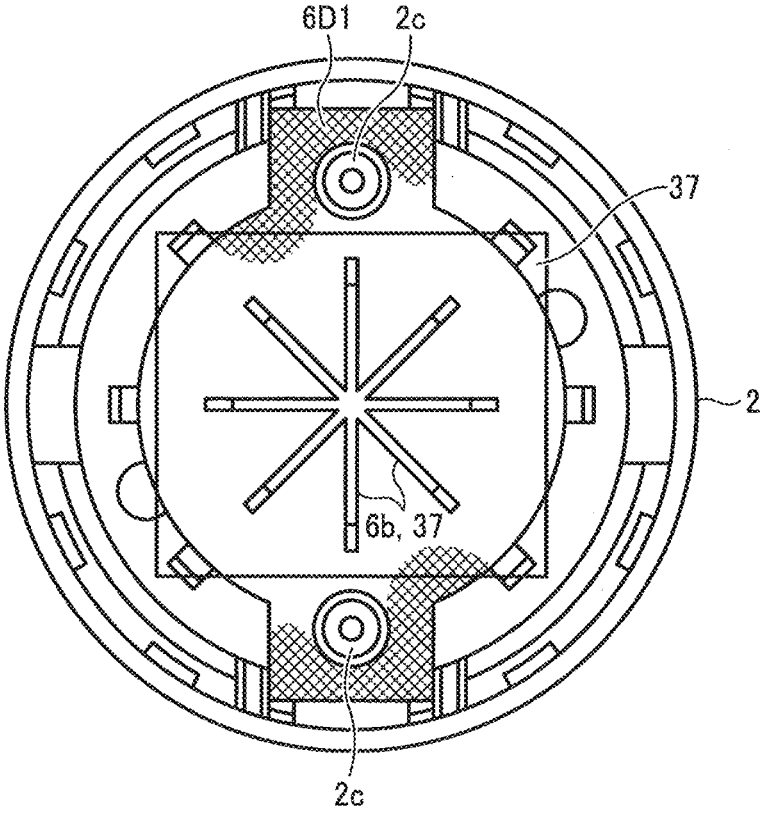
FIG. 65B is a diagram for explaining the configuration of the flange assembly of the second example, and particularly, a front view illustrating the state before the grounding plate is mounted.

As shown in FIGS. 65B and 66A, the PET sheet 37 is transparent in this example, and the shape of the outer periphery of the PET sheet is a rectangle being an approximate square of which outer circumferential portion is smaller than the shape of the outer periphery of each of the conductive cloth 6D1 and the grounding plate 5 (particularly, smaller than the circumferential portions of the boss holes 6*m* and the boss fixing claws 5*c*). That is, the feature of the shape of the outer periphery of the PET sheet 37 is that it is formed to be small so as not to cover the peripheries of the boss holes 6*m* of the conductive cloth 6D1 and the boss fixing claws 5*c* of the grounding plate 5. With this structure, when the grounding plate 5 is mounted on the flange 2 such that the boss fixing claws 5*c* of the grounding plate 5 are engaged with the bosses 2*c* of the flange 2, the conductive cloth 6D1 and the grounding plate 5 can be brought into contact with each other at a portion closest to the portions fixed by the boss fixing claws 5*c* of the grounding plate 5. Therefore, the conductive cloth 6D1 and the grounding plate 5 surely come into close contact with each other, so that the electrical connection can be stabilized. Cuts 37*a* in the approximately same shapes as the cuts 6*b* of the conductive cloth 6D1 are formed in the center of the PET sheet 37.

As shown in FIG. 65A, when the PET sheet 37 is mounted on the flange 2, the above-mentioned portion is formed where the conductive cloth 6D1 and the grounding plate 5 come into direct contact with each other as shown in FIGS. 65B, 66B, and 66C. Accordingly, even when the PET sheet 37 is sandwiched between the conductive cloth 6D1 and the grounding plate 5, the conductive cloth 6D1 and the grounding plate 5 come into direct contact with each other and are electrically connected to each other. FIG. 66C illustrates a state in which the shaft 4 passes through a flange assembly 32A. It can be seen from FIG. 66C that the shaft 4 and the conductive cloth 6D1 come into contact with each other by being pressed by the PET sheet 37 and that the PET sheet 37 has the function of pressing the conductive cloth 6D1.

It is sufficient to place the PET sheet 37 between the conductive cloth 6D1 and the grounding plate 5 so as to allow the shaft 4 to pass through the flange assembly, and the PET sheet 37 need not be fixed to the conductive cloth 6D1 or the grounding plate 5. However, it is possible to add a process of forming the PET sheet 37 to the process of processing the conductive cloth assembly 33 shown in FIGS. 24A to 24E or appropriately arrange a positioning means such as embossing so as to match the phases for preventing displacement between the cuts 37*a* of the PET sheet 37 and the cuts 6*b* of the conductive cloth 6D1 or to simplify a metal mold or a work process.

Figures 68, 69:
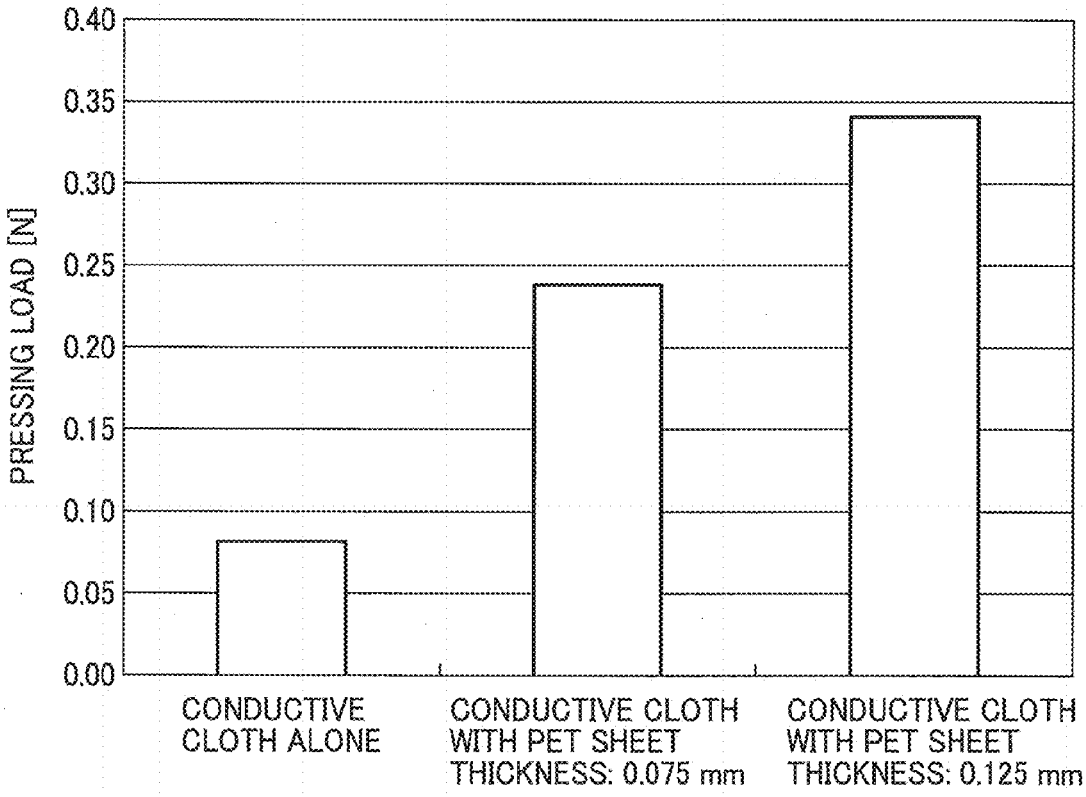
FIG. 68 is a table containing measurement results of the pressing load applied to the three types of test pieces (measurement pieces)
FIG. 69 is a graph of the measurement results of the pressing load applied to the three types of test pieces (measurement pieces)

A table shown in FIG. 68 and a graph shown in FIG. 69 contain test results of a measurement test of the pressing load on three types of test pieces (measurement pieces), i.e., a conductive cloth alone and two conductive cloths with PET sheets having respective thicknesses of 0.075 mm and 0.125 mm.

Figure 67A:
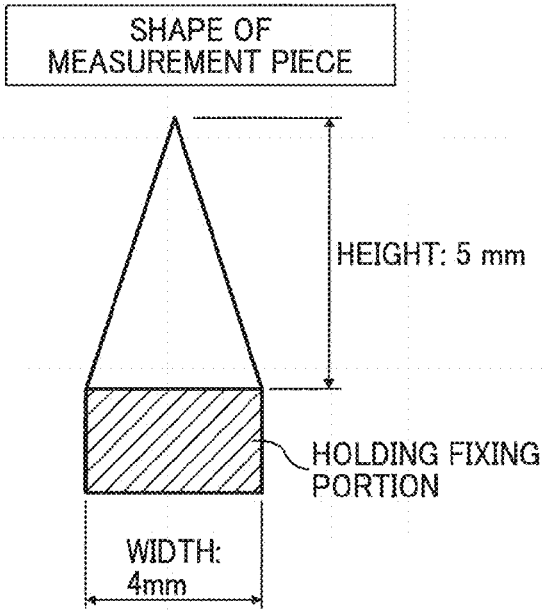
FIG. 67A is a diagram for explaining a shape and dimension of three types of test pieces (measurement pieces), i.e., a conductive cloth alone and two conductive cloths with PET sheets of different thicknesses.
Figure 67B:
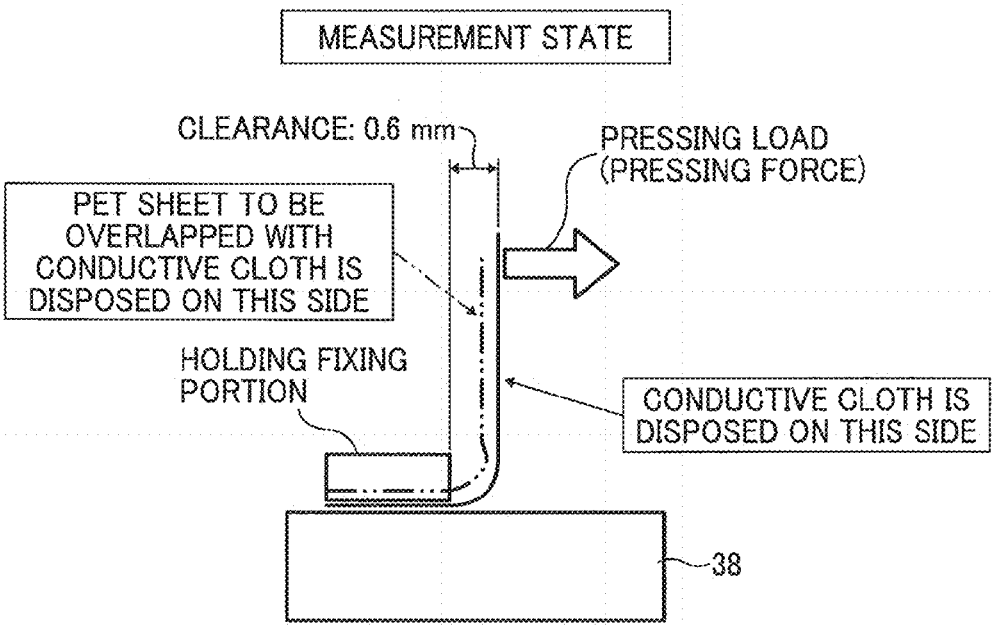
FIG. 67B is a diagram for explaining a measurement state of pressing load on the test pieces (measurement pieces)
Figure 70:
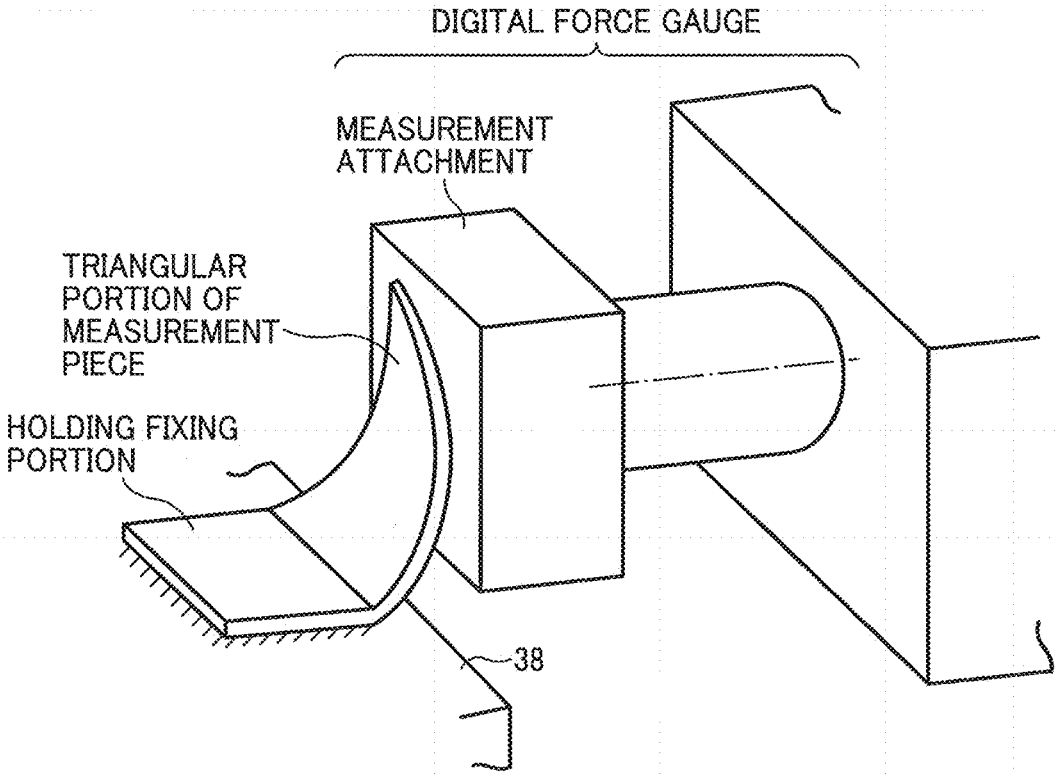
FIG. 70 is a perspective view of a test piece and an exemplary digital force gauge.

The test conditions are as follows. As shown in FIGS. 67A and 67B, the shape of a test piece (measurement piece) is such that a conductive cloth is shaped to have a width of 4 mm and a triangular protruding tip with a height of 5 mm from an end portion indicated by a hatched line. The pressing load (pressing force) is measured by using a digital force gauge by fixing the end portion (holding fixing portion) and deforming the test piece until the clearance becomes 0.6 mm as shown in FIG. 67B. FIG. 70 is an exemplary illustration of the digital force gauge and the test piece at the measurement test. In the case of the conductive cloths with the PET sheets, the shape of each PET sheet is made identical to that of the conductive cloth, the conductive cloth and the PET sheet are disposed as shown in FIG. 67B, and measurement is performed by fixing the end portion (holding fixing portion) to a test bench 38 such that the PET sheet and the conductive cloth overlap each other. In this case, the PET sheet and the conductive cloth are only overlapped with each other and not bonded together.

In this manner, by placing the elastic body in the form of a thin plate such as the PET sheet, it is possible to stably apply the pressing force to the conductive cloth.

As for the stabilization of the contact state under a high-temperature soaking condition, the electrical connection sometimes became unstable with use of the conductive cloth alone. However, in the flange assembly with the PET sheet having a thickness of 0.075 mm or 0.125 mm, the electrical connection can be stabilized in both cases, and any unstable states were found, showing a significant difference from the use of the conductive cloth alone.

With the test results described above, to maintaining a stable contact state between the shaft 4 and the conductive cloth 6D1, it is advantageous to place the elastic body in the form of a thin plate such as the PET sheet 37 so that the pressing force can be increased. It is confirmed by the tests that at least the PET sheet 37 having a thickness of 0.075 mm or 0.125 mm can sufficiently function to obtain the above advantages.

Although the invention has been described above with respect to embodiments and the like including specific examples, the scope and sprit of the invention are not limited to the above-mentioned embodiments and the like. The embodiments and the like may be appropriately combined with each other, and it is apparent to those skilled in the art that a variety of modifications or embodiments may be made without departing from the scope of the invention according to need, purpose, use, and the like.

A mechanism for electrifying, e.g., grounding a specific rotator, which is used in the electrophotographic image forming apparatus, has been described in each embodiment and each modification. However, the invention is not limited thereto. It is natural that the invention may be applied to a rotator, which is needed to be electrified, e.g., grounded, of an electrophotographic image forming apparatus, an electrostatic recording image forming apparatus, and a magnetic recording image forming apparatus. The term "an electrophotographic image forming apparatus, an electrostatic recording image forming apparatus, or a magnetic recording image forming apparatus" means a transfer-type electrophotographic image forming apparatus, such as a copying machine, a facsimile, a printer, a plotter, or a complex machine having a plurality of these functions, that forms and carries a transferable image such as a toner image corresponding to target image information on an image carrier, such as an electrophotographic photoreceptor, an electrostatic recording dielectric, or an magnetic recording magnetic body through image forming processes, such as an electrophotographic process, an electrostatic recording process, and an magnetic recording process; and transfers the transferable image to a transfer member or a sheet-like recording medium by a appropriate transfer unit, such as a transfer roller or a corona discharger, to which a transfer bias has been applied.

According to the invention, it may be possible to provide a novel mechanism for electrifying a rotator, which solves the above-mentioned problem; an image carrier unit, a process cartridge, a belt unit, a fixing unit, a sheet conveying unit, and an image forming apparatus that respectively use the mechanism for electrifying a rotator; a method of electrifying a rotator; and a conductive member.

According to one aspect of the invention, sliding between metals may be eliminated because of the above-mentioned structure. Accordingly, it may be possible to prevent poor electrical connection by suppressing oxidation and generation of noise. Further, since a conductive lubricant is not needed, it may be possible to provide a mechanism for electrifying a rotator which is environment-friendly, inexpensive, compact, and reliable.

Further, it may be possible to provide a mechanism for electrifying a rotator, which has an advantage of securing more stable electrical connection, by a simple structure where a cloth-like or sheet-like conductive member includes cuts. Further, it may also be possible to obtain an advantage of preventing the generation of scraps or dust.

Further, it may be possible to obtain an advantage of securing more stable electrical connection, by a simple structure where a cloth-like or sheet-like conductive member includes a cutout portion. Furthermore, it may be possible to obtain an advantage of accurately or precisely adjusting the contact with a contact target, the contact range, and the contact pressure by carefully designing the shape of the cutout portion.

Further, with the above-mentioned structure, it may be possible to obtain an advantage of accurately or precisely adjusting the contact with a contact target, the contact range, and contact pressure.

Further, with the above-mentioned structure, it may be possible to obtain an advantage of securing stable electrical connection.

Further, with the above-mentioned structure, it may be possible to provide an image carrier unit that obtains at least one or more of the advantages as described above.

Further, it may be possible to obtain an advantage of securing reliable electrical connection with time by pressing the sheet-like conductive member or conductive cloth by the pressing member in the image carrier unit.

Further, it may be possible to obtain at least one or more of the advantages as described above in the process cartridge.

Further, it may be possible to obtain an advantage of providing stable image quality in the image forming apparatus.

Further, it may be possible to obtain at least one or more of the advantages as described above in the belt device.

Further, it may be possible to obtain an advantage of securing reliable electrical connection with time by pressing the sheet-like conductive member or conductive cloth by the pressing member in the belt device.

Further, it is provided a belt device including any one of an intermediate transfer belt serving as an intermediate transfer body; an image carrier belt including any one of an electrophotographic photoreceptor layer, an electrostatic recording dielectric layer, and a magnetic recording magnetic layer; and a transfer conveying belt serving as a transfer conveying body, and the belt device may have at least one or more of the advantages as described above.

Further, it may be possible to obtain at least one or more of the advantages as describved above even in the fixing device.

Further, it may be possible to obtain an advantage of securing reliable electrical connection with time by pressing the sheet-like conductive member or conductive cloth by the pressing member in the fixing device.

Further, it may be possible to obtain at least one or more of the advantages as described above even in the sheet conveying unit.

Further, it may be possible to obtain an advantage of securing reliable electrical connection with time by pressing the sheet-like conductive member or conductive cloth by the use of the pressing member in the sheet conveying unit.

Further, it may be possible to obtain at least one or more of the advantage of the belt unit as described above, the advantage of the fixing units described above, and the advantage of the sheet conveying unit as described above, in the image forming apparatus.

According to another aspect of the invention, there is provided a method of electrifying a rotator by which poor electrical connection is prevented because oxidation and noise generation are suppressed, which is resulting from elimination of sliding between metals, and which is environment-friendly, inexpensive, compact, and stable because a conductive lubricant is not needed.

According to still another aspect of the invention, it may be possible to provide a method of electrifying a rotator, which secures more stable electrical connection.

According to still another aspect of the invention, it may be possible to provide a conductive material that obtains at least one or more of the advantages as described above.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A mechanism configured to electrify a rotator of an image forming apparatus, the mechanism comprising:

a conductive member having one of a cloth-like or sheet-like composition with slits therein such that the slits radially extend beyond an outer diameter of a contact member of the rotator received thereby, the conductive member being in electrical contact with an object configured to be electrified, the slits configured to receive the contact member therethrough and allow the conductive member to bend around the contact member when the conductive member is penetrated by the contact member such that an area in which a side surface of the conductive member and the contact member are in surface contact is increased while an edge of the slits do not contact the contact member, and the conductive member remaining slidably rotatable with respect to the contact member when the contact member penetrates the conductive member.

2. The mechanism according to claim 1, wherein a contact direction of the contact member with respective to the conductive member is a same direction as a bending direction of the conductive member.

3. The mechanism according to claim 1, wherein the conductive member has a portion of the cloth-like or sheet-like composition cutout to form a flap therethrough, and the conductive member is configured to receive the contact member through the cutout such that the flap of the conductive member is bent when the contact member penetrates through the cutout allowing the flap to substantially come into line contact with the contact member when the contact member penetrates through the cutout portion.

4. The mechanism according to claim 1, wherein the plurality of slits in the conductive member include a plurality of radial slits, the radial slits extending from an approximate center of a portion of the conductive member in a radial direction.

5. The mechanism according to claim 1, wherein the conductive member has a portion of the cloth-like or sheet-like composition cutout to form at least two flaps therethrough, the conductive member is configured to receive the contact member through the cutout such that the at least two flaps of the conductive member are bent when the contact member penetrates through the cutout, and the shape of the flaps are such that a contact area between the conductive member and the contact member is reduced toward a center of a cross-section of the contact member when the contact member penetrates through the cutout.

6. The mechanism according to claim 1, wherein the conductive member is a conductive cloth formed of a cloth-like material that is woven with at least one fiber of polyethylene terephthalate fiber, nylon fiber, and polyester fiber and nickel and copper.

7. An image carrier unit comprising:

the mechanism according to claim 1, wherein the rotator is an image carrier that includes, a cylindrical conductive base member, at least one of an electrophotographic photoreceptor layer, an electrostatic recording dielectric layer, and a magnetic recording magnetic layer on the conductive base member, a flange fixed to at least one end portion of the image carrier, and a metal conductive member, a base end portion of the metal conductive member comes into contact with the conductive member and is mounted on the flange while a tip portion of the metal conductive member is fixed to an inner wall of the conductive base member, wherein the contact member is a shaft where the rotator is rotatable supported, the shaft passing through a center portion of the flange, the conductive member is bent and comes into contact with the shaft when the shaft passes through the conductive member, and the conductive base member and the shaft are electrically connected to each other through the contact between the metal conductive member and the conductive member.

8. A process cartridge that integrally supports at least one of the image carrier, a charging unit, a cleaning unit, and a developing unit and the process cartridge being detachably mounted on a main body, the process cartridge comprising:

the image carrier unit according to claim 7.

9. An image forming apparatus comprising:

the image carrier unit according to claim 7.

10. An image forming apparatus comprising:

the process cartridge according to claim 8.

11. A belt unit comprising:

the mechanism according to claim 1;

an endless belt that carries and conveys at least one of a transfer image and a transferrable image;

a plurality of rotary members, the belt being stretched along the plurality of rotary members and one of the plurality of rotary members serving as a driving rotary member;

a driving unit that drives the driving rotary member;

a driven rotary member that supports the belt in cooperation with the driving rotary member, at least one of the driving rotary member and the driven rotary member being a hollow rotary member that includes a cylindrical conductive base member, the hollow rotary member being the rotator;

a flange fixed to at least one end portion of the hollow rotary member; and a metal conductive member, a base end portion of the metal conductive member coming into contact with the conductive member and the base end portion being mounted on the flange while a tip portion of the metal conductive member being fixed to an inner wall of the conductive base member, wherein the contact member is a shaft where the hollow rotary member is rotatably supported, the shaft passing through a center portion of the flange, the conductive member is bent and comes into contact with the shaft when the shaft passes through the conductive member, and the conductive base member and the shaft are electrically connected to each other through the contact between the metal conductive member and the conductive member.

12. A fixing unit that conveys a sheet recording medium on which an unfixed transfer image is formed and that makes the sheet recording medium to pass a nip portion to thereby fix the unfixed transfer image to the sheet recording medium, the fixing unit comprising:

a heating member that includes a heat source and an elastic layer;

a pressurizing member that comes into press contact with the heating member to form the nip portion; and the mechanism according to claim 1, wherein the contact member is a rotating shaft disposed on at least one of the heating member and the pressurizing member, and the rotating shaft on at least one of the heating member and the pressuring member causes the conductive member to bend and come into contact with the rotating shaft when the rotating shaft passes through the conductive member, thereby establishing electrical connection with the object via the conductive member.

13. A conveying unit that is rotatably supported by a supporting member configured to support a rotary shaft disposed on a conveying member for conveying a sheet recording medium, and that electrifies static electricity generated by triboelectric charge between the conveying member and the sheet recording medium, the conveying unit comprising:

the mechanism according to claim 1, wherein, the contact member is the rotary shaft that is disposed on the conveying member and being conductive, and the rotary shaft causes the conductive member to bend and come into contact with the rotary shaft when the rotary shaft passes through the conductive member, thereby establishing electrical connection, with the object via the conductive member.

14. A method of electrifying a rotator of an image forming apparatus, the method comprising:

electrifying an object, the object electrically connected to a conducive member having one of a cloth-like or sheet-like composition with slits therein such that the slits radially extend beyond an outer diameter of a contact member of the rotator received thereby, the slits configured to receive the contact member therethrough; and penetrating the slits of the conductive member with the contact member such that the conductive member bends around the contact member increasing an area in which a side surface of the conductive member and the contact member are in surface contact while an edge of the slits do not contact the contact member and the conductive member remains slidably rotatable with respect to the contact member.

15. A cloth-like or sheet-like conductive member having slits therein, a side surface of the slits configured to make surface contact with a contact member while an edge of the slits do not contact the contact member when the contact member penetrates the conductive member, the slits radially extending beyond an outer diameter of the contact member received thereby and the conductive member remaining slidably rotatable with respect to the contact member when the contact member penetrates the conductive member.

16. The conductive member according to claim 15, wherein the slits of the conductive member includes a plurality of first radial slits extending from an approximate center of the conductive member in a radial direction.

17. The conductive member according to claim 15, wherein a substantially circular portion of the conductive member corresponds to an area in which the contact member penetrates the conductive member, and the conductive member has the slits therein in a shape of a wavy or broken line that crisscrosses the circular portion of the conductive member.

18. The conductive member according to claim 15, wherein a substantially circular portion of the conductive member corresponds to an area in which the contact member penetrates the conductive member, and the slits of the conductive member include a plurality of first slits in the substantially circular portion thereof in a first direction and a plurality of second slits in the substantially circular portion in a second direction, the second direction being orthogonal to the first direction such that the substantially circular portion of the conductive member has a plurality of flaps therethrough.

* * * * *